US007087367B2

(12) United States Patent
Sasaki et al.

(10) Patent No.: US 7,087,367 B2
(45) **Date of Patent: *Aug. 8, 2006**

(54) SILVER SALT PHOTOTHERMOGRAPHIC DRY IMAGING MATERIAL

(75) Inventors: Takayuki Sasaki, Hachioji (JP); Akihisa Nakajima, Sagamihara (JP); Kiyokazu Morita, Kokubunji (JP)

(73) Assignee: Konica Minolta Medical & Graphic, INC, Tokyo (JP)

( * ) Notice: Subject to any disclaimer, the term of this patent is extended or adjusted under 35 U.S.C. 154(b) by 25 days.

This patent is subject to a terminal disclaimer.

(21) Appl. No.: 11/038,397

(22) Filed: Jan. 20, 2005

(65) Prior Publication Data

US 2005/0170300 A1 Aug. 4, 2005

(30) Foreign Application Priority Data

Jan. 30, 2004 (JP) ..... 2004-022721

(51) Int. Cl.
*G03C 1/00* (2006.01)
*G03C 1/06* (2006.01)
*G03C 1/005* (2006.01)

(52) U.S. Cl. ..... 430/617; 430/618; 430/619; 430/620; 430/605; 430/604; 430/631

(58) Field of Classification Search ..... 430/617–620, 430/604, 605, 631
See application file for complete search history.

(56) References Cited

U.S. PATENT DOCUMENTS

2005/0112514 A1* 5/2005 Kashiwagi ..... 430/619

* cited by examiner

*Primary Examiner*—Geraldine Letscher
(74) *Attorney, Agent, or Firm*—Lucas & Mercanti, LLP

(57) ABSTRACT

A photothermographic material is disclosed, comprising on a support a light-sensitive layer comprising a light-insensitive silver salt of an aliphatic carboxylic acid, light-sensitive silver halide grains, a reducing agent for silver ions and a binder, wherein the light-sensitive layer further comprises nonaqueous dispersion particles insoluble in organic solvents.

16 Claims, No Drawings

SILVER SALT PHOTOTHERMOGRAPHIC DRY IMAGING MATERIAL

FIELD OF THE INVENTION

The present invention relates to a thermally developable silver salt photothermographic dry imaging material (hereinafter, also denoted simply as thermally developable photographic material or photothermographic material).

BACKGROUND OF THE INVENTION

In the field of medical diagnosis and graphic arts, there have been concerns in processing of photographic film with respect to effluent produced from wet-processing of image forming materials, and recently, reduction of the processing effluent is strongly demanded in terms of environmental protection and space saving.

As a result, techniques have been sought which relate to photothermographic materials which can be effectively exposed employing laser imagers and laser image setters and can form clear black-and-white images with high resolution.

Such techniques are described in, for example, U.S. Pat. Nos. 3,152,904 and 3,487,075, both by D. Morgan and B. Shely, or D. H. Klosterboer et al., "Dry Silver Photographic Materials", (Handbook of Imaging Materials, Marcel Dekker, Inc. page 48, 1991). Also known are silver salt photothermographic materials which comprise a support having thereon an organic silver salt, photosensitive silver halide and a reducing agent. Since any liquid-type processing chemicals are not employed for the silver salt photothermographic materials, they exhibit advantages in that it is possible to provide a simpler environmentally friendly system to customers.

These silver salt photothermographic materials are characterized in that photosensitive silver halide grains as a photo-sensor and an organic silver salt as a supply source of silver ions are incorporated in a photosensitive layer and are thermally developed, commonly at 80 to 140° C., utilizing the incorporated reducing agent, without being fixed.

However, the aforesaid silver salt photothermographic materials tend to result in fogging during storage prior to thermal development, due to incorporation of organic silver salts, photosensitive silver halide grains and reducing agents. Further, after exposure, thermal development is commonly carried out at 80 to 250° C. followed by no fixing. Therefore, since all or some of the silver halide, organic silver salts, and reducing agents remain after thermal development, problems occur in which, during extended storage, image quality such as silver image tone tends to vary-due to formation of metallic silver by heat as well as light.

Techniques which overcome these problems are disclosed in Patent Documents Nos. 1, 2, U.S. Pat. No. 5,714,311, European Patent No. 1096310, and references cited therein, for example, JP-A Nos. 6-208192, 8-267934, 7-2781 and 6-208193. These techniques disclosed therein exhibit some effects, but are not sufficient to meet the market's requirements.

In addition, for the purpose of enhancing covering power (CP), when the number of photosensitive silver halide grains is increased while decreasing the diameter of the aforesaid grains, it has been found that problems occur in which variation and degradation of image quality such as tone of silver images are further accelerated due to effects of light incident to the aforesaid photosensitive slier halide grains during storage of the aforesaid photosensitive silver halide grains after development as well as while viewing them.

A technology employing a leuco dye capable of producing color is disclosed. This technology enables to adjust a hue of silver to a preferred color. The hue of silver is caused by a morphology of silver. Examples of such technology are disclosed in Japanese Patent Publication Open to Public Inspection (hereafter it is referred to as JP-A) Nos. 50-36110, 59-206831, 5-204087, 11-231460, 20002-169249 and 2002-236334. However, this technology is not fully effective to prevent change of color of silver after long-term storage.

It is disclosed another technology to prevent change and deterioration of silver caused by irradiation of light. That technology employs a halogenated compound capable of oxidizing a silver image by irradiation of light. Examples of compounds are shown in Patent Documents-Nos. 3, 4 and JP-A 50-120328. However, these compounds generally tend to exhibit an oxidizing property by an effect of heat. As a result, they have an effect of preventing fog formation but at the same time they may prevent formation of a silver image resulting in a loss of photographic speed, a loss of Dmax and a loss of a silver covering power.

These photothermographic materials can be prepared by performing coating and drying with relatively low energy so that it is popular to coat and dry a coating solution containing solvents such as an organic solvent but drying at a further lower energy is desired for the environment. However, a photothermographic material prepared at a lower temperature tends to result in an increase of the residual solvent content, not only producing problems in photographic performance such as sensitivity or fogging and image lasting quality but also causing odor unsuitable for product quality.

Further, to enhance transportability in equipments, it is necessary to enhance the friction factor of the surface of a photothermographic material.

Accordingly, there has been desired development of a technique for achieving markedly enhanced image quality to overcome problems inherent to the photothermographic imaging material and disadvantages of conventional corresponding techniques.

SUMMARY OF THE INVENTION

The present invention has come into being in view of the foregoing and it is therefore an object of the invention to provide a thermally developable silver salt photothermographic imaging material exhibiting enhanced sensitivity, minimized fogging, improved storage stability and reduced odor even after being dried at a relatively low temperature.

In one aspect the present invention is directed to a photothermographic material comprising light-insensitive aliphatic carboxylic acid silver salt grains, light-sensitive silver halide grains, a reducing agent for silver ions and a binder, wherein the photothermographic material is provided with a light-sensitive emulsion layer containing the light-sensitive silver halide grains and the light-sensitive layer contains a binder and nonaqueous dispersion particles insoluble in organic solvent.

DETAILED DESCRIPTION OF THE INVENTION

The foregoing nonaqueous dispersion particles insoluble in organic solvent include, for example, organic polymer particles such as those known as non-aqua dispersion particles (or NAD particles) and organic or inorganic composite particles, and polymeric particles formed of a polymerizable monomer containing an unsaturated double bond and resin-cured particles are also preferably usable in this invention. The nonaqueous dispersion particles refer to those which are capable of existing in the form of suspension when dispersed in a medium containing at least 80% water.

In the preparation of a light-sensitive emulsion coating solution, the use of a binder and nonaqueous dispersion particles results in enhanced dispersibility and superior storage stability and also leads to non-reticular particles, as compared to the case of preparing a coating solution of only a binder, whereby the odor of high boiling solvents or the like is reduced even when the photothermographic material is dried at a relatively low temperature after coating.

A polymerizable monomer containing an unsaturated double bond, used for preparation of the dispersion particles of this invention, preferably contains a hydroxy group and examples thereof include a hydroxyalkyl acrylate, a hydroxyalkyl methacrylate and their lactonization products (or lactone compounds derived from a hydroxyalkyl acrylate or hydroxyalkyl methacrylate). Examples of a hydroxyalkyl (having, for example, 1 to 6 carbon atoms) acrylate include 2-hydroxyethyl acrylate and 2-hydroxypropyl acrylate. Examples of a hydroxyalkyl (having, for example, 1 to 6 carbon atoms) methacrylate include 2-hydroxyethyl methacrylate and 2-hydroxypropyl methacrylate.

Specific examples of the foregoing lactonization products of a hydroxyalkyl acrylate and hydroxyalkyl methacrylate include a lactonized hydroxyalkyl acrylate and lactonized hydroxyalkyl methacrylate. The mixing proportion of a polymerizable monomer containing a hydroxyalkyl and an unsaturated double bond is preferably from 0.5% to 35.0% by weight of the whole monomers containing an unsaturated double bond, and more preferably from 1% to 30.0% by weight.

Polymerizable monomers containing a carboxyl group and an unsaturated double bond are usable for preparation of the dispersion particles of the invention. Examples of such monomers include acrylic acid, methacrylic acid, maleic acid and fumaric acid. A carboxyl group may exist in the form of an acid anhydride, such as maleic acid anhydride. These monomer components may be used alone or in combination thereof. The mixing proportion of a polymerizable monomer containing a carboxyl group and an unsaturated double bond is preferably from 0.1% to 10.0% by weight of the whole monomers containing an unsaturated double bond, and more preferably from 0.5% to 8.0% by weight. These polymerizable monomers containing an unsaturated double bond may be used singly or in combination.

Organic solvents usable for preparation of the dispersion particles include, for example, an aromatic type solvent, an aliphatic type solvent, an ester type solvent and a ketone type solvent. Examples of an aromatic type solvent include toluene and xylene; examples of an aliphatic type solvent include heptane, hexane, petroleum benzin, ligroin, mineral spirits, petroleum naphtha and kerosene; examples of a ketone type solvent include methyl ethyl ketone (also denoted simply as MEK), methyl isobutyl ketone and cyclohexanone; and examples of an ester type solvent include ethyl acetate, propyl acetate, isopropyl acetate, butyl acetate, isobutyl acetate, amyl acetate. These solvents may be used individually or in combination thereof. The foregoing organic solvents are preferably contained in an amount of 30 to 60 parts by weight, based on 100 parts by weight of copolymer.

The dispersion particles can be prepared usually by employing radical polymerization but the method thereof is not specifically limited. The polymerization is preferably conducted in the presence of a polymerization initiator. The reaction temperature preferably is from 50 to 200° C., and more preferably from 70 to 150° C. The reaction time preferably is from 3 to 12 hrs.

Further, non-aqueous dispersion particles of multi-layered acrylic rubber are also preferably usable as dispersion particles of this invention. The multi-layered acrylic rubber particles are preferably used. Such particles are each comprised of at least two layers comprising an outermost layer (or shell) of a glassy polymer (which exhibits a relatively high glass transition point, for example, 60° C. or more) and an inner layer (or core) of a rubbery polymer (which exhibits a relatively low glass transition point), Preferably, the foregoing multi-layer particles are comprised of at least three layers in which a glassy polymer layer is arranged inside the rubbery-polymer layer.

Crosslinked resin particles are also preferably used for preparation of the dispersion particles of this invention. There is preferably used a particulate obtained by allowing a monomer containing at least two unsaturated polymerizable groups and capable of crosslinking (hereinafter, also denoted as a crosslinkable monomer) to be copolymerized with other monomers. In one preferred embodiment, other monomers are chosen from those containing a functional group except for a polymerizable group, such as a carboxyl group, epoxy group, amino group, isocyanate group or hydroxyl group.

Examples of such a crosslinkable monomer include compounds containing plural unsaturated polymerization groups, such as divinyl benzene, diallylphthalate, ethylene glycol di(metha)acrylate, trimethylolpropane tri(metha) acrylate and pentaerythritol triacrylate.

Examples of the foregoing other monomers include butadiene, isoprene, dimethylbutadiene, chloroprene, 1,3-pentadiene, unsaturated nitrile compounds such as (metha)acrylonitrile, α-chloroacrylonitrile, α-chloromethylacrylonitrile, α-methoxyacrylonitrile, α-ethoxyacrylonitrile, crotonic acid nitrile, cinnamic acid nitrile, itaconic acid nitrile, maleic acid dinitrile and fumaric acid dinitrile; unsaturated amides such as (metha)acrylamide, N,N'-methylenebis(metha)acrylamide, N,N'-hexamethylenebis(metha)acrylamide, N-hydroxymethyl(metha)acrylamide, N-(2-hydroxyethyl) (metha)acrylamide, N,N-bis(2-hydroxyethyl)(metha) acrylamide, crotonic acid amide and cinnamic acid amide; (metha)acrylic acid esters such as (metha)acrylic acid methyl, (metha)acrylic acid ethyl, (metha)acrylic acid propyl, (metha)acrylic acid butyl, (metha)acrylic acid hexyl, (metha)acrylic acid lauryl, polyethylene glycol (metha)acrylate and polypropylene glycol (metha)acrylate; aromatic vinyl compounds such as styrene, α-methylstyrene and o-methoxystyrene; epoxy(metha)acrylates obtained by reaction of bisphenol A diglycidyl ether or glycol diglycidyl ether with (metha)acrylic acid or hydroxyalkyl (metha9acrylate; urethane (metha)acrylates obtained by reaction of hydroxyalkyl, (metha)acrylate and a polyisocyanate; unsaturated compounds containing an epoxy group such as glycidyl (metha)acrylate and (metha)acryl glycidyl ether; unsaturated acid compounds such as (metha)acrylic acid, itaconic acid, β-(metha)acryloxyethyl succinate, β-(metha)acryloxyethyl maleate, β-(metha)acryloxyethyl phthalate and β-(metha)acryloxyethyl hexahydrophthalate; unsaturated compounds containing an amino group such as dimethylamino(metha)acrylate and diethylamino(metha) acrylate; and unsaturated compounds containing a hydroxy group such as hydroxyethyl(metha)acrylate and hydroxypropyl(metha)acrylate.

A crosslinkable monomer constituting the foregoing crosslinked particles is preferably used in the range of from 1% to 20% by weight of the whole monomers used in copolymerization, more preferably from 1.5% to 15%, and still more preferably 2% to 10%.

Further, there are also preferably used crosslinked silicone resin beads, crosslinked acryl-styrene copolymer beads, crosslinked styrene resin beads, crosslinked polymethacrylic acid methyl beads, crosslinked resin particles formed of conjugated diene or conjugated diene-vinyl aromatic hydrocarbon particles and crosslinked urethane resin particles.

A crosslinked acryl-styrene copolymer which is in the form of beads, is preferred. These crosslinked acryl-styrene copolymer particles are fine spherical particles obtained by polymerization (such as suspension polymerization) of a styrene monomer and methyl methacrylate monomer together with a crosslinking agent. Various multi-functional monomers such as ethylene glycol methacrylate, divinylbenzene, 1,6-hexanediol and trimethylpropane are generally usable as a crosslinking agent.

There are also preferred crosslinked resin particles obtained by crosslinking one or more polymers formed of a conjugated diene or of a conjugated diene and a vinyl aromatic hydrocarbon, using an organic peroxide. A polymer used for forming crosslinked resin particles can be prepared by allowing the foregoing conjugated diene and vinyl aromatic hydrocarbon to polymerize through commonly known polymerization methods such as radical polymerization or anionic polymerization. In cases when a conjugated diene and a vinyl aromatic hydrocarbon are used as a monomer, the composition ratio of the diene and a vinyl aromatic hydrocarbon of the obtained polymer is variable within the range of from 99:1 to 5:95, and preferably from 95:5 to 10:90. The polymer composed of a diene and a vinyl aromatic hydrocarbon may be a random copolymer or a block copolymer, which can be prepared by conventional methods known in the art. For example, as described in U.S. Pat. No. 3,094,514, a random copolymer can be prepared by supplying a mixture of a diene and a vinyl aromatic hydrocarbon into a polymerization vessel at a slower polymerization rate than for usual polymerization. Further, as described in U.S. Pat. No. 3,451,988, a random copolymer can be prepared by allowing a mixture of a diene and a vinyl aromatic hydrocarbon to copolymerize in the presence of the polar compound described above or a randomizing agent.

Crosslinked urethane resin particles are also preferred as dispersion particles of this invention. There may be used polyvinyl alcohol, hydroxyalkyl cellulose, carboxyalkyl cellulose, gum arabic, polyacrylate, pblyacrylamide, polyvinyl pyrrolidone, copolymer of ethylene and maleic anhydride, commonly known nonionic, anionic or cationic surfactants or various protective colloids as a dispersion stabilizer to stabilize the dispersion of a urethane component in a dispersion medium. The urethane component refers to a mixture including a polyisocyanate compound as an essential ingredient and further optionally including a polyhydroxy compound having a functional group capable of reacting with an isocyanate group, a reaction catalyst and/or a polyamine compound, or its reaction product. To form crosslinked resin particles, at least one of these compounds is to contain an at least tri-functional reactive group.

Of the foregoing urethane components, an organic phase composed of a mixture of a polyisocyanate compound and optionally including a polyhydroxy compound and a reaction catalyst is finely dispersed in a dispersion medium, by using a dispersing apparatus. Alternatively, it may be mixed or coarsely dispersed using a commercial fluid stirrer, a high-rotating and high-shearing type stirrer, a colloid mill or an ultrasonic homogenizer, followed by being finely dispersed using a dispersing machine. Subsequently, a dispersion composed of the thus finely dispersed organic phase and a dispersion medium is heated to cause a hardening reaction to obtain crosslinked urethane particles. Alternatively, crosslinked urethane particles can be obtained by adding a polyamine to the dispersion to cause interfacial polymerization. Reaction of a polyisocyanate with a polyamine or water forms not only a urethane bond but also a urea bond, whereby tougher particles are obtained. In, that case, the reaction is conducted at a temperature of 20 to 200° C., and preferably 30 to 150° C.

Any of commonly known polyisocyanate compounds is usable in this invention and representative ones are shown below. Aliphatic isocyanate compounds include, for example, hexamethylene diisocyanate, 2,4-diisocyanate-1-1-methylcyclohexane, diisocyanate cyclobutane, tetramethylene diisocyanate, o-, m- or p-xylilene diisocyanate, hydrogenated xylilene diisocyanate, dicyclohexylmethane diisocyanate, dimethyldicyclohexylmethane diisocyanate, lysine diisocyanate, cyclohexane diisocyanate, dodecane diisocyanate, tetramethylxylene diisocyanate, and isophorone diisocyanate.

Aromatic isocyanate compounds include isocyanate monomers such as tolylene-2,4-diisocyanate, tolylene-2,6-diisocyanate, diphenylmethane-4,4'-diisocyanate, 3-methyldiphenylmethane-4,4'-diisocyanate, m- or p-phenylenediamine diisocyanate, chlorophenylene-2,4-diisocyanate, naphthalene-1,5-diisocyanate, diphenyl-4,4'-diisocyanate, 3,3'-dimethyldiphenyl-1,3,5-triisopropylbenzene-2,4-diisocyanate, carbodiimide-modified diphenylmethane diisocyanate, polyphenylpolymethylene-isocyanate and diphenyl ether diisocyanate; and modified polyisocyanates based on the foregoing various monomers, for example, polyurethane polyisocyanate obtained by allowing one or more isocyanate monomers in excess to react with a polyhydroxy compound, as represented by polyhydric alcohol such as dihydric alcohol, trihydric alcohol and tetrahydric alcohol, a polyisocyanate containing a isocyanuric ring, obtained by allowing the foregoing polyisocyanate monomers to polymerize, and a polyisocyanate having a biuret bond, obtained by reaction with water. The number-average molecular weight of a polyisocyanate described above is from 200 to 10,000, and preferably from 300 to 7,000.

The nonaqueous dispersion particles of this invention usually have an average primary particle size (ϕn) of 0.05 to 2.0 μm in a dry state, preferably 0.05 to 0.5 μm, and still more preferably 0.05 to 0.3 μm. An average particle size (ϕn) of less than 0.05 μm tends to cause aggregation of particles, rendering it difficult to achieve homogeneous dispersion in an organic solvent. An average particle size (ϕn) of more than 2 μm often causes coat haze.

One feature of the dispersion particles of this invention is that the particles are insoluble in an organic solvent.

Specific examples of the dispersion particles of this invention are shown below but are not limited to these.

PB-1: STAPHYLOID IM-101 (GANZ CHEMICAL CO., LTD.)

PB-2: STAPHYLOID IM-203 (GANZ CHEMICAL CO., LTD.)

PB-3: STAPHYLOID IM-401 (GANZ CHEMICAL CO., LTD.)

PB-4: STAPHYLOID IM-601 (GANZ CHEMICAL CO., LTD.)

PB-5: STAPHYLOID AC3355 (GANZ CHEMICAL CO., LTD.)

PB-6: STAPHYLOID AC3364 (GANZ CHEMICAL CO., LTD.)

PB-7: Narpow VP-101 (Sanyo Boeki Co.)

PB-8: Narpow VP-301 (Sanyo Boeki Co.)

PB-9: Narpow VP-401 (Sanyo Boeki Co.)

PB-10: Narpow VP-601 (Sanyo Boeki Co.)

PB-11: AQUABRID 4735 (DAICEL CHEMICAL INDUSTRIES LTD)

One feature of the dispersion particles of this invention is that the particles are insoluble in an organic solvent.

Organic solvents used for coating solution of this invention preferably exhibit a solubility parameter (hereinafter, also denoted as a SP value) of from 7.5 to 12.5 (more preferably from 8.0 to 10.0). It is preferred to lessen the difference in SP value (or SP value difference) between the particles and an organic solvent to enhance dispersion stability, while optimal crosslinking of the particles results in reduced swelling. Specifically, it is preferred to use crosslinked resin particles having composition exhibiting an SP value difference of from 0 to 3.5 between the particles and an organic solvent.

The particles are mixed or coarsely dispersed in advance using a commercial fluid stirrer, a high-rotating and high-shearing type stirrer, a colloid mill or an ultrasonic homogenizer, followed by being finely dispersed using a high pressure homogenizer, also generally called a pressure nozzle type emulsifier, that is, jet type bubble homogenizer, or a micro-fluidizer (produced by Microfluidic Co.).

An SP value of an organic solvent of less than 7.5 or more than 12.5 results in deteriorated dispersibility of particles. Organic solvents exhibiting a boiling point of 60 to 200° C. are preferred in terms of being easily removed.

Examples of an organic solvent satisfying the foregoing SP value include ketones such as acetone, methyl ethyl ketone, methyl isobutyl ketone and cyclohexanone; ethylene glycol monomethyl ether, ethylene glycol monoethyl ether, ethylene glycol monopropyl ether, diethylene glycol monomethyl ether, diethylene glycol monoethyl ether, diethylene glycol monopropyl ether, propylene glycol monomethyl ether, propylene glycol monoethyl ether, propylene glycol monopropyl ether, and acetates of the foregoing ethers; ethers and esters such as ethyl acetate, propyl acetate, butyl acetate, ethyl lactate, butyl lactate, 3-methyl-3-methoxybutanol, 3-methyl-3-methoxybutyl acetate, and ethyl-3-ethoxypropionate; toluene, xylene, dimethylformamide and tetrahydrofuran. Of these, methyl ethyl ketone (exhibiting a SP value of 9.3) is preferred.

The dispersion particles insoluble in an organic solvent are preferably contained at 10% to 95% by weight of a polymer binder described below, more preferably 40% to 95%, and still more preferably 60% to 95%. A content of less than 10% tends to result in increased residual solvent, while a content of more than 95% tends to result in lowered dispersibility. The dispersion particle binder preferably exhibit a glass transition temperature (Tg) of from −40° C. to 105° C. An excessively low Tg becomes weaker against external stress and an excessively high Tg becomes inert to thermal development.

A binder containing the dispersion particles of this invention is used within the range capable of effectively functioning as a binder and the effective range can easily be determined by one skilled in the art. For example, as a measure of the case of holding an aliphatic carboxylic acid silver salt, the ratio of binder to aliphatic carboxylic acid silver salt is preferably from 15:1 to 1:2, and more preferably from 8:1 to 1:1. Namely, the binder content of the light-sensitive layer preferably is from 1.5 to 6 g/m$^2$, and more preferably from 1.7 to 5 g/m$^2$. A content of less than 1.5 g/m$^2$ results in a markedly increased density of the unexposed area, which is often an unacceptable level in practice.

Binder

Suitable binders for the silver salt photothermographic material are to be transparent or translucent and commonly colorless, and include natural polymers, synthetic resin polymers and copolymers, as well as media to form film. The binders include, for example, gelatin, gum Arabic, casein, starch, poly(acrylic acid), poly(methacrylic acid), poly(vinyl chloride), poly(methacrylic acid), copoly(styrene-maleic anhydride), copoly(styrene-acrylonitrile), copoly(styrene-butadiene), poly(vinyl acetals) (for example, poly(vinyl formal) and poly(vinyl butyral), poly(esters), poly(urethanes), phenoxy resins, poly(vinylidene chloride), poly(epoxides), poly(carbonates), poly(vinyl acetate), cellulose esters, poly(amides). The binders may be hydrophilic ones or hydrophobic ones.

Preferable binders for the photosensitive layer of the silver salt photothermographic material of this invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

In this invention, it is preferable that thermal transition point temperature, after development is at higher or equal to 100° C., is from 46 to 200° C. and is more preferably from 70 to 105° C. Thermal transition point temperature, as described in this invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic materials, a large endothermic peak appears at a temperature lower than the Tg value of the binder resin employed in the photosensitive layer. The inventors of this invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, this invention was achieved.

The glass transition temperature (Tg) is determined employing the method, described in Brandlap, et al., "Polymer Handbook", pages III-139 through III-179, 1966 (published by Wiley and Son Co.). The Tg of the binder composed of copolymer resins is obtained based on the following formula.

Tg of the copolymer (in ° C.)$=v_1Tg_1+v_2Tg_2+\ldots+v_nTg_n$ wherein $v_1, v_2, \ldots v_n$ each represents the mass ratio of the monomer in the copolymer, and $Tg_1, Tg_2, \ldots Tg_n$ each represents Tg (in ° C.) of the homopolymer which is prepared employing each monomer in the copolymer. The accuracy of Tg, calculated based on-the formula calculation, is ±5° C.

In the silver salt photothermographic material of this invention, employed as binders, which are incorporated into the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Ethylenically unsaturated monomers as constitution units forming homopolymers or copolymers include alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy)ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, there may be employed the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidehe chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, preferable examples include alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by formula (V) described below.

Formula (V)

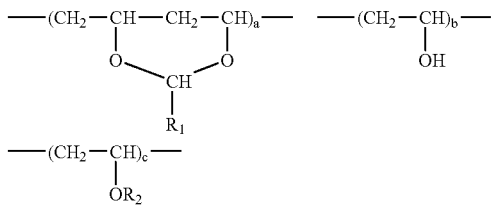

wherein $R_1$ represents a substituted-or unsubstituted alkyl group, and a substituted or unsubstituted aryl group, however, groups other than the aryl group are preferred; $R_2$ represents a substituted or unsubstituted alkyl group, a substituted or unsubstituted aryl group, —$COR_3$ or —$CONHR_3$, wherein $R_3$ represents the same as defined above for $R_1$. Unsubstituted alkyl groups represented by $R_1$, $R_2$, and $R_3$ preferably have 1 to 20 carbon atoms and more preferably have 1 to 6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have from 6 to 20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably from 1 to 20, while the number of total carbons of the substituted aryl group is preferably from 6 to 20.

$R_2$ is preferably —$COR_3$ (wherein $R_3$ represents an alkyl group or an aryl group) and —$CONHR_{53}$ (wherein $R_3$ represents an aryl group) "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c" is in the range of 0 to 40 mol percent. The repeated units having each composition ratio of "a", "b", and "c" may be the same or different.

Employed as polyurethane resins usable in this invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —$N(R_4)_2$, —$N^+(R_4)_3$ (wherein $R_{54}$ represents a hydrocarbon group, and a plurality of $R_{54}$ may be the same or different), an epoxy group, —SH, and —CN. The amount of such polar groups is commonly from $10^{-1}$ to $10^{-8}$ mol/g; and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH, groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/mm$^2$.

Polymers represented by the foregoing formula (V) of this invention can be synthesized employing common synthetic methods described in "Sakusan Binihru Jushi (Vinyl Acetate Resins)", edited by Ichiro Sakurada (Kohbunshi Kagaku Kankohkai, 1962).

Examples of representative synthetic methods will now be described. However, the present invention is not limited to these representative synthetic examples.

SYNTHESIS EXAMPLE 1

Synthesis of P-1

Charged into a reaction vessel were 20 g of polyvinyl alcohol (Gosenol GH18) manufactured by Nihon Gosei Co., Ltd. and 180 g of pure water, and the resulting mixture was dispersed in pure water so that 10 percent by weight polyvinyl alcohol dispersion was obtained. Subsequently, the resultant dispersion was heated to 95° C. and polyvinyl alcohol was dissolved. Thereafter, the resultant solution was cooled to 75° C., whereby an aqueous polyvinyl alcohol solution was prepared. Subsequently, 1.6 g of 10 percent by weight hydrochloric acid, as an acid catalyst, was added to the solution. The resultant solution was designated as Dripping Solution A. Subsequently, 11.5 g of a mixture consisting of butylaldehyde and acetaldehyde in a mol ratio of 4:5 was prepared and was designated as Dripping Solution B. Added to a 1,000 ml four-necked flask fitted with a cooling pipe and a stirring device was 100 ml of pure water which was heated to 85° C. and stirred well. Subsequently, while stirring, Dripping Solution A and Dripping Solution B were simultaneously added dropwise into the pure water over 2 hours, employing a dripping funnel. During the addition, the reaction was conducted while minimizing coalescence of deposit particles by controlling the stirring rate. After the dropwise addition, 7 g of 10 weight percent hydrochloric acid, as an acid catalyst, was further added, and the resultant mixture was stirred for 2 hours at 85° C., whereby the reaction had sufficiently progressed. Thereafter, the reaction mixture was cooled to 40° C. and was neutralized employing sodium bicarbonate. The resultant product was washed with water 5 times, and the resultant polymer was collected through filtration and dried, whereby P-1 was prepared. The Tg of obtained P-1 was determined employing a DSC, resulting in 83° C.

Other polymers described in Table 1 were synthesized in the same manner as above.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the aforesaid binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer | Acetoacetal mol % | Butyral mol % | Acetal mol % | Acetyl mol % | Hydroxyl Group mol % | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd.

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in the present invention may be various conventional cross-linking agents, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent Application Open to Public Inspection No. 50-96216. Of these, preferred are isocyanate based compounds, silane compounds, epoxy compounds or acid anhydrides, as shown below.

As one of preferred cross-linking agents, isocyanate based and thioisocyanate based cross-linking agents represented by Formula (IC), shown below, will now be described.

$$X{=}C{=}N\text{-}L\text{-}(N{=}C{=}X)_v \qquad \text{Formula (IC)}$$

wherein v represents 1 or 2; L represents an alkyl group, an aryl group, or an alkylaryl group which is a linking group having a valence of v+1; and X represents an oxygen atom or a sulfur atom.

Incidentally, in the compounds represented by aforesaid Formula (IC), the aryl ring of the aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

The aforesaid isocyanate based cross-linking agents are isocyanates having at least two isocyanate groups and adducts thereof. Specific examples thereof include aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols.

Employed as specific examples may be isocyanate compounds described on pages 10 through 12 of JP-A No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have "v" of 0, namely compounds having only one functional group.

Listed as examples of silane compounds which can be employed as a cross-linking agent in the present invention are compounds represented by General Formal (1) or Formula (2), described in JP-A No. 2002-22203.

In these Formulas, $R^1$, $R^2$, $R^3$, $R^4$, $R^5$, $R^6$, $R^7$, and $R^8$ each represents a straight or branched chain or cyclic alkyl group having from 1 to 30 carbon atoms, which may be substituted, (such as a methyl group, an ethyl group, a butyl group, an octyl group, a dodecyl group, and a cycloalkyl group), an alkenyl group (such as a propenyl group, a butenyl group, and a nonenyl group), an alkynyl group (such as an acetylene group, a bisacetylene group, and a phenylacetylene group), an aryl group, or a heterocyclic group (such as a phenyl group, a naphthyl group, a tetrahydropyrane group, a pyridyl group, a furyl group, a thiophenyl group, an imidazole group, a thiazole group, a thiadiazole group, and an oxadiazole group, which may have either an electron attractive group or an electron donating group as a substituent.

At least one of substituents selected from $R^1$, $R^2$, $R^3$, $R^4$, $R^5$, $R^6$, $R^7$, and $R^8$ is preferably either a non-diffusive group or an adsorptive group. Specifically, $R^2$ is preferably either a non-diffusive group or an adsorptive group.

Incidentally, the non-diffusive group, which is called a ballast group, is preferably an aliphatic group having at least 6 carbon atoms or an aryl group substituted with an alkyl group having at least 3 carbon atoms. Non-diffusive properties vary depending on binders as well as the used amount of cross-linking agents. By introducing the non-diffusive groups, migration distance in the molecule at room temperature is retarded, whereby it is possible to retard reactions during storage.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Preferred as epoxy compounds are those represented by the following formula (EP):

Formula (EP)

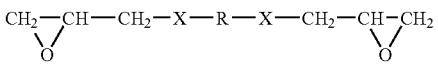

In the formula (EP), the substituent of the alkylene group represented by R is preferably a group selected from a halogen atom, a hydroxyl group, a hydroxyalkyl group, or an amino group. Further, the linking group represented by R preferably has an amido linking portion, an ether linking portion, or a thioether linking portion. The divalent linking group, represented by X, is preferably $—SO_2—$, $—SO_2NH—$, —S—, —O—, or $—NR_1—$, wherein $R_1$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/m$^2$, and is more preferably in the range of $1\times10^{-5}$ to $1\times10^{-3}$ mol/m$^2$.

The epoxy compounds may be incorporated in optional layers on the photosensitive layer side of a support, such as a photosensitive layer, a surface protective layer, an interlayer, an antihalation layer, and a subbing layer, and may be incorporated in at least two layers. In addition, the epoxy compounds may be incorporated in optional layers on the side opposite the photosensitive layer on the support. Incidentally, when a photosensitive material has a photosensitive layer on both sides, the epoxy compounds may be incorporated in any layer.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited, but the compounds represented by the following formula (SA) are preferred.

Formula (SA)

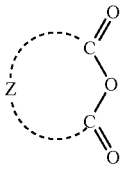

In the foregoing formula (SA), Z represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-6}$ to $1\times10^{-3}$ mol/m$^2$.

In the present invention, the acid anhydrides may be incorporated in optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

Silver Halide Grain

Next, there will be described light-sensitive silver halide grains used in the photothermographic material of this invention.

Light-sensitive silver halide grains used in this invention are those which are capable of absorbing light as an inherent property of silver halide crystal or capable of absorbing visible or infrared light by artificial physico-chemical methods, and which are treated or prepared so as to cause a physico-chemical change in the interior and/or on the surface of the silver halide crystal upon absorbing light within the region of ultraviolet to infrared.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide. Specifically, silver bromide or silver iodobromide is preferred. In the case of silver iodobromide, the iodide content thereof is preferably 0.02 to 6 mol %/Ag mol. The iodide may be distributed overall within grain or localized in a specific portion of the grain, such as a core/shell structure comprising the central portion containing a relatively high iodide and surface portion containing a relatively low or substantially no iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains.

In order to minimize cloudiness or yellowish coloring of images after image formation and to obtain excellent image quality, the less the average grain size, the more preferred. When particles of les than 02 μm are ignored, the average grain size is preferably from 0.030 μm to 0.55 μm.

The grain size as described above is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains.

The monodisperse grains as described herein refer to grains having a coefficient of variation of grain size obtained by the formula described below of not more than 30%; more preferably not more than 20%, and still more preferably not more than 15%:

Coefficient of variation of grain size=standard deviation of grain diameter/average grain diameter×100(%)

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$—YO(CH_2CH_2O)m(C(CH_3)CH_2O)p(CH_2CH_2O)_nY$$

where Y is a hydrogen atom, $—SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also-preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5 mol/l, and more preferably 0.01 to 2.5 mol/l. The flow rate of aqueous silver salt solution is preferably $1.5\times10^{-3}$ to $3.0\times10^{-1}$ mol/min per liter of the solution, and more preferably $3.0\times10^{-3}$ to $8.0\times10^{-2}$ mol/min. per liter of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

One feature of silver halide grains of this invention is that the silver halide grains form latent images capable of acting as a catalyst in development (or reduction reaction of silver ions by a reducing agent) upon exposure to light prior to thermal development on the silver halide grain surface, and upon exposure after completion of thermal development, images are formed preferentially in the interior of the grains (i.e., internal latent image formation), thereby suppressing latent image formation on the grain surface. Thus, silver halide grains which exhibit remarkable change of the function of latent image formation before and after thermal development were used in the photothermographic material of this invention, thereby leading to further enhanced effects of this invention.

In general, when exposed to, light, light-sensitive silver halide grains or spectral sensitizing dyes adsorbed onto the surfaces of the silver halide grains are photo-excited to form free electrons. The thus formed electrons are trapped competitively by electron traps on the grain surface (sensitivity center) and internal electron traps existing in the interior of the grains. In cases when chemical sensitization centers (chemical sensitization nuclei) or dopants useful as a electron trap exist more on the surface than the interior of the grain, latent images are more predominantly on the surface than in the interior of the grain, rendering the grains developable. On the contrary, the chemical sensitization centers or dopants useful as electron traps, which exist more in the interior than the surface of the grains form latent images preferentially in the interior rather than the surface of the grains, rendering the grain undevelopable. Alternatively, it can be said that, in the former case, the grain surface has higher sensitivity than the interior; in the latter case, the surface has lower sensitivity than the interior. The foregoing is detailed, for example, in T. H. James, The Theory of the Photographic Process, 4th Ed. (Macmillan Publishing Co., Ltd., 1977 and Nippon Shashin Gakai Ed., "Shashin Kogaku no Kiso (Gin-ene Shashin)" (Corona Co., Ltd., 1998).

In one preferred embodiment of this invention, light-sensitive silver halide grains each internally contains an electron-trapping dopant. Thus, it is preferred to cause an electron trapping dopant to be occluded in the interior of light-sensitive silver halide grains, resulting in enhanced sensitivity and improved image storage stability. The dopant is more preferably one which functions as a hole trap when exposed prior to thermal development and which also functions as an electron trap after subjected to thermal development.

The electron trapping dopant is an element or compound, except for silver and halogen forming silver halide, referring to one having a property of trapping free electrons or one whose occlusion within the grain causes a site such as an electron-trapping lattice imperfection. Examples thereof include metal ions except for silver and their salts or complexes; chalcogen (elements of the oxygen group) such as sulfur, selenium and tellurium; chalcogen or nitrogen containing organic or inorganic compounds; and rare earth ions or their complexes.

Examples of the metal ions and their salts or complexes include a lead ion, bismuth ion and gold ion; lead bromide, lead carbonate, lead sulfate, bismuth nitrate, bismuth chloride, bismuth trichloride, bismuth carbonate, sodium bismuthate, chloroauric acid, lead acetate, lead stearate and bismuth and acetate.

Compounds containing chalcogen such as sulfur, selenium or tellurium include various chalcogen-releasing compounds, which are known, in the photographic art, as a chalcogen sensitizer. The chalcogen0 or nitrogen-containing organic compounds are preferably heterocyclic compounds. Examples thereof include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetrazaindene; preferred of these are imidazole, pyridine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetrazaindene. The foregoing heterocyclic compounds may be substituted with substituents. Examples of substituents include an alkyl group, alkenyl group, aryl group, alkoxy group, aryloxy group, acyloxy group, acyl group, alkoxycarbonyl group, aryloxycarbonyl group, acyloxy group, acylamino group, alkoxycarbonylamino group, aryloxycarbonylamino group, sulfonylamino group, sulfamoyl group, carbamoyl group, sulfonyl group, ureido group, phosphoric acid amido group, halogen atoms, cyano group, sulfo group, carboxyl group, nitro group, and heterocyclic group; of these, an alkyl group, aryl group, alkoxy group, aryloxy group, acyl group, acylamino group, alkoxycarbonylamino group, sulfonylamino group, sulfamoyl group, carbamoyl group, sulfonyl group, ureido group, phosphoric acid amide group, halogen atoms, cyano group, nitro group and heterocyclic group are preferred; and an alkyl group, aryl group, alkoxy group, aryloxy group, acyl group, acylamino group, sulfonylamino group, sulfamoyl group, carbamoyl group, halogen atoms, cyano group, nitro group, and heterocyclic group are more preferred.

Silver halide grains used in this invention may occlude transition metal ions selected from group 6 to 11 of the periodical table whose oxidation state is chemically prepared in combination with ligands so as to function as an electron-trapping dopant and/or a hole-trapping dopant. Preferred transition metals include W, Fe, Co, Ni, Cu, Ru, Rh, Pd, Re, Os, Ir and Pt.

The foregoing dopants may be used alone or in combination thereof, provided that at least one of the dopants needs to act as an electron-trapping dopant when exposed after being subjected to thermal development. The dopants can be introduced, in any chemical form, into silver halide grains. The dopant content is preferably $1\times10^{-9}$ to $1\times10$ mol, more preferably $1\times10^{-8}$ to $1\times10^{-1}$ mol, and still more preferably $1\times10^{-6}$ to $1\times10^{-2}$ mol per mol of silver. The optimum content, depending on the kind of the dopant, grain size or form of silver halide grains and other environmental conditions, can be optimized in accordance with the foregoing conditions.

In this invention, transition metal complexes or their ions, represented by the formula described below are preferred:

$$(ML_6)^m: \qquad \text{Formula}$$

wherein M represents a transition metal selected from elements in Groups 6 to 11 of the Periodic Table; L represents a coordinating ligand; and m represents 0, 1-, 2-, 3- or 4-. M is selected preferably from W, Fe, Co, Ni, Cu, Ru, Rh, Pd, Re, Os, Ir and Pt. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or suitable organic solvents (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening. Non-metallic dopants can also be introduced in a manner similar to the foregoing metallic dopants.

Whether a dopant has an electron-trapping property in the photothermographic material relating to this invention can be evaluated according to the following manner known in the photographic art. A silver halide emulsion comprising silver halide grains doped with a dopant is subjected to microwave photoconductometry to measure photoconductivity. Thus, the doped emulsion can be evaluated with respect to a decreasing rate of photoconductivity on the basis of a silver halide emulsion-containing no dopant. Evaluation can also be made based on comparison of internal sensitivity and surface sensitivity.

A photothermographic material relating to this invention can be evaluated with respect to effect of an electron trapping dopant, for example, in the following manner. The photothermographic material, prior to exposure, is heated under the same condition as usual thermal developing conditions and then exposed through an optical wedge to white light or light in the specific spectral sensitization region (for example, in the case when spectrally sensitized for a laser, light falling within such a wavelength region and in the case when infrared-sensitized, an infrared light) for a period of a given time and then thermally developed under the same condition as above. The thus processed photothermographic material is further subjected to densitometry with respect to developed silver image to prepare a characteristic curve comprising an abscissa of exposure and an ordinate of silver density and based thereon, sensitivity is determined. The obtained sensitivity is compared for evaluation with that of a photothermographic material using silver halide emulsion grains not containing an electron trapping dopant. Thus, it is necessary to confirm that the sensitivity of the photothermographic material containing the dopant is lower than that of the photothermographic material not containing the dopant.

A photothermographic material is exposed through an optical wedge to white light or a light within the specific spectral sensitization region (e.g., infrared ray) for a given time (e.g., 30 seconds) and thermally developed under usual practical thermal development conditions (e.g., 123° C., 15 seconds) and the sensitivity obtained based on the characteristic curve is designated as $S_1$. Separately, the photothermographic material, prior to exposure, is heated under the practical thermal development conditions and further exposed and thermally developed similarly to the foregoing and the sensitivity obtained based on a characteristic curve is designated as $S_2$. The ratio of $S_2/S_1$ of the photothermographic material relating to this invention is preferably not more than 0.2, more preferably not more than 0.1 (or 1/10 or less), still more preferably not more than 0.05 (or 1/20 or less), and further still more preferably not more than 0.02 (or 1/50 or less).

Specifically, the foregoing characteristics can be evaluated in the following manner. Thus, the photothermographic material is subjected to a heat treatment at a temperature of 123° C. for a period of 15 sec., followed by being exposed to white light (e.g., light at 4874K) or infrared light through an optical wedge for a prescribed period of time (within the range of 0.01 sec. to 30 min., e.g., 30 sec. using a tungsten light source) and being thermally developed at a temperature of 123° C. for a period of 15 sec. The thus processed photothermographic material is further subjected to densitometry with respect to developed silver image to prepare a characteristic curve comprising an abscissa of exposure and an ordinate of silver density and based thereon, sensitivity is determined, which is designated as $S_2$. Separately, the photothermographic material is exposed and thermally developed in the same manner as above, without being subjected to the heat treatment to determine sensitivity, which is designated $S_1$. The sensitivity is defined as the reciprocal of an exposure amount giving a density of a minimum density (or a density of the unexposed area) plus 1.0.

Silver halide may be incorporated into an image forming layer by any means, in which silver halide is arranged so as to be as close to reducible silver source (aliphatic carboxylic acid silver salt) as possible. It is general that silver halide, which has been prepared in advance; added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto. Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno-compounds and other halogen containing compounds. These compounds are detailed in U.S. Pat. Nos. 4,009,039, 3,457,075 and 4,003,749; British Patent 1,498,956; and JP-A Nos. 53-27027 and 53-25420. Silver halide can be formed by converting a part or all of an organic silver salt to silver halide through reaction of the organic silver salt and a halide ion. The silver halide separately prepared may be used in combination with silver-halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide grain emulsions used in the invention may be desalted after the grain formation, using the methods known in the art, such as the noodle washing method and flocculation process.

Aliphatic Carboxylic Acid Silver Salt

The light-insensitive silver salt of an aliphatic carboxylic acid relating to this invention will be described. The light-insensitive silver salts of aliphatic carboxylic acids (hereinafter, denoted as silver salts of fatty acids and also denoted as silver aliphatic carboxylates or organic silver salts) are a reducible silver source, and silver salts of organic acids are preferred and silver salts of long chain aliphatic carboxylic acid (also called fatty carboxylic acid or simply fatty acid) having 10 to 30 carbon atom, preferably 15 to 25 carbon atoms are more preferred. Examples of silver salt of long chain aliphatic carboxylic acids include silver salts of gallic acid, citric acid, behenic acid, stearic acid, arachidic acid, palmitic acid and lauric acid, and of these, silver behenate, silver arachidate and silver stearate are preferred.

The combined use of at least two kinds of silver salts of aliphatic carboxylic acids is preferable to enhance developability and to form images with high density and high contrast. For example, such silver salts can be prepared by adding an aqueous silver salt solution to a mixture of at, least two kinds of fatty acids. On the other hand, it is preferred from the point of view of image lasting quality that the content of silver salts of aliphatic carboxylic acids exhibiting a melting point of 50° C. or more (preferably 60° C. or more) is at least 60% (more preferably at least 70% and still more preferably at least 80%). In view thereof, the higher content of silver behenate is more preferable.

Aliphatic carboxylic acid silver salts can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Alkali metal salts usable in this invention include, for example, sodium hydroxide, potassium hydroxide and lithium hydroxide, and the combined use of sodium hydroxide and potassium hydroxide is preferred. The ratio of both hydroxides used in combination is preferably from 10:90 to 75:25. The combined use falling within the foregoing range can control the viscosity of a reaction mixture in a favorable state. When an aliphatic carboxylic acid silver salt is prepared in the presence of silver halide grains having grain sizes of 0.050 μm or less, A higher proportion of potassium of alkali metals of an alkali metal salt suitably inhibits dissolution and Ostwald ripening of silver halide grains. A higher potassium proportion results in reduced particle size of a fatty acid silver salt. The potassium salt proportion is preferably 50% to 100%, based total alkali metal salts used in the preparation of an aliphatic carboxylic acid silver salt. The alkali metal concentration preferably is from 0.1 to 0.3 mol per 1000 ml.

An emulsion containing aliphatic carboxylic acid silver salt particles according to the present invention is a mixture consisting of free aliphatic carboxylic acids which do not form silver salts, and aliphatic carboxylic acid silver salts. In view of storage stability of images, it is preferable that the ratio of the former is lower than the latter. Namely, the aforesaid emulsion according to the present intention preferably contains aliphatic carboxylic acids in an amount of 3 to 10 mol percent with respect to the aforesaid aliphatic carboxylic acid silver salt particles, and most preferably from 4 to 8 mol percent.

Incidentally, in practice, each of the amount of total aliphatic carboxylic acids and the amount of free aliphatic carboxylic acids is determined employing the methods described below. Whereby, the amount of aliphatic carboxylic acid silver salts and free aliphatic carboxylic acids, and each ratio, or the ratio of free carboxylic acids to total aliphatic carboxylic acids, are calculated.

Quantitative analysis of the amount of total aliphatic carboxylic acids (the total amount of these being due to both of the aforesaid aliphatic carboxylic acid silver salts and free acids is conducted according to the following procedure:

(1) A sample in an amount (the weight when peeled from a photosensitive material) of approximately 10 mg is accurately weighed and placed in a 200 ml eggplant type flask;
(2) Subsequently, 15 ml of methanol and 3 ml of 4 mol/L hydrochloric acid are added and the resulting mixture is subjected to ultrasonic dispersion for one minute;
(3) Boiling stones made of Teflon (registered trade name) are placed and refluxing is performed for 60 minutes;
(4) After cooling, 5 ml of methanol is added from the upper part of the cooling pipe and those adhered to the cooling pipe are washed into the ovoid flask (this is repeated twice);
(5) The resulting liquid reaction composition is subjected to extraction employing ethyl acetate (separation extraction is performed twice by adding 100 ml of ethyl acetate and 70 ml of water);
(6) Vacuum drying is then performed at normal temperature for 30 minutes;
(7) Placed in a 10 ml measuring flask is 1 ml of a benzanthorone solution as an internal standard (approximately 100 mg of benzanthrone is dissolved in toluene and the total volume is made to 100 ml by the addition of toluene);
(8) The sample is dissolved in toluene and placed in the measuring flask described in (7) and the total volume is adjusted by the addition of toluene;
(9) Gas chromatography (GC) measurements are performed under the measurement conditions below.

Apparatus: HP-5890+HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa Quantitative analysis of free aliphatic carboxylic acids is conducted according to the following procedure:

(1) A sample in an amount of approximately 20 mg is accurately weighed and placed in a 200 ml ovoid flask. Subsequently, 100 ml of methanol was added and the resulting mixture is subjected to ultrasonic dispersion (free organic carboxylic acids are extracted);
(2) The resulting dispersion is filtered. The filtrate is placed in a 200 ml ovoid flask and then dried up (free organic carboxylic acids are separated);
(3) Subsequently, 15 ml of methanol and 3 ml of 4 mol/L hydrochloric acid are added and the resulting mixture is subjected to ultrasonic dispersion for one minute;
(4) Boiling stones made of Teflon (registered trade mark) were added, and refluxing is performed for 60 minutes;

(5) Added to the resulting liquid reaction composition are 60 ml of water and 60 ml of ethyl acetate, and a methyl-esterificated product of organic carboxylic acids is then extracted to an ethyl acetate phase. Ethyl acetate extraction is performed twice;

(6) The ethyl acetate phase is dried, followed by vacuum drying for 3.0 minutes;

(7) Placed in a 10 ml measuring flask is 1 ml of a benzanthorone solution (being an internal standard and prepared in such a manner that approximately 100 mg of benzanthrone is dissolved in toluene and the total volume is made to 100 ml by the addition of toluene);

(8) The product obtained in (6) is dissolved in toluene and placed in the measuring flask described in (7) and the total volume is adjusted by the addition of more toluene;

(9) GC measurement is carried out using the conditions described below.

Apparatus: HP-5890+HP-Chemistation

Column: HP-1 30 m×0.32 mm×0.25 μm (manufactured by Hewlett-Packard)

Injection inlet: 250° C.

Detector: 280° C.

Oven: maintained at 250° C.

Carrier gas: He

Head pressure: 80 kPa

Aliphatic carboxylic acid silver salts according to the present invention may be crystalline grains which have the core/shell structure disclosed in European Patent No. 1168069A1 and Japanese Patent Application Open to Public Inspection No. 2002-023303. Incidentally, when the core/shell structure is formed, organic silver salts, except for aliphatic carboxylic acid silver, such as silver salts of phthalic acid and benzimidazole may be employed wholly or partly in the core portion or the shell portion as a constitution component of the aforesaid crystalline grains.

In the aliphatic carboxylic acid silver salts according to the present invention, it is preferable that the average circle equivalent diameter is from 0.05 to 0.80 μm, and the average thickness is from 0.005 to 0.070 μm. It is still more preferable that the average circle equivalent diameter is from 0.2 to 0.5 mm, and it is more preferable that the average circle equivalent diameter is from 0.2 to 0.5 μm and the average thickness is from 0.01 to 0.05 μm.

When the average circle equivalent diameter is less than or equal to 0.05 μm, excellent transparency is obtained, while image retention properties are degraded. On the other hand, when the average grain diameter is less than or equal to 0.8 μm, transparency is markedly degraded. When the average thickness is less than or equal to 0.005 μm, during development, silver ions are abruptly supplied due to the large surface area and are present in a large amount in the layer, since specifically in the low density section, the silver ions are not used to form silver images. As a result, the image retention properties are markedly degraded. On the other hand, when the average thickness is more than or equal to 0.07 μm, the surface area decreases, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, LTD.). The resultant negative image is converted to a digital image employing a scanner. Subsequently, by employing appropriate software, the grain diameter (being an equivalent circle diameter) of at least 300 grains is determined and an average grain diameter is calculated.

It is possible to determine the average thickness, employing a method utilizing a transmission electron microscope (hereinafter, also referred to as a TEM) as described below.

First, a photosensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. The ultra-thin slice is supported by a copper mesh and transferred onto a hydrophilic carbon layer, employing a glow discharge. Subsequently, while cooling the resultant slice at less than or equal to 130° C. employing liquid nitrogen, a bright field image is observed at a magnification of 5,000 to 40,000, employing TEM, and images are quickly recorded employing either film, imaging plates, or a CCD camera. During the operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, the organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo. Gakkai Kanto Shibu (Maruzen).

It is preferable that a TEM image, recorded in a suitable medium, is decomposed into preferably at least 1,024×1,024 pixels and subsequently subjected to image processing, utilizing a computer. In order to carry out the image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binary-coding process.

At least 300 of the thickness of aliphatic carboxylic acid silver salt particles, extracted as above, are manually determined employing appropriate software, and an average value is then obtained.

Methods to prepare aliphatic carboxylic acid silver salt particles, having the shape as above, are not particularly limited. It is preferable to maintain a mixing state during formation of an organic acid alkali metal salt soap and/or a mixing state during addition of silver nitrate to the soap as desired, and to optimize the proportion of organic acid to the soap, and of silver nitrate which reacts with the soap.

It is preferable that, if desired, the planar aliphatic carboxylic acid silver salt particles (referring to aliphatic carboxylic acid silver salt particles, having an average circle equivalent diameter of 0.05 to 0.80 μm as well as an average thickness of 0.005 to 0.070 μm) are preliminarily dispersed together with binders as well as surface active agents, and thereafter, the resultant mixture is dispersed employing a media homogenizer or a high pressure homogenizer. The preliminary dispersion may be carried out employing a common anchor type or propeller type stirrer, a high-speed rotation centrifugal radial type stirrer (being a dissolver), and a high-speed rotation shearing type stirrer (being a homomixer).

Further, employed as the aforesaid media homogenizers may be rotation mills such as a ball mill, a planet ball mill, and a vibration ball mill, media stirring mills such as a bead mill and an attritor, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, yttrium-stabilized zirconia, and zirconia-reinforced alumina (hereafter ceramics containing zirconia are abbreviated to as zirconia). The reason of the preference is that impurity formation due to friction with beads as well as the homogenizer during dispersion is minimized.

In apparatuses which are employed to disperse the planar aliphatic carboxylic acid silver salt particles of the present invention, preferably employed as materials of the members which come into contact with the aliphatic carboxylic acid silver salt particles are ceramics such as zirconia, alumina, silicon nitride, and boron nitride, or diamond. Of these, zirconia is preferably employed. During the dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at less than or equal to 45° C. The examples of the preferable operation conditions for the main dispersion are as follows. When a high-pressure homogenizer is employed as a dispersion means, preferable operation conditions are from 29 to 100 MPa, and at least double operation frequency. Further, when the media homogenizer is employed as a dispersion means, the peripheral rate of 6 to 13 m/second is cited as the preferable condition.

In the present invention, light-insensitive aliphatic carboxylic acid silver salt particles are preferably formed in the presence of compounds which function as a crystal growth retarding agent or a dispersing agent. Further, the compounds which function as a crystal growth retarding agent or a dispersing agent are preferably organic compounds having a hydroxyl group or a carboxyl group.

In the present invention, compounds, which are described herein as crystal growth retarding agents or dispersing agents for aliphatic carboxylic acid silver salt particles, refer to compounds which, in the production process of aliphatic carboxylic acid silver salts, exhibit more functions and greater effects to decrease the grain diameter, and to enhance monodispersibility when the aliphatic carboxylic acid silver salts are prepared in the presence of the compounds, compared to the case in which the compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable addition amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isostearic acid, isoarachidinic acid, isobehenic acid, or isohexaconic acid. Preferable side chains include an alkyl group and an alkenyl group having 4 or fewer carbon atoms. Further, there are included aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable addition amount is from 0.5 to 10.0 mol percent of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropyl methyl cellulose, polyvinylpyrrolidone, and gelatin. The preferable addition amount is from 0.1 to 20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease particle size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts to increase the distortion of crystal lattices whereby the particle size decreases due to non-formation of over-sized crystals.

Antifoggant and Image Stabilizer

As mentioned above, compared to conventional silver halide photographic materials, the greatest different point in terms of the structure of silver salt photothermographic materials is that in the latter materials, a large amount of photosensitive silver halide, organic silver salts and reducing agents is contained which are capable of becoming causes of generation of fogging and printout silver, irrespective of prior and after photographic processing. Due to that, in order to maintain storage stability before development and even after development, it is important to apply highly effective fog minimizing and image stabilizing techniques to silver salt photothermographic materials. Other than aromatic heterocyclic compounds which retard the growth and development of fog specks, heretofore, mercury compounds, such as mercury acetate, which exhibit functions to oxidize and eliminate fog specks, have been employed as a markedly effective storage stabilizing agents. However, the use of such mercury compounds may cause problems regarding safety as well as environmental protection.

The important points for achieving technologies for antifogging and image stabilizing are:

to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic material of the present invention will now be described.

In the silver salt photothermographic material of the present invention, one of the features is that bisphenols are mainly employed as a reducing agent, as described below. It is preferable that compounds are incorporated which are capable of deactivating reducing agents upon generating active species capable of extracting hydrogen atoms from the aforesaid reducing agents.

Preferred compounds are those which are capable of: preventing the reducing agent from forming a phenoxy radial; or trapping the formed phenoxy radial so as to stabilize the phenoxy radial in a deactivated form to be effective as a reducing agent for silver ions.

Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group.

More preferred are compounds having a sulfonyl group, a sulfoxide group or a phosphoryl group in the molecule.

Specific examples are disclosed in, JP-A Nos. 6-208192, 20001-215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in JP-A Nos. 50-120328, 59-57234, 4-232939, 6-208193, and 10-197989, as well as U.S. Pat. No. 5,460,938, and JP-A No. 7-2781. Specifically, in the imaging materials according to the present invention, specific examples of preferred compounds include halogen radical releasing compounds which are represented by Formula (OFI) below.

$$Q_2\text{-Y—C}(X_1)(X_3)(X_2) \qquad \text{Formula (OFI)}$$

In Formula (OFI), $Q_2$ represents an aryl group or a heterocyclic group; $X_1$, $X_2$, and $X_3$ each represent a hydrogen atom, a halogen atom, an acyl group, an alkoxycarbonyl group, an aryloxycarbonyl group, a sulfonyl group, or an aryl group, at least one of which is a halogen atom; and Y represents —C(═O)—, —SO— or —$SO_2$—.

The aryl group represented by $Q_2$ may be in the form of a single ring or a condensed ring, and is preferably a single ring or double ring aryl group having 6–30 carbon atoms (for example, phenyl and naphthyl) and is more preferably a phenyl group and a naphthyl group, and is still more preferably a phenyl group.

The heterocyclic group represented by $Q_2$ is a 3- to 10-membered saturated or unsaturated heterocyclic group containing at least one of N, O, or S, which may be a single ring or may form a condensed ring with another ring.

The heterocyclic group is preferably a 5- to 6-membered unsaturated heterocyclic group which may have a condensed ring, is more preferably a 5- to 6-membered aromatic heterocyclic group which may have a condensed ring, and is most preferably a 5- to 6-membered aromatic heterocyclic group which may have a condensed ring containing 1 to 4 nitrogen atoms. Heterocycles in such heterocyclic groups are preferably imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; are more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; are still more preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, triazole, benzimidazolei and benzthiazole; and are most preferably pyridine, thiadiazole, quinoline, and benzthiazole.

The aryl group and heterocyclic group represented by $Q_2$ may have a substituent other than —YU—C($X_1$)($X_2$)($X_3$). Substituents are preferably an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylimino group, a sulfamoyl group, a carbamoyl group, a sulfonyl group, a ureido group, a phosphoric acid amide group, a halogen atom, a cyano group, a sulfo group, a carboxyl group, a nitro group, and a heterocyclic group; are more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amide group, a halogen atom, a cyano group, a nitro group, and a heterocyclic group; are more preferably an alkyl group, an aryl group, an alkoxy group, an aryloxy group, an acyl group, an acylamino group, a sulfonylimino group, a sulfamoyl group, a carbamoyl group, a halogen atom, a cyano group, a nitro group, and a heterocyclic group; and are most preferably an alkyl group, an aryl group, are a halogen atom.

Each of $X_1$, $X_2$, and $X_3$ is preferably a halogen atom, a haloalkyl group, an acyl group, an alkoxycarbonyl group, an aryloxycarbonyl group, a carbamoyl group, a sulfamoyl group, a sulfonyl group, or a heterocyclic group; is more preferably a halogen atom, a haloalkyl group, an acyl group, an alkoxycarbonyl group, an aryloxycarbonyl group, or a sulfonyl group; is still more preferably a halogen atom or a trihalomethyl group; and is most preferably a halogen atom. Of halogen atoms preferred are a chlorine atom, a bromine atom and an iodine atom. Of these, a chlorine atom and a bromine atom are more preferred and a bromine atom is particularly preferred.

Y represents —C(═O)— or —$SO_2$—, and is preferably —$SO_2$—.

The added amount of these compounds is commonly $1\times10^{-4}$ to 1 mol per mol of silver, and is preferably $1\times10^{-3}$ to $5\times10^{-2}$ mol.

Incidentally, in the imaging materials according to the present invention, it is possible to use those disclosed in JP-A No. 2003-5041 in the manner as the compounds represented by aforesaid Formula (OFI).

Specific examples of the compounds represented by Formula (OFI) are listed below, however, the present invention is not limited thereto.

OFI-1

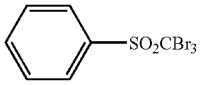

OFI-2

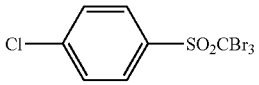

OFI-3

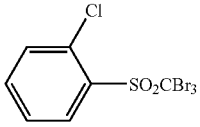

OFI-4

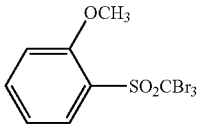

OFI-5

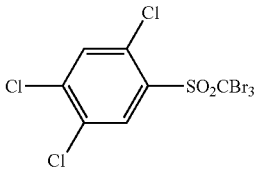

OFI-6

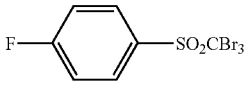

OFI-7

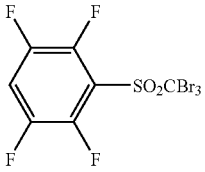

OFI-8

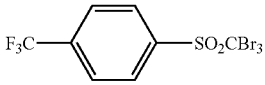

OFI-9

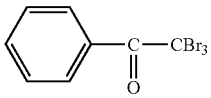

OFI-10

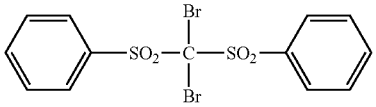

OFI-11

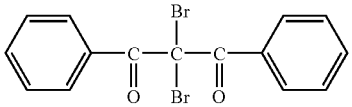

OFI-12

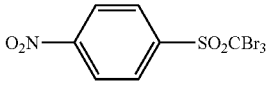

-continued

OFI-13

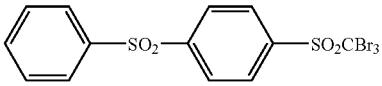

OFI-14

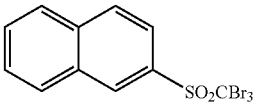

OFI-15

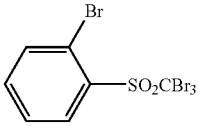

OFI-16

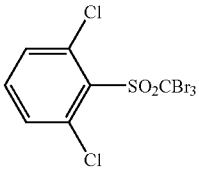

OFI-17

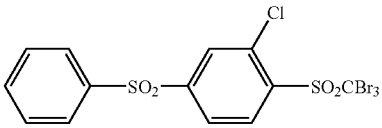

OFI-18

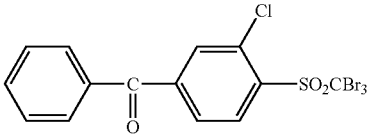

OFI-19

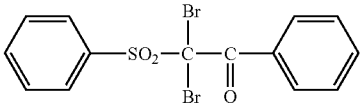

OFI-20

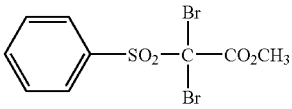

OFI-21

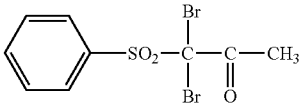

OFI-22

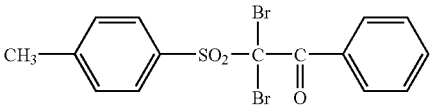

OFI-23

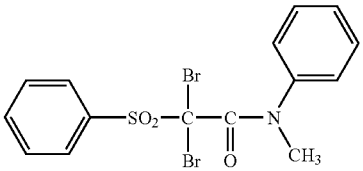

OFI-24

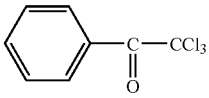

-continued
OFI-25
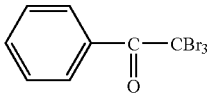
OFI-26
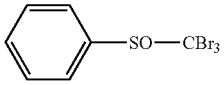
OFI-27
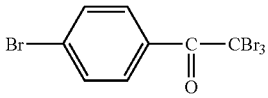
OFI-28
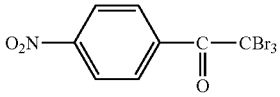
OFI-29
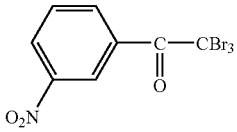
OFI-30
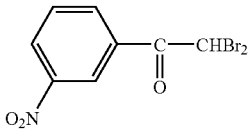
OFI-31
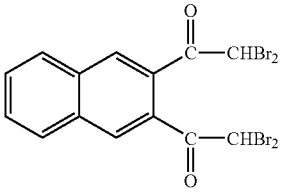
OFI-32
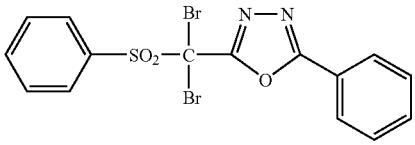
OFI-33
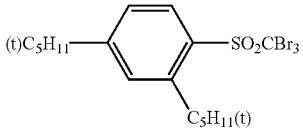
OFI-34
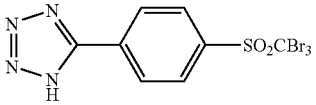
OFI-35
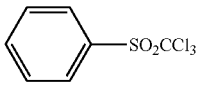
OFI-36
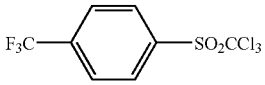
-continued
OFI-37
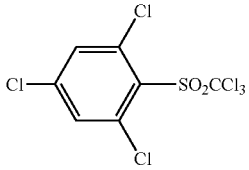
OFI-38
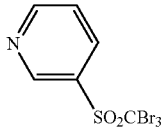
OFI-39
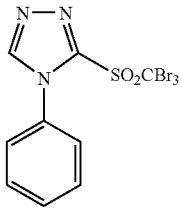
OFI-40
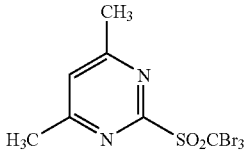
OFI-41
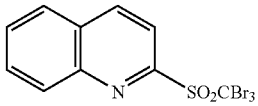
OFI-42
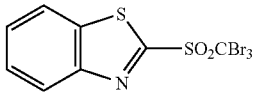
OFI-43
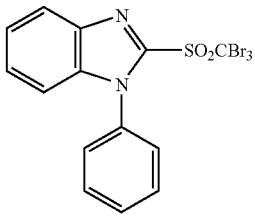
OFI-44
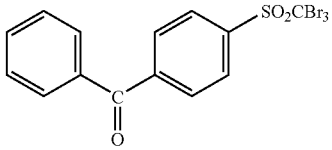
OFI-45
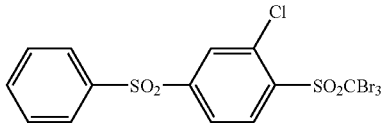
OFI-46
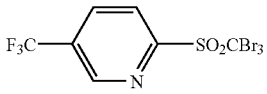

-continued

OFI-47

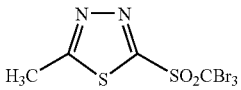

OFI-48

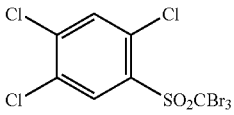

OFI-49

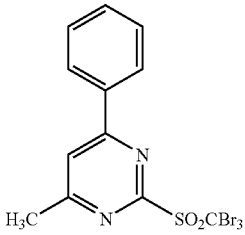

OFI-50

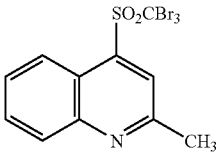

OFI-51

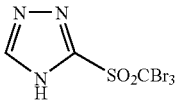

OFI-52

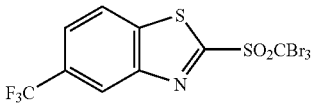

OFI-53

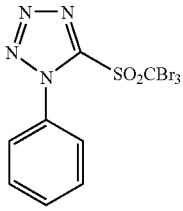

OFI-54

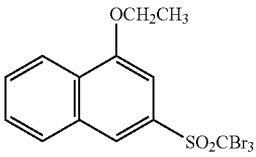

OFI-55

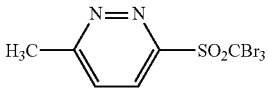

OFI-56

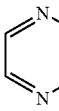

-continued

OFI-57

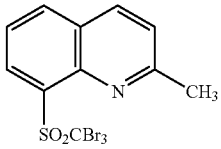

OFI-58

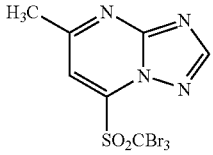

OFI-59

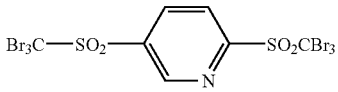

OFI-60

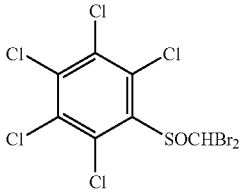

OFI-61

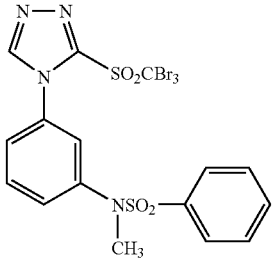

OFI-62

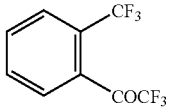

OFI-63

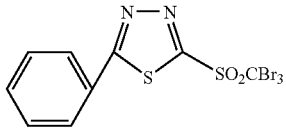

OFI-64

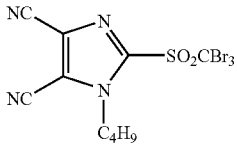

Further, in view of the capability of more stabilizing of silver images, as well as an increase in photographic speed and CP, it is preferable to use, in the photothermographic imaging materials according to the present invention, as an image stabilizer, polymers which have at least one repeating unit of the monomer having a radical releasing group disclosed in JP-A No. 2003-91054.

Specifically, in the photothermographic imaging materials according to the present invention, desired results are unexpectedly obtained.

Specific examples of polymers havin g a halogen radical releasing group are shown below. However, the present invention is not limited theret.

XP1

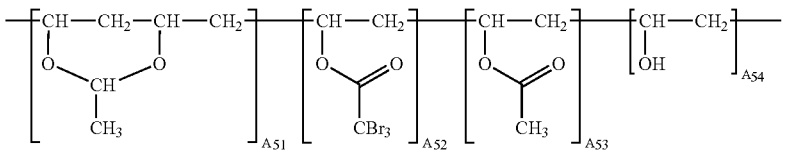

Number average molecular weight of 20,000
Composition (in weight percent) A51:A52:A53:A54 = 70:22:2:6 respectively

XP2

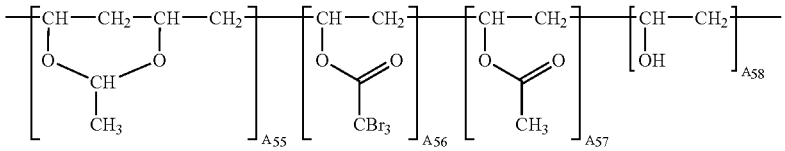

Number average molecular weight of 20,000
Composition (in weight percent) A55:A56:A57:A58 = 62:29:0.5:5.5 respectively

XP3

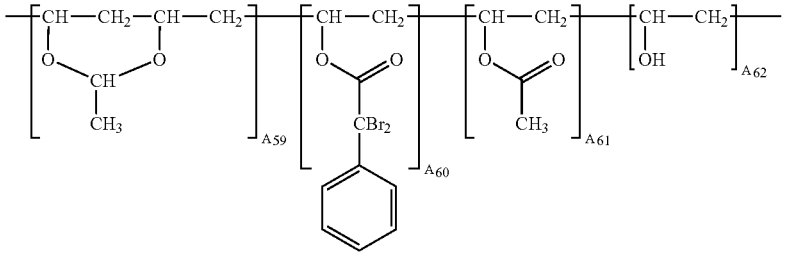

Number average molecular weight of 30,000
Composition (in weight percent) A59:A60:A61:A62 = 52:40:4:4 respectively

XP4

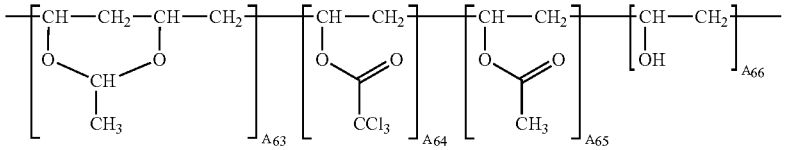

Number average molecular weight of 30,000
Composition (in weight percent) A63:A64:A65:A66 = 57:39:2:2 respectively

XP5

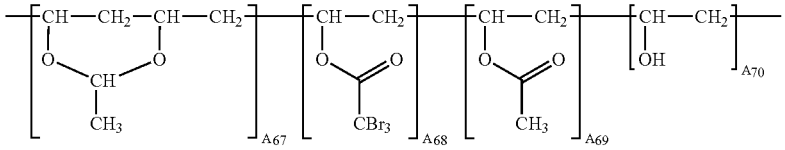

Number average molecular weight of 100,000
Composition (in weight percent) A67:A68:A69:A70 = 60:33:2:5 respectively

XP6

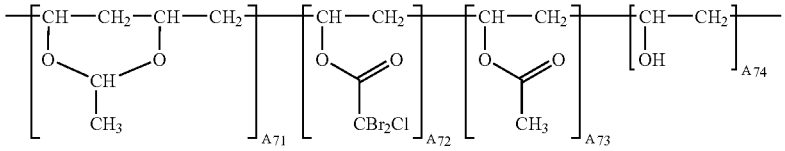

Number average molecular weight of 25,000
Composition (in weight percent) A71:A72:A73:A74 = 80:12:2:6 respectively -continued

XP7

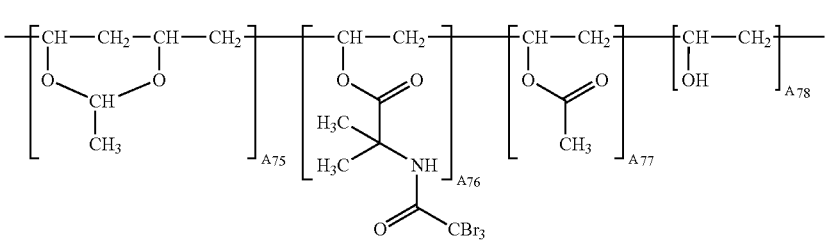

Number average molecular weight of 20,000
Composition (in weight percent) A75:A76:A77:A78 = 78:21:2:6 respectively

XP8

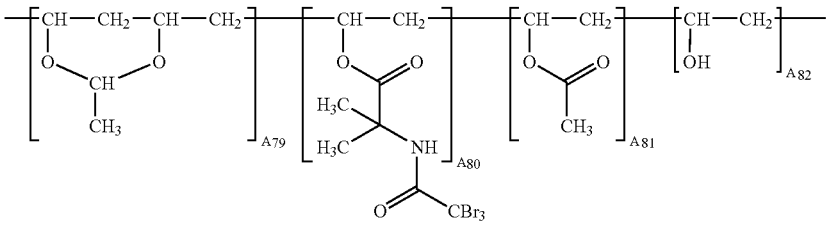

Number average molecular weight of 60,000
Composition (in weight percent) A79:A80:A81:A82 = 70:25:1:4 respectively

XP9

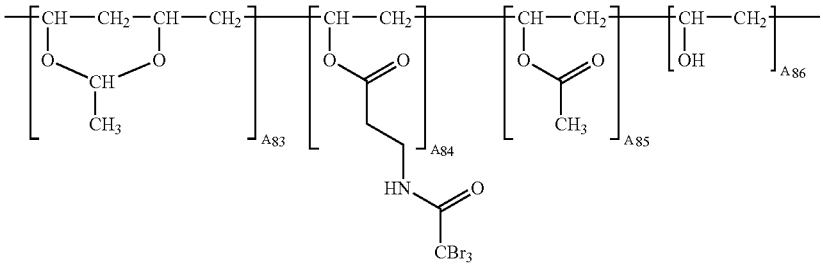

Number average molecular weight of 100,000
Composition (in weight percent) A83:A84:A85:A86 = 76:23:0.5:0.5 respectively

XP10

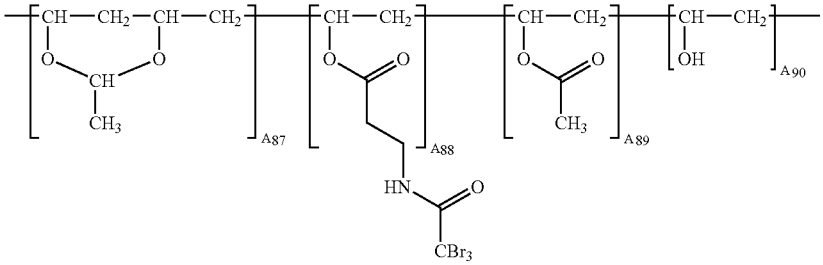

Number average molecular weight of 27,000
Composition (in weight percent) A87:A88:A89:A90 = 71:20:3:6 respectively Further, other than the above-mentioned compounds, compounds which are conventionally known as an antifogging agent may be incorporated in the silver salt photothermograpohic materials of the present invention. For example, listed are the compounds described in U.S. Pat. Nos. 3,589,903, 4,546,075, and 4,452,885, and JP-A Nos. 9-288328 and 9-90550. Listed as other antifogging agents are compounds disclosed in U.S. Pat. No. 5,028,523, and European Patent Nos. 600,587, 605,981 and 631,176.

In the imaging materials according to the present invention, it is preferable to use the compounds represented by the following formula (PC) as an antifogging agent and a storage stabilizer:

$$R\text{-}(CO\text{—}O\text{—}M)_n \qquad \text{Formula (PC)}$$

wherein R represents a linkable atom, an aliphatic group, an aromatic group, a heterocyclic group, or a group of atoms capable of forming a ring as they combine with each other; M represents a hydrogen atom, a metal atom, a quaternary ammonium group, or a phosphonium group; and n represents an integer of from 2 to 20.

Listed as linkable atoms represented by R are those such as nitrogen, oxygen, sulfur or phosphor.

Listed as aliphatic groups represented by R are straight or branched alkyl, alkenyl, alkynyl, and cycloalkyl groups having 1 to 30 and preferably 1 to 20 carbon atoms. Specific examples include methyl, ethyl, butyl, hexyl, decyl, dodecyl, isopropyl, t-butyl, 2-ethylhexyl, allyl, butenyl, 7-octenyl, propagyl, 2-butynyl, cyclopropyl, cyclopentyl, cyclohexyl, and cyclododecyl groups.

Listed as aromatic groups represented by R are those having 6 to 20 carbon atoms, and specific examples include phenyl, naphthyl, and anthranyl groups.

Heterocyclic groups represented by R may be in the form of a single ring or a condensed ring and include 5- or 6-membered heterocyclic groups which have at least O, S, or N atoms, or an amineoxido group. Listed as specific examples are pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isoxazole, isothiazole, triazole, tetrazole, thiadiazole, and oxadiazole, and groups derived from these benzelogues.

In the case in which R is formed employing $R_1$ and $R_2$, each $R_1$ or $R_2$ is defined as R, and $R_1$ and $R_2$ may be the same or different. Rings which are formed employing $R_1$ and $R_2$ include 4- to 7-membered rings. Of these, are preferred 5- to 7-membered rings. Preferred groups represented by $R_1$ and $R_2$ include aromatic groups as well as heterocyclic groups. Aliphatic groups, aromatic groups, or heterocyclic rigs may be further substituted with a substituent. Listed as the above substituents are a halogen atom (e.g., a chlorine atom or a bromine atom), an alkyl group (e.g., a methyl group, an ethyl group, an isopropyl group, a hydroxyethyl group, a methoxymethyl group, a trifluoromethyl group, or a t-butyl group), a cycloalkyl group (e.g., a cyclopentyl group or a cyclohexyl group), aralkyl group (e.g., a benzyl group or a 2-phenetyl group), an aryl group (e.g., phenyl group, a naphthyl group, a p-tolyi group, or a p-chlorophenyl group), an alkoxy group (e.g., a methoxy group, an ethoxy group, an isopropoxy group, or a butoxy group), an aryloxy group (e.g., a phenoxy group or a 4-methoxyphenoxy group), a cyano group, an acylamino group (e.g., an acetylamino group or a propionylamino group), an alkylthio group (e.g., a methylthio group, an ethylthio group, or a butylthio group), an arylthio group (e.g., a phenylthio group or a p-methylphenylthio group), a sulfonylamino group (e.g, a methanesulfonylamino group or a benzenesulfonylamino group), a ureido group (e.g., a 3-methylureido group, a 3,3-dimethylureido group, or a 1,3-dimethylureido group), a sulfamoylamino group (a dimethylsulfamoylamino group or a diethylsulfamoylamino group), a carbamoyl group (e.g., a methylcarbamoyl group, an ethylcarbmoyl group, or a dimerthylcarbamoyl group), a sulfamoyl group (e.g., an ethylsulfamoyl group or a dimethylsulfamoyl group), an alkoxycarbonyl group (e.g., a methoxycarbonyl group or an ethoxycarbonyl group), an aryloxycarbonyl group (e.g., a phenoxycarbonyl group or a p-chlorophenoxycarbonyl group), a sulfonyl group (e.g., a methanesulfonyl group, a butanesulfonyl group, or a phenylsulfonyl group), an acyl group (e.g., an acetyl group, a propanoyl group, or a butyroyl group), an amino group (e.g., a methylamino group, an ethylamino group, and a dimethylamino group), a hydroxy group, a nitro group, a nitroso group, an amineoxide group (e.g., a pyridine-oxide group), an imido group (e.g., a phthalimido group), a disulfide group (e.g., a benzenedisulfide group or a benzthiazoryl-2-disulfide group), and a heterocyclic group (e.g., a pyridyl group, a benzimidazolyl group, a benzthiazoyl group, or a benzoxazolyl group). $R_1$ and $R_2$ may each have a single substituent or a plurality of substituents selected from the above. Further, each of the substituents maybe further substituted with the above substituents. Still further, $R_1$ and $R_2$ may be the same or different. Yet further, when Formula (PC-1) is an oligomer or a polymer $(R\text{-}(COOM)_{n0})_m$, desired effects are obtained, wherein n is preferably 2–20, and m is preferably 1–100, or the molecular weight is preferably at most 50,000.

Acid anhydrides of Formula (PC-1), as described in the present invention, refer to compounds which are formed in such a manner that two carboxyl groups of the compound represented by Formula (PC-1) undergo dehydration reaction. Acid anhydrides are preferably prepared from compounds having 3 to 10 carboxyl groups and derivatives thereof.

Further preferably employed are simultaneously dicarboxylic acids described in JP-A Nos. 58-95338, 10-288824, 11-174621, 11-218877, 2000-10237, 2000-10236, and 2000-10231.

It is preferable that imaging materials according to the present invention contain the compounds represented by the following formula (ST):

$$Z\text{-}SO_2\text{.}S\text{-}M \qquad \text{formula (ST)}$$

wherein Z is a substituted or unsubstituted alkyl, aryl or heterocyclic group, and M is a metal atom or an organic cation.

The aforesaid compounds will now be detailed. In the compounds represented by Formula (ST), the alkyl group, aryl group, heterocyclic group, aromatic ring and heterocyclic ring, which are represented by Z may be substituted. Listed as the substituents may be, for example, a lower alkyl group such as a methyl group or an ethyl group, an aryl group such as a phenyl group, an alkoxyl group having 1–8 carbon atoms, a halogen atom such as chlorine, a nitro group, an amino group, or a carboxyl group. Metal atoms represented by M are alkaline metals such as a sodium ion or a potassium ion, while as the organic cation preferred are an ammonium ion or a guanidine group.

Listed as specific examples of the compounds represented by Formula (ST) may be those described below. However, the present invention is not limited thereto.

(ST-1) $CH_3SO_2SNa$ (ST-2) $C_2H_5SO_2SNa$ (ST-3) $HOOC—CH_2CH_2SO_2SK$ (ST-4) $(n)C_4H_9SO_2SNa$ (ST-5) $NC—CH_2CH_2CH_2SO_2SNa$ (ST-6) $(n)C_8H_{17}SO_2SNa$ (ST-7) $(n)C_{12}H_{25}SO_2SNa$ (ST-8) $ClCH_2(CH_2)_4SO_2SK$ (ST-9) $(n)C_{18}H_{37}SO_2SNa$ (ST-10) $(n)C_4H_9SO_2SK$ (ST-11) $(n)C_8H_{17}SO_2SK$ (ST-12)

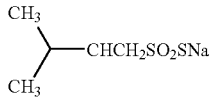

(ST-13)

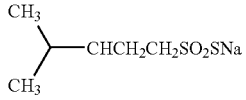

-continued (ST-14)

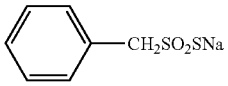

(ST-15)

$(n)C_8H_{17}SO_2S^- \cdot (n)(C_4H_9)_4N^+$ (ST-16)

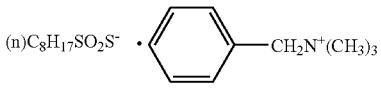

(ST-17)

$H_2N—CH_2CH_2SO_2SH$ (ST-18)

$CH_3O—CH_2CH_2SO_2SNa$ (ST-19)

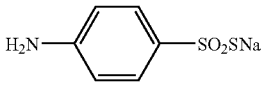

(ST-20)

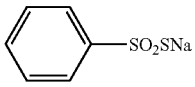

(ST-21)

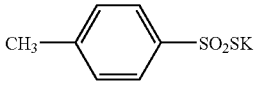

(ST-22)

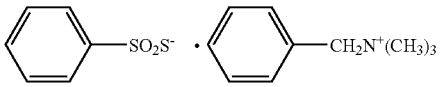

(ST-23)

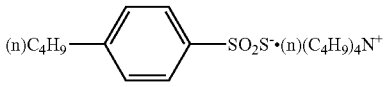

(ST-24)

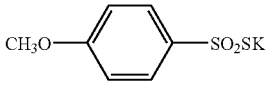

(ST-25)

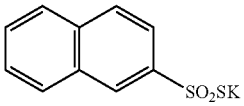

(ST-26)

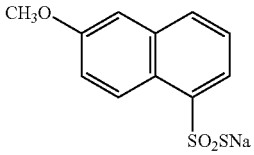

(ST-27)

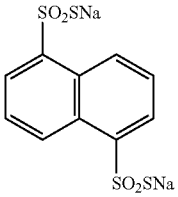

(ST-28)

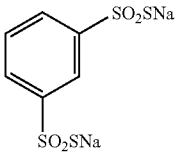

-continued (ST-29)

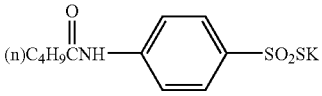

(ST-30)

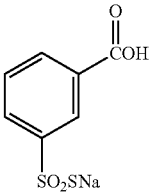

(ST-31)

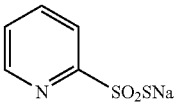

(ST-32)

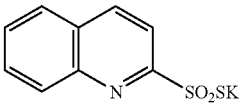

(ST-33)

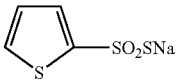

(ST-34)

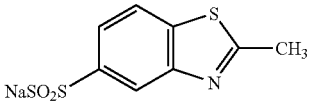

(ST-35)

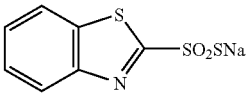

(ST-36)

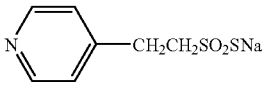

(ST-37)

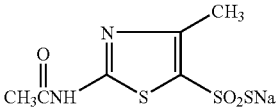

(ST-38)

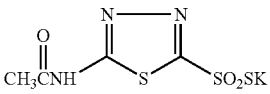

(ST-39)

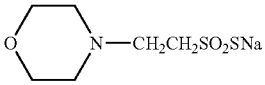

(ST-40)

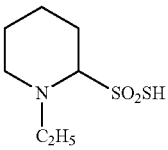

It is possible to synthesize the compounds represented by Formula (ST), employing methods which are generally well known. For example, it is possible to synthesize them employing a method in which corresponding sulfonyl fluoride is allowed to react with sodium sulfide, or corresponding sodium sulfinate is allowed to react with sulfur. On the other hand, these compounds are also easily available on the market.

The compounds represented by Formula (ST) may be added at any time prior to the coating process of the production process of the imaging materials according to the present invention. However, it is preferable that they are added to a liquid coating composition just before the coating.

The added amount of the compounds represented by Formula (ST) is not particularly limited, but is preferably in the range of $1\times10^{-6}$–1 g per mol of the total silver amount, including silver halides.

Further, similar compounds are disclosed in JP-A No. 8-314059.

In the present invention, it is preferable to simultaneously use the fog restrainers represented by aforesaid Formula (CV), that is, vinyl type restrainers containing an electron withdrawing group, as described in Japanese Patent Application No. 2003-199555.

The photothermographic material preferably contains a compound represented by the following formula (CV):

formula (CV)

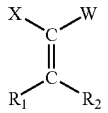

wherein, X represents an electron withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, X and $R_1$ may be a cis-form or a trans-form.

An electron withdrawing group represented by X is a substituent, Hammett's constant "σp" of which is positive. Specific example thereof include substituted alkyl groups (such as halogen-susbstituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. Provided that X does not represent a formyl group. The σp value is preferably not less than 0.2 and more preferably not less than 0.3.

W includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group. In addition to electron withdrawing groups having a positive Hammett's substituent constant up, except a formyl group, aryl groups and heterocyclic groups are also preferred as W.

X and W may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_1$ includes a hydroxyl group or organic or inorganic salts of the hydroxyl group. Specific examples of alkyl groups, alkenyl groups, alkynyl groups, aryl groups and heterocyclic groups represented by $R_2$ include each example of alkyl groups, alkenyl groups, alkynyl groups, aryl groups and heterocyclic groups exemplified as W.

Further, in this invention, any of X, W and $R_2$ may contain a ballast group. A ballast group means a so-called ballast group in such as a photographic coupler, which makes the added compound have a bulky molecular weight not to migrate in a coated film of a light-sensitive material.

Further, in this invention, X, W and $R_2$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of X and W represents a cyano group, or X and W form a cyclic structure by bonding to each other.

Further, compounds in which a thioether group (—S—) is contained in the substituents represented by X, W and $R_2$ are preferred in this invention.

Furthermore, preferable are those in which at least one of X and W is provided with an alkene group represented by following Formula (CV1):

—C(R)=C(Y)(Z) Formula (CV1)

wherein, R represents a hydrogen atom or a substituent, Y and Z each represent a hydrogen atom or a substituent, however, at least one of Y and Z represents an electron withdrawing group.

Examples of electron withdrawing groups among the substituents represented by Y and Z include the aforesaid electron withdrawing groups listed as X and W, such as a cyano group and a formyl group.

X and W represented by above Formula (CV1) include, for example, the following groups.

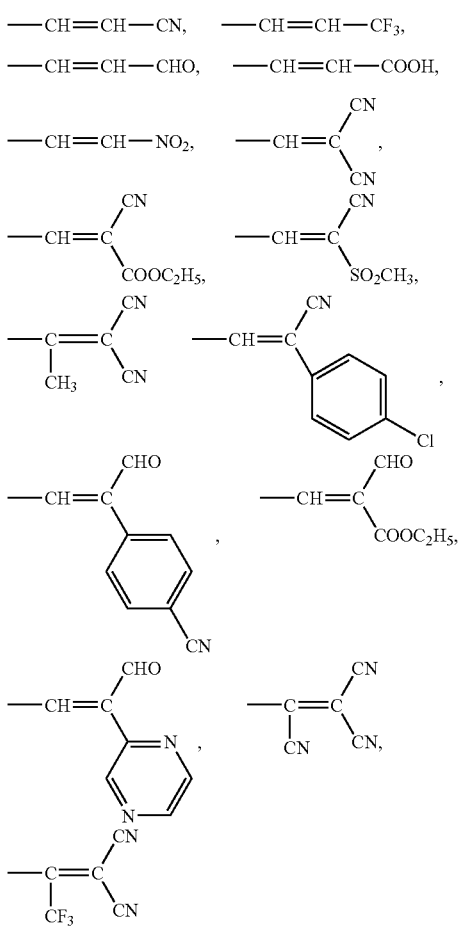

Further, those in which at least one of X and W is provided with alkyne groups described below are preferred:

—C≡C-$R_5$ wherein $R_5$ represents a hydrogen atom or a substituent, and the substituent is preferably an electron withdrawing group such as those listed in the aforesaid X and W. X and W represented by the above Formula (CV1)include the following groups:

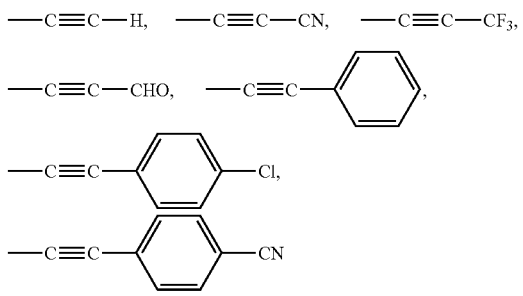

Further, at least one of X and W is preferably provided with an acyl group selected from a substituted alkylcarbonyl group, alkenylcarbonyl group and alkynylcarbonyl group, and X and W, for example, include the following groups:

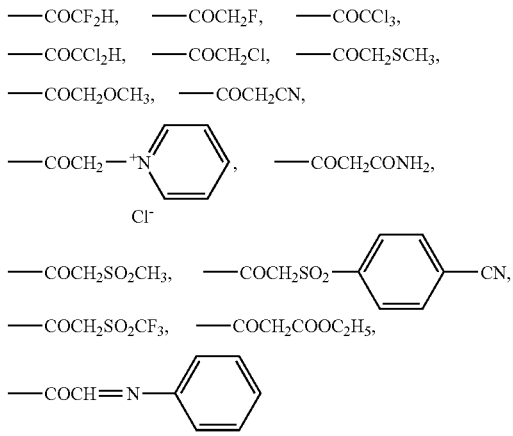

Further, at least one of X and W is preferably provided with an oxalyl group, and X and W provided with an oxalyl group include the following groups:

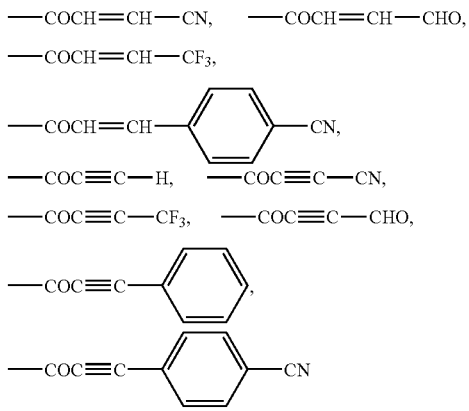

—$COCOCH_3$, —$COCOOC_2H_5$, —$COCONHCH_3$, —$COCOSC_2H_5$ and $COCOOC_2H_4SCH_3$.

Further, at least one of X and W is also preferably provided with an aryl group or a nitrogen containing hetrocyclic group substituted by an electron withdrawing group, and such X and W, for example, include the following groups.

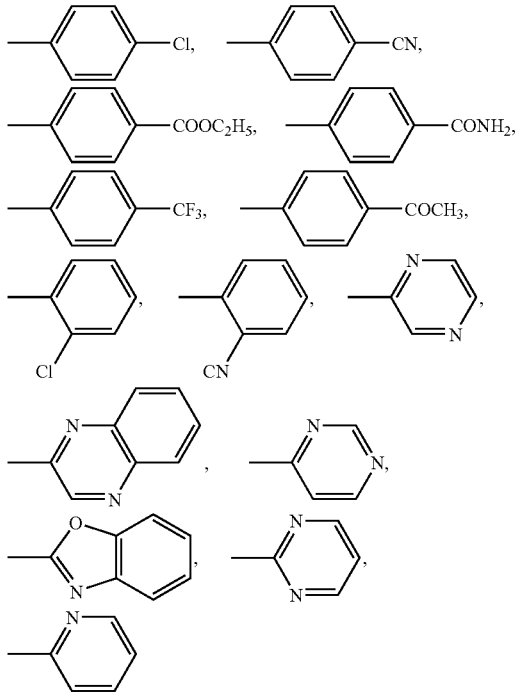

In this invention, alkene compounds represented by formula (CV) include every isomers when they can take isomeric structures with respect to a double bond, where X, W, $R_1$ and $R_2$ substitute, and also include every isomers when they can take tautomeric structures such as a keto-enol form.

In the following, specific examples of compounds represented by formula (CV) will be described, however; this invention is not limited thereto.

CV-1

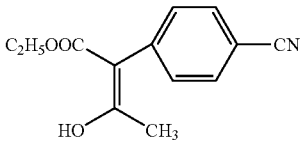

CV-2

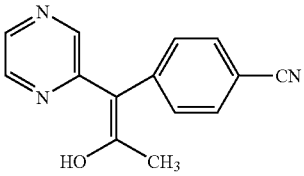

CV-3

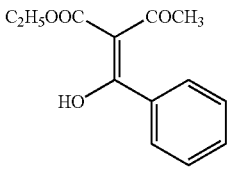

-continued

CV-4

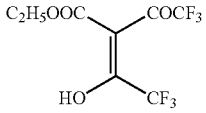

CV-5

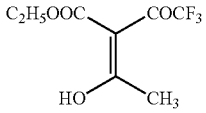

CV-6

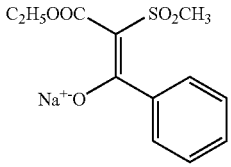

CV-7

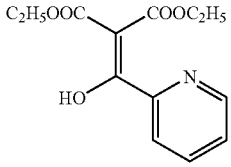

CV-8

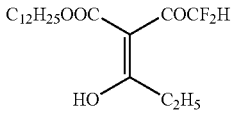

CV-9

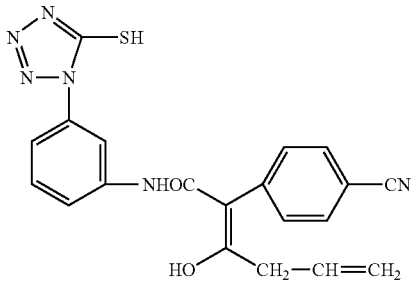

CV-10

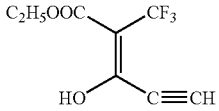

CV-11

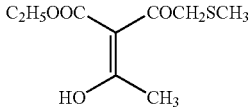

CV-12

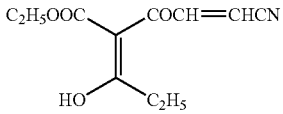

CV-13

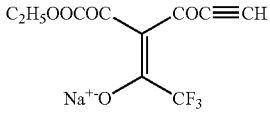

-continued
CV-14
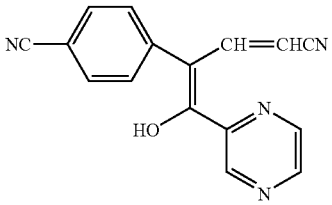
CV-15
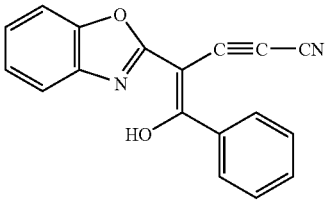
CV-16
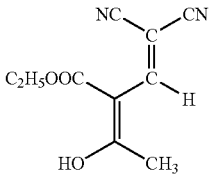
CV-17
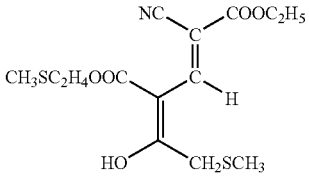
CV-18
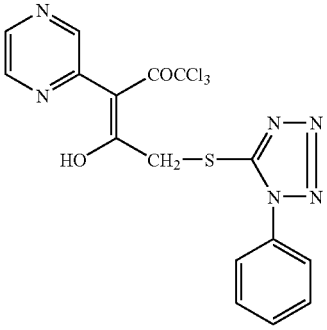
CV-19
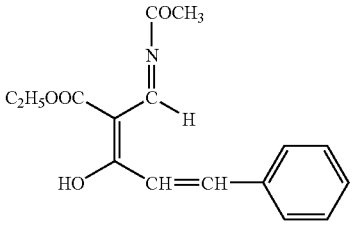
CV-20
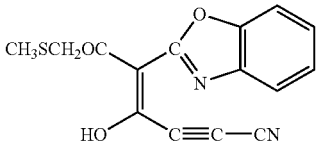
-continued
CV-21
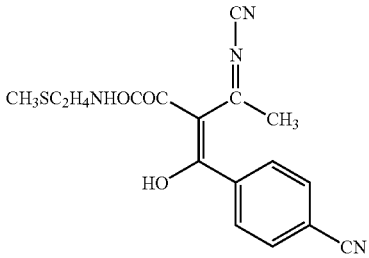
CV-22
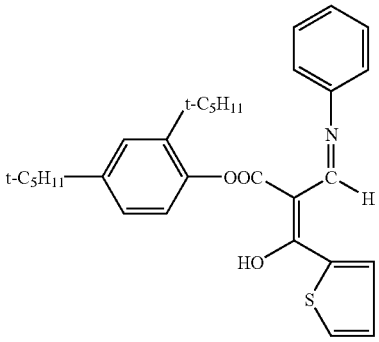
CV-23
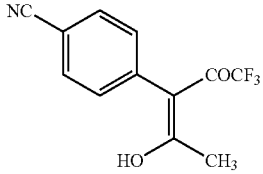
CV-24
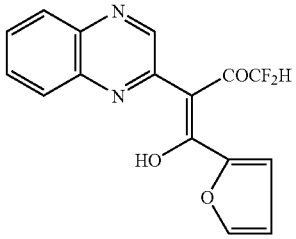
CV-25
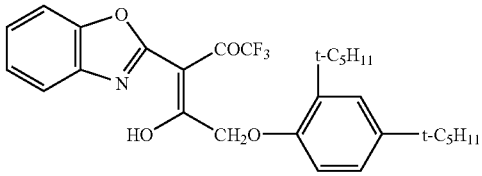
CV-26
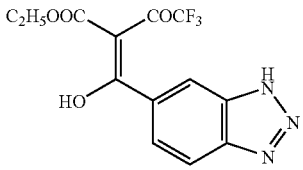

-continued
CV-27
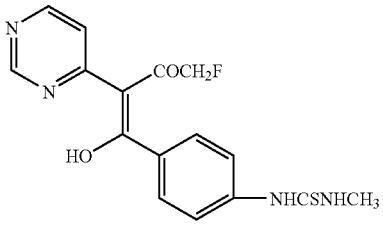
CV-28
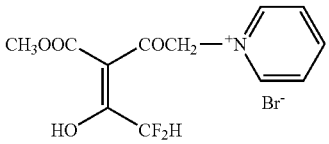
CV-29
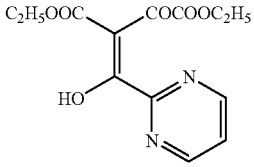
CV-30
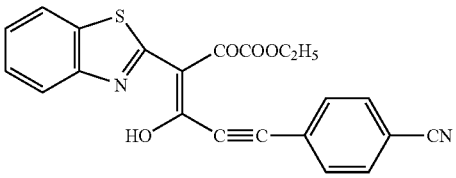
CV-31
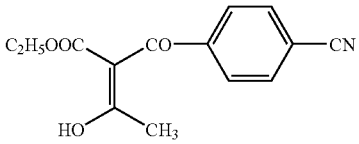
CV-32
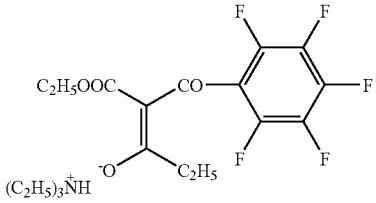
CV-33
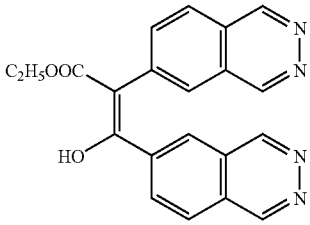
CV-34
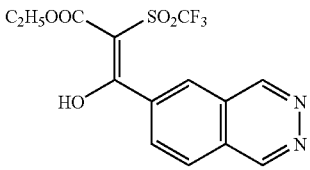
-continued
CV-35
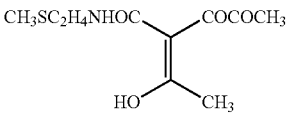
CV-36
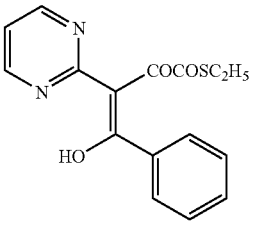
CV-37
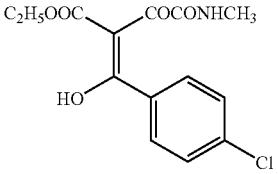
CV-38
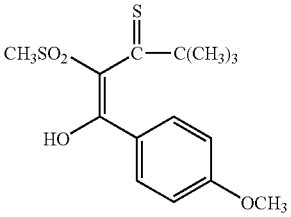
CV-39
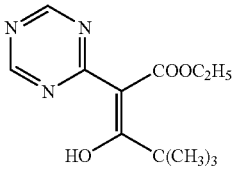
CV-40
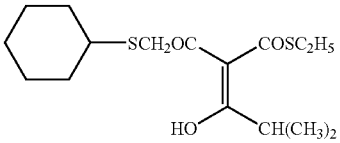
CV-41
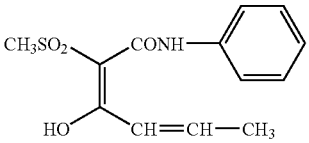
CV-42
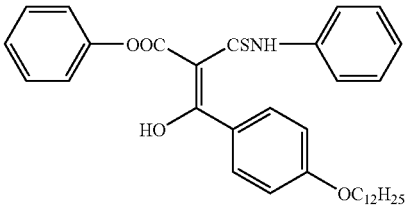

-continued
CV-43
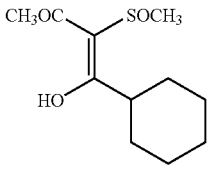
CV-44
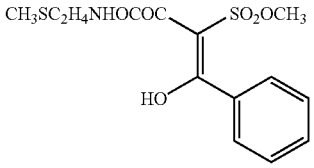
CV-45
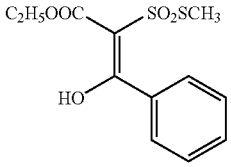
CV-46
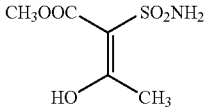
CV-47
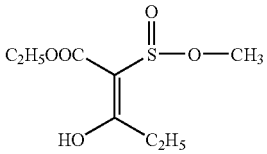
CV-48
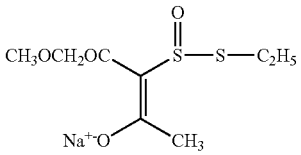
CV-49
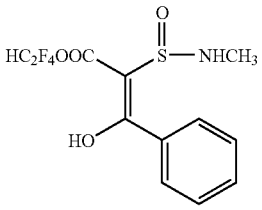
CV-50
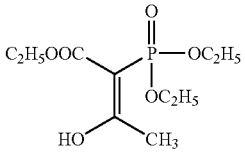
CV-51
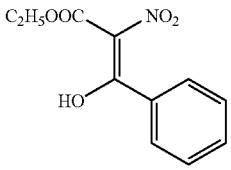
-continued
CV-52
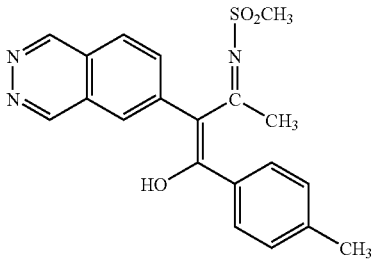
CV-53
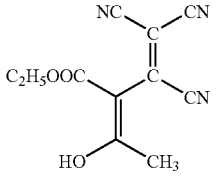
CV-54
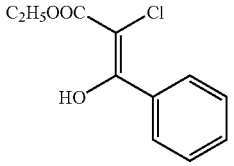
CV-55
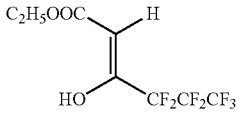
CV-56
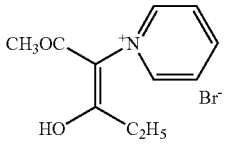
CV-57
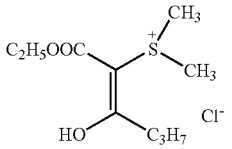
CV-58
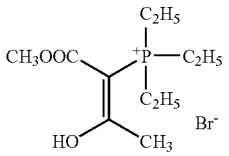
CV-59
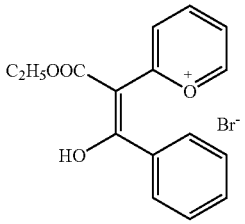
CV-60
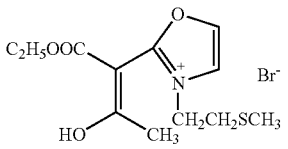

-continued
CV-61
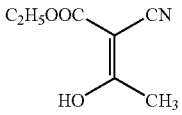
CV-62
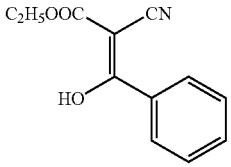
CV-63
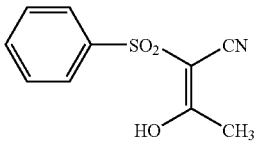
CV-64
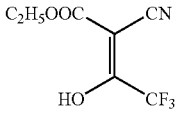
CV-65
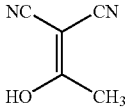
CV-66
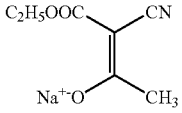
CV-67
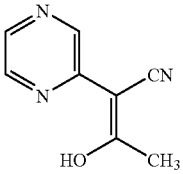
CV-68
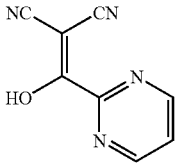
CV-69
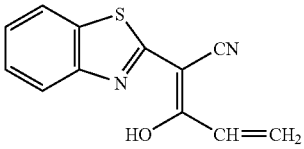
CV-70
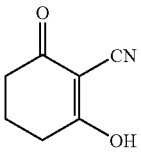
-continued
CV-71
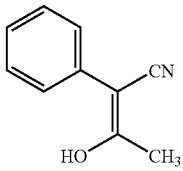
CV-72
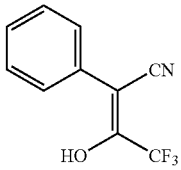
CV-73
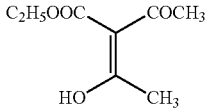
CV-74
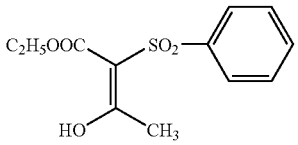
CV-75
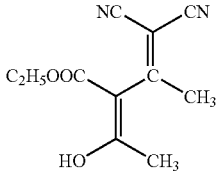
CV-76
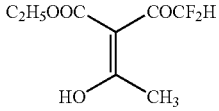
CV-77
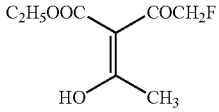
CV-101
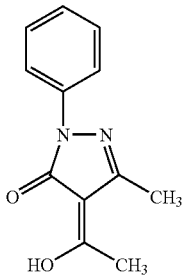
CV-102
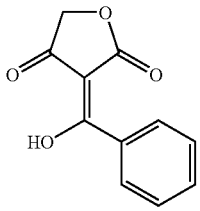

-continued
CV-103
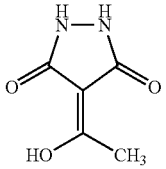
CV-104
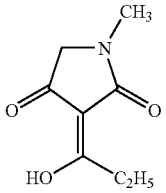
CV-105
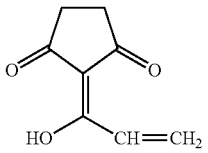
CV-106
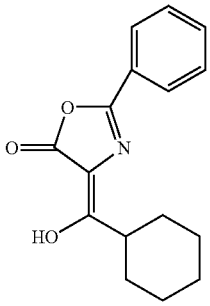
CV-107
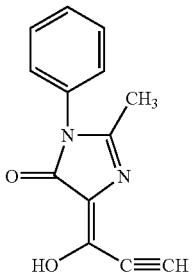
CV-108
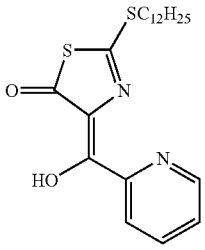
-continued
CV-109
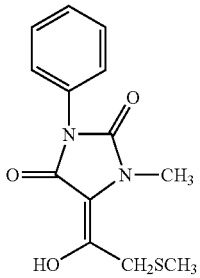
CV-110
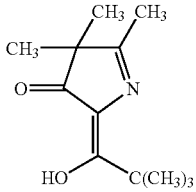
CV-111
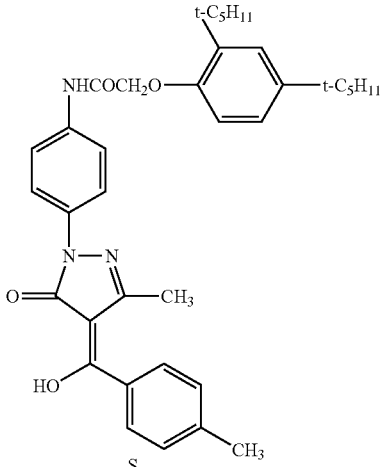
CV-112
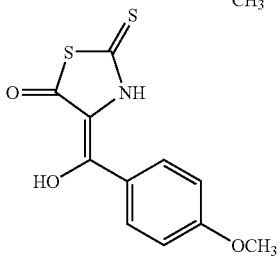
CV-113
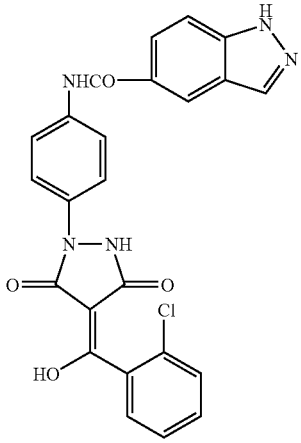

-continued
CV-114
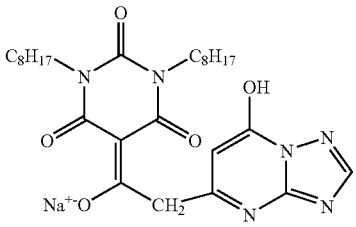
CV-115
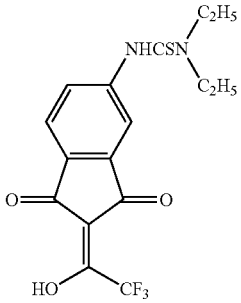
CV-116
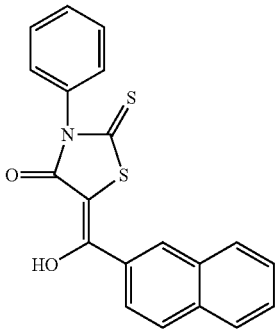
CV-117
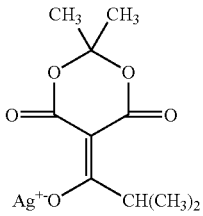
CV-118
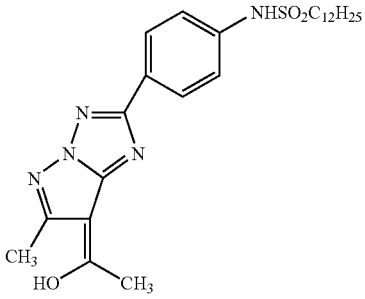
-continued
CV-119
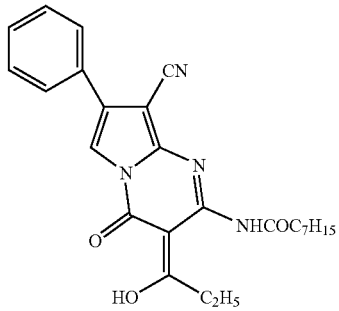
CV-120
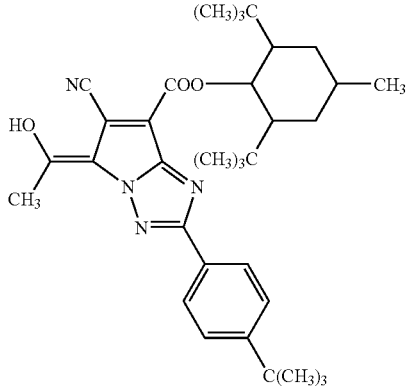
CV-121
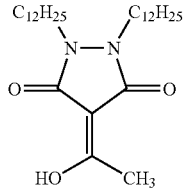
CV-122
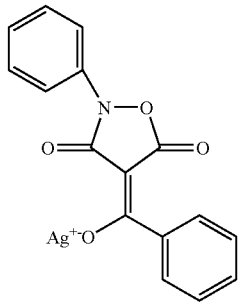
CV-123
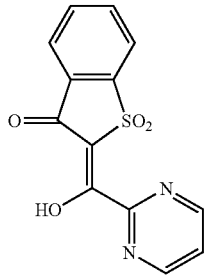

-continued
CV-124
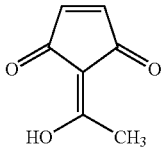
CV-125
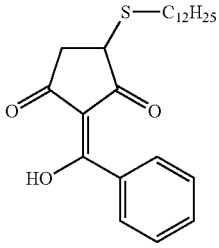
CV-126
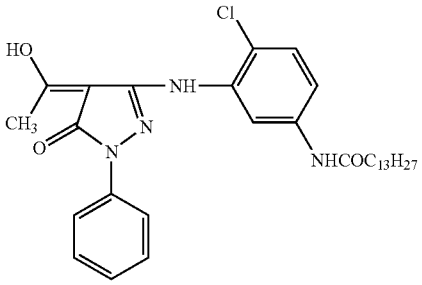
CV-127
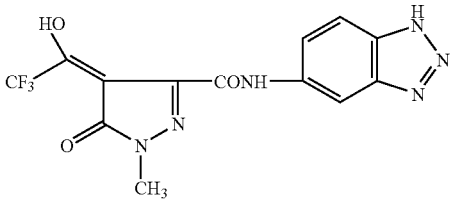
CV-128
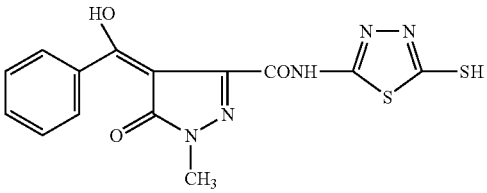
CV-129
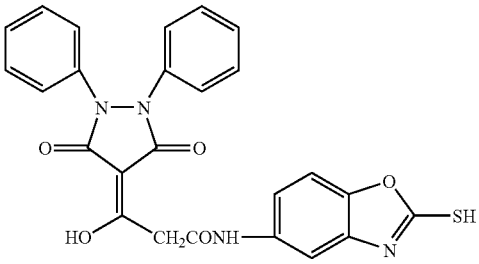
CV-130
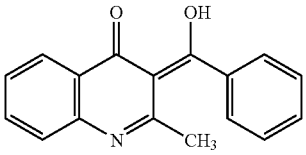
-continued
CV-131
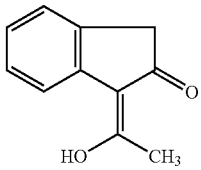
CV-132
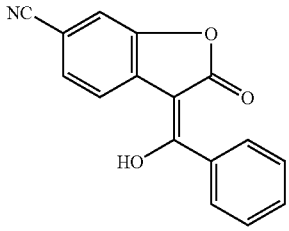
CV-133
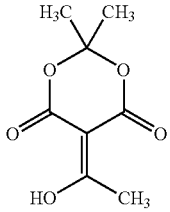
CV-134
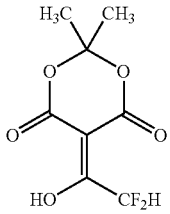
CV-135
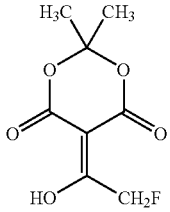
CV-136
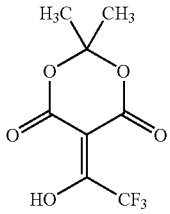
CV-137
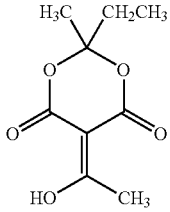
Compounds represented by formula (CV) of this invention can be synthesized by various methods, and they can be synthesized by referring to, for example, a method described in Japanese Translated PCT Patent Publication No. 2000-515995.

Example compound CV-5 can be synthesized, for example, by the following rout.

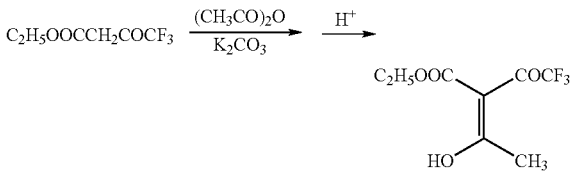

Other compounds represented by Formula (CV) can be synthesized in a similar manner.

The compound represented by Formula (CV) is incorporated at least in one of a light-sensitive layer and light-insensitive layers on said light-sensitive layer side, of a thermally developable light-sensitive material, and preferably at least in a light-sensitive layer. The addition amount of compounds represented by Formula (1) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by formula (CV) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for fine-particle dispersion techniques, many techniques have been disclosed and the compound can be dispersed according to these techniques.

Reducing Agents for Silver Ions

In this present invention, there may be employed, as a reducing agent for silver ions (hereinafter occasionally referred simply to as a reducing agent), polyphenols described in U.S. Pat. Nos. 3,589,903 and 4,021,249, British Patent No. 1,486,148, JP-A Nos. 51-5193350-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In the present invention, preferred reducing agents for silver ions are compounds represented by the following formula (RED):

formula (RED)

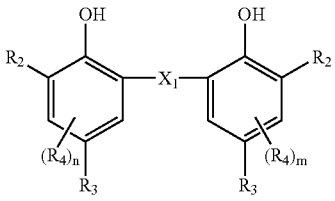

In the formula (RED), $X_1$ represents a chalcogen atom or $CHR_1$. Specific examples of a chalcogen atom include a sulfur atom, a selenium atom, and a tellurium atom. Of these, a sulfur atom is preferred. In the foregoing $CHR_1$, $R_1$ represents a hydrogen atom, a halogen atom, an alkyl-group, an alkenyl group, an alkynyl group, an aryl group or a heterocyclic group. Halogen atoms include, for example, a fluorine atom, a chlorine atom, and a bromine atom. Examples of an alkyl group include alkyl groups having 1–20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Examples of the substituents include a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different. Of these, an alkyl group is pecifically preferred.

$R_2$ represents an alkyl group. Preferred as the alkyl groups are those, having 1–20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. $R_2$ is preferably a secondary or tertiary alkyl group and preferably has 2–20 carbon atoms. $R_2$ is more preferably a tertiary alkyl group, is still more preferably a t-butyl group, a t-pentyl group, or a methylcyclohexyl group, and is most preferably a t-butyl group.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

$R_3$ preferably is methyl, ethyl, i-propyl, t-butyl, cyclohexyl, 1-methylcyclohexyl, or 2-hydroxyethyl. Of these, 2-hydroxyethyl is more preferred.

These groups may further have a substituent. Employed as such substituents may be those listed in aforesaid $R_1$.

Further, $R_3$ is more preferably an alkyl group having 1–10 carbon atoms. Specifically listed is the hydroxyl group disclosed in Japanese Patent Application No. 2002-120842, or an alkyl group, such as a 2-hydroxyethyl group, which has as a substituent a group capable of forming a hydroxyl group while being deprotected. In order to achieve high maximum density (Dmax) at a definite silver coverage, namely to result in silver image density of high covering power (CP), sole use or use in combination with other kinds of reducing agents is preferred.

The most preferred combination of $R_2$ and $R_3$ is that $R_2$ is a tertiary alkyl group (t-butyl, or 1-methylcyclohexyl) and $R_3$ is an alkyl group, such as a 2-hydoxyethyl group, which has, as a substituent, a hydroxyl group or a group capable of forming a hydroxyl group while being deprotected. Incidentally, a plurality of $R_2$ and $R_3$ is may be the same or different.

$R_4$ represents a group capable of being substituted to a benzene ring. Listed as specific examples may be an alkyl group having 1–25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyll pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylaminosulfonyl, hexylamitosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of 0–2. However, the most preferred case is that both n and m are 0. A plurality of $R_4$s may be the same or different.

Further, $R_4$ may form a saturated ring together with $R_2$ and $R_3$. $R_4$ is preferably a hydrogen atom, a halogen atom, or an alkyl group, and is more preferably a hydrogen atom.

Specific examples of the compounds represented by formula (RED) are listed below. However, the present invention is not limited thereto.

(RED-1)

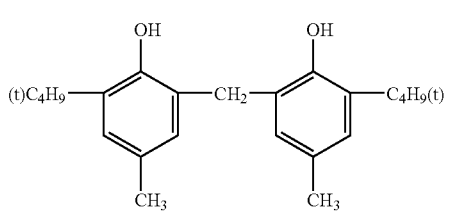

(RED-2)

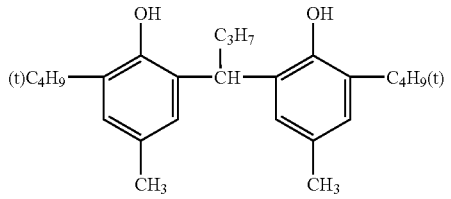

(RED-3)

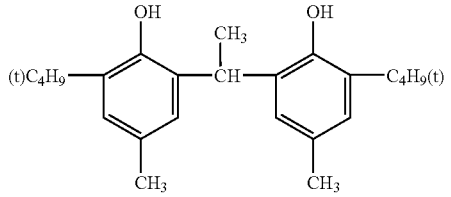

(RED-4)

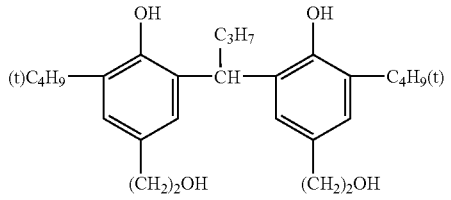

(RED-5)

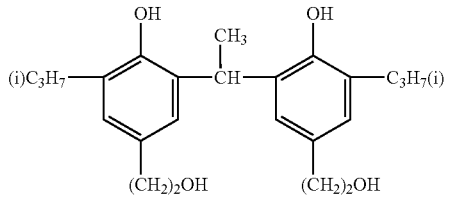

-continued
(RED-6)
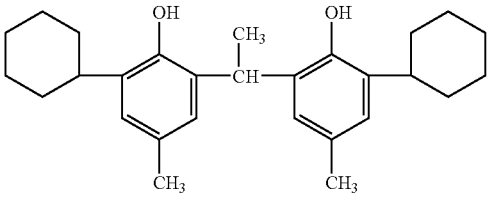
(RED-7)
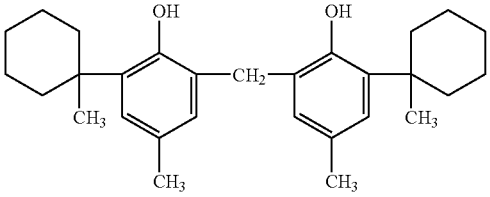
(RED-8)
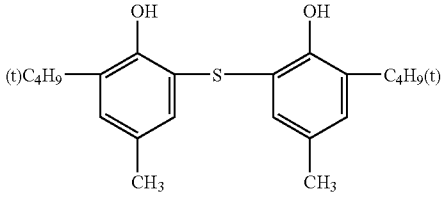
(RED-9)
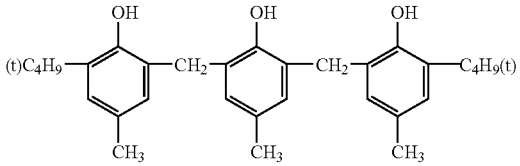
(RED-10)
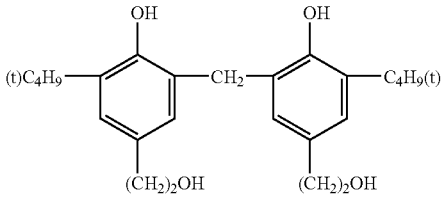
(RED-11)
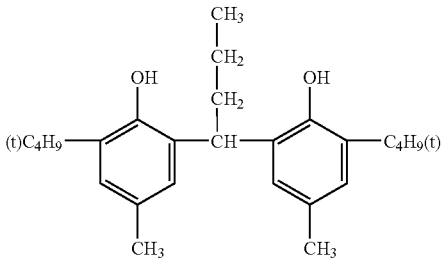
-continued
(RED-12)
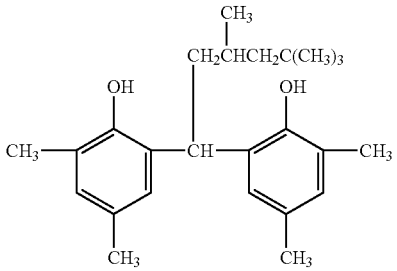
(RED-13)
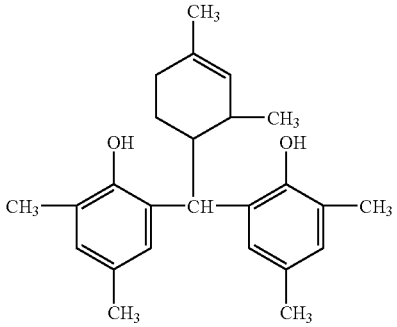
(RED-14)
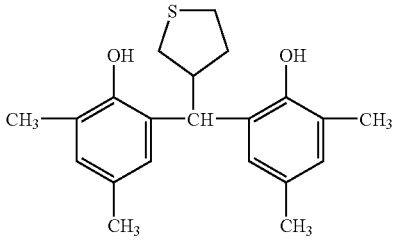
(RED-15)
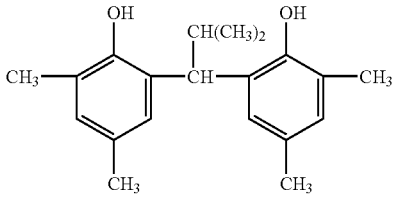
(RED-16)
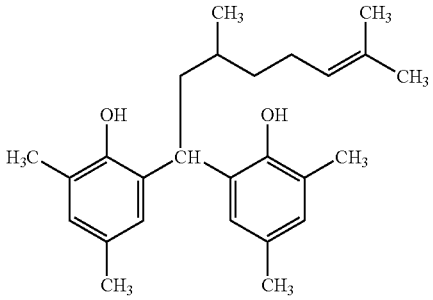
(RED-17)
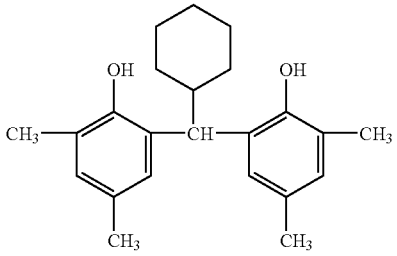

-continued (RED-18)

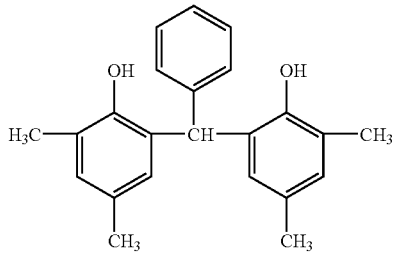

(RED-19)

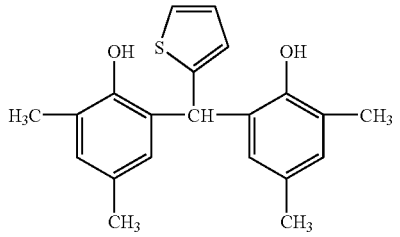

(RED-20)

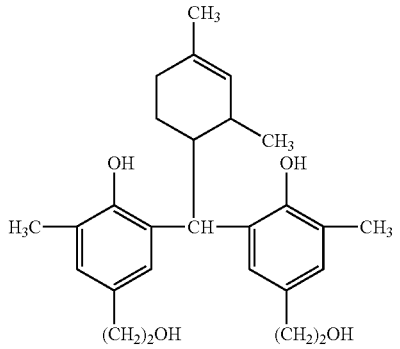

(RED-21)

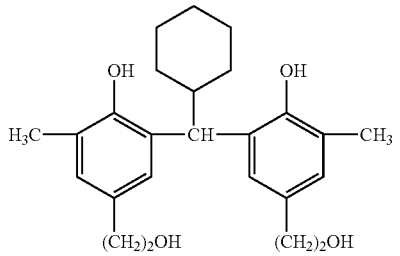

It is possible to synthesize these compounds (bisphenol compounds) represented by Formula (RED) employing conventional methods known in the art (for example, referred to Japanese Patent Application No. 2002-147562).

The specific examples of the synthesis methods will now be described.

Synthesis of Compound RED-13

Dissolved in 5.94 ml of water was 1.97 g of sodium hydroxide, and subsequently added were 30.1 g of 2,4-xylenol and 15 ml of toluene. Thereafter, the water and toluene were distilled out at 120° C. The resulting reaction solution was then cooled to room temperature, and 13.65 g of 2,4-dimethyl-3-cyclohexanecarboxyaldehyde was added and the resulting mixture was stirred at 120° C. for 8 hours. While distilling out the resulting water, stirring was carried out for 12 hours under heating. Thereafter, heating was terminated. When the reaction solution was cooled to 80° C., 64 ml of heptane was gradually added, whereby the resulting reaction solution was dispersed. After cooling to room temperature by being allowed to stand, a solution prepared by mixing 5.28 g of concentrated hydrochloric acid and 14.4 ml of water were added, and the resulting mixture was stirred for 4 hours. After cooling the resulting mixture employing iced water for an additional 4 hours while stirring, filtration was carried out. Thereafter, washing was carried out employing 54 ml of heptane, whereby crude crystals were obtained. The resulting crude crystals were dissolved in 133 ml of acetonitrile while heated. After filtration, 88 ml of water was added and stirring was carried out for 4 hours at room temperature. Further, stirring was carried out while being cooled employing iced water for an additional 4 hours, and deposited crystals were collected by filtration, whereby 28.8 g (at a yield of 80 percent) of the targeted compound was obtained.

The aforesaid crystals were mixed crystals consisting of 25 percent (being a mol percentage) of cis form and 75 percent of trans form, resulting in a melting point of 198.5–199.5° C.

Employing the same method as above, 100 g of a cis form/trans form mixture was obtained. After dissolving the resulting mixture in 800 ml of acetone while heating, the resulting solution was cooled to room temperature while allowed to stand, and stirring continued throughout the night without any modification. Deposited crystals were collected via filtration and dried under vacuum for 15 hours, whereby crystals comprised of a trans form as a main component were obtained. On the other hand, the mother liquor was concentrated to approximately ⅓ of the original volume, whereby 10.9 g of crystals comprised of cis form as a main component was obtained. The aforesaid mother liquor was further concentrated to ⅔ of the original volume, into which cis form seed crystals were placed while stirring, whereby 3.2 g of cis form crystals as a main component was obtained. Subsequently, dissolved in 100 ml of tetrahydrofuran were the aforesaid two types of crystals comprised of cis form as a main component. Subsequently, while performing partial concentration employing an evaporator, 300 ml of hexane was added and the total volume was concentrated to approximately 100 ml. Thereafter, deposited crystals were collected via filtration and dried at 40° C. for 4 hours under vacuum, whereby 11.1 g of cis form Crystals (1) comprised as a main component was obtained.

The mother liquors were collected and concentrated, whereby 24.4 g residue was obtained. All the resulting residue was separated into a fraction containing trans form in a greater amount and a fraction containing the cis form, employing gas chromatography. (500 g of silica gel and isopropyl ether/hexane=¼). The residue which was obtained by concentrating the fraction containing cis form in a greater amount was dissolved in tetrahydrofuran, and while performing partial concentration, hexane was added. Deposited crystals were collected via filtration, whereby 12.5 g of cis form crystals as a main component was obtained. The resulting crystals were again dissolved in 100 ml of tetrahydrofuran while added by 300 ml of hexane, and the resulting solution was concentrated to approximately 100 ml. Thereafter, deposited crystals were collected via filtration and dried at 60° C. for 4 hours under vacuum, whereby 7.8 g of cis form Crystals (2) as a main component was obtained.

Subsequently, 11.1 g of aforesaid cis form crystals (1) as a main component and 7.8 g of Crystals (2) were mixed and dissolved in 300 ml of tetrahydrofuran. After an active carbon treatment, while performing partial concentration, 1,000 ml of hexane was added, and the resulting mixture was concentrated to approximately 300 ml. Thereafter, deposited crystals were collected via filtration and dried at 60° C. for 4 hours under vacuum. The resulting crystals were suspended in 200 ml of hexane, stirred for 30 minutes, and collected via filtration, dried for 15 hours under vacuum, whereby 15.3 g of cis form crystals (at a purity of 99.9 percent) was obtained at a melting point of 190° C.

Synthesis of Compound RED-10

First Step:

In a 100 ml 4-necked flask fitted with a refluxing device and a stirrer were added 10.0 g ($7.24\times10^{-2}$ mol) of 4-hydroxyphenetyl alcohol, 13.7 g ($1.19\times10^{-1}$ mol) of 85 percent phosphoric acid, and 50.0 ml of toluene. After heating the resulting mixture to 95–100° C. while stirring, a solution consisting of 90 g ($7.96\times10^{-2}$ mol) and 6.00 ml of toluene was dripped over a period of 30 minutes while maintaining the temperature of the solution in the range of from 90 to 100° C.

After completion of the dripping, the resulting mixture was stirred for one hour at the same temperature. Thereafter, the interior temperature was lowered to 50° C., and 25.0 ml of ethyl acetate and 50.0 ml of water were added. Subsequently, the content was transferred to a separating funnel. After performing washing three times employing 50.0 ml of water each time, the pH was adjusted to 6–7 by the addition of an aqueous $Na_2CO_3$ solution. Further, after performing washing employing a saturated sodium chloride solution, the water in the organic layer was removed by $MgSO_4$.

After dehydration, $MgSO_4$ was removed via filtration, and solvents were distilled out under vacuum. After completion of the distilling-out, a product in the form of glutinous starch syrup was obtained, resulting in a yield of 14.0 g. The resulting product was dissolved in 28 ml of toluene, and employed in the subsequent step without any modification.

Second Step

Into a 100 ml flask fitted with a refluxing device and a stirrer were added the entire first step product (being a toluene solution), 1.4 g ($7.24\times10^{-3}$ mol) of p-tolunesulfonic acid monohydrate, and 1.2 g ($3.98\times10^{-2}$ mol) of paraformaldehyde. The resulting mixture underwent reaction at 70 to 75° C. for 3 hours.

After completion of the reaction, 30.0 ml of ethyl acetate and 20.0 ml of water were added to the reaction product, and the resulting mixture was then transferred to a separating flask.

Washing was performed employing 20.0 ml of water and the pH was adjusted to 6–7. Further, after washing employing a saturated sodium chloride solution, water in the organic layer was removed employing $MgSO_4$. After dehydration, $MgSO_4$ was removed via filtration, and solvents were distilled out under vacuum. After completion of the distilling-out, a product in the form of a glutinous starch syrup was obtained. The resulting product was subjected to column purification*1. The separated targeted product was dissolved in 11.5 ml of dichloromethane, cooled by iced water and crystallized, whereby crude crystals were obtained, resulting in a crude yield of 9.5 g (65 percent).

Crude crystals were dissolved in 9.5 ml of ethyl acetate and the resulting solution was chilled by iced water to result in crystallization, whereby a targeted product was obtained, resulting in a crude yield of 9.5 g (65 percent). *1: Due to a minute amount of impurities which were formed in the first step, it was difficult to achieve crystallization without any modification, and as a result, column purification was reluctantly performed.

Incidentally, the second step proceeds at a high reaction rate. Therefore, if it is possible to sufficiently remove impurities formed in the first step, the aforesaid column purification becomes unnecessary.

The amount of silver ion reducing agents employed in the photothermographic materials of the present invention varies depending on the types of organic silver salts, reducing agents and other additives. However, the aforesaid amount is customarily 0.05–10 mol per mol of organic silver salts, and is preferably 0.1–3 mol. Further, in the aforesaid range, silver ion reducing agents of the present invention may be employed in combinations of at least two types. Namely, in view of achieving images exhibiting excellent storage stability, high image quality and high CP, it is preferable to simultaneously use reducing agents which differ in reactivity, due to a different chemical structure.

In the present invention, preferred cases occasionally occur in which the aforesaid reducing agents are added, just prior to coating, to a photosensitive emulsion comprised of photosensitive silver halide, organic silver salt particles, and solvents and the resulting mixture is coated to minimize variations of photographic performance due to the standing time.

Further, hydrazine derivatives and phenol derivatives represented by Formulas (1) to (4) in JP-A No. 2003-43614, and Formulas (1) to (3) in JP-A No. 2003-66559 are preferably employed as a development accelerator which are simultaneously employed with the aforesaid reducing agents.

The oxidation potential of development accelerators employed in the silver salt photothermographic materials of the present invention, which is determined by polarographic measurement, is preferably lower 0.01 to 0.4 V, and is more preferably lower 0.01 to 0.3 V than that of the compounds represented by Formula (RED). Incidentally, the oxidation potential of the aforesaid development accelerators is preferably 0.2 to 0.6 V, which is polarographically determined in a solvent mixture of tetrahydrofuran:Britton Robinson buffer solution=3:2 the pH of which is adjusted to 6 employing an SCE counter electrode, and is more preferably 0.3 to 0.55 V. Further, the pKa value in a solvent mixture of tetrahydrofuran:water=3:1 is preferably 3–12, and is more preferably 5–10. It is particularly preferable that the oxidation potential which is polarographically determined in the solvent mixture of tetrahydrofuran:Britton Robinson buffer solution=3:2, the pH of which is adjusted to 6, employing an SCE counter electrode is from 0.3 to 0.55, and the pKa value in the solvent mixture of tetrahydrofuran:water=3:2 is from 5 to 10.

Further, there may be employed, as silver ion reducing agents according to the present invention, various types of reducing agents disclosed in European Patent No. 1,278,101 and JP-A No. 2003-15252.

The amount of silver ion reducing agents employed in the photothermographic imaging materials of the present invention varies depending on the types of organic silver salts, reducing agents, and other additives. However, the aforesaid amount is customarily 0.05 to 10 mol per mol of organic silver salts and is preferably 0.1 to 3 mol. Further, in this amount range, silver ion reducing agents of the present invention may be employed in combinations of at least two types. Namely, in view of achieving images exhibiting excellent storage stability, high image quality, and high CP, it is preferable to simultaneously employ reducing agents which differ in reactivity due to different chemical structure.

In the present invention, preferred cases occasionally occur in which when the aforesaid reducing agents are added to and mixed with a photosensitive emulsion comprised of photosensitive silver halide, organic silver salt particles, and solvents just prior to coating, and then coated, variation of photographic performance during standing time is minimized.

Chemical Sensitization

Silver halide grains used in the invention can be subjected to chemical sensitization. In accordance with methods described in JP-A Nos. 2001-249428 and 2001-249426, for example, a chemical sensitization center (chemical sensitization speck) can be formed using compounds capable of releasing chalcogen such as sulfur or noble metal compounds capable of releasing a noble metal ion such as a gold ion. In this invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double-bond. Specifically, heterocycle-containing thiourea derivatives and triphenylphosphine sulfide derivatives are preferred. A variety of techniques for chemical sensitization employed in silver halide photographic material for use in wet processing are applicable to conduct chemical sensitization, as described, for example, in T. H. James, The Theory of the Photographic Process, 4th Ed. (Macmillan Publishing Co., Ltd., 1977 and Nippon Shashin Gakai Ed., "Shashin Kogaku no Kiso (Gin-ene Shashin)" (Corona Co., Ltd., 1998). The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical-sensitization under preferred conditions, the pAg is preferably 6 to 11, and more preferably 7 to 10, the pH is preferably 4 to 10 and more preferably 5 to 8, and the temperature is preferably not more than 30° C.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains an be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

When the surface of silver halide grains is subjected to chemical sensitization, it is preferred that an effect of the chemical sensitization substantially disappears after subjected to thermal development. An effect of chemical sensitization substantially disappearing means that the sensitivity of the photothermographic material, obtained by the foregoing chemical sensitization is reduced, after thermal development, to not more than 1.1 times that of the case not having been subjected to chemical sensitization. To allow the effect of chemical sensitization to disappear, it is preferred to allow an oxidizing agent such as a halogen radical-releasing compound which is capable of decomposing a chemical sensitization center (or chemical sensitization nucleus) through an oxidation reaction to be contained in an optimum amount in the light-sensitive layer and/or the light-insensitive layer. The content of an oxidizing agent is adjusted in light of oxidizing strength of an oxidizing agent and chemical sensitization effects.

Spectral Sensitization

There may be further used sensitizing dyes other than those described above as long as they do not result in adversely effects. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

The photothermographic material preferably contains at least one of sensitizing dyes described in Japanese Patent Application No. 2003-102726, represented by the following formulas (SD-1) and (SD-2):

formula (SD-1)

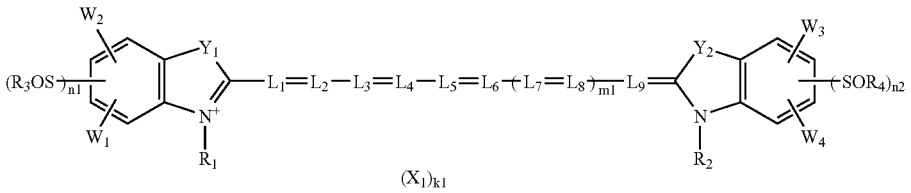

formula (SD-2)

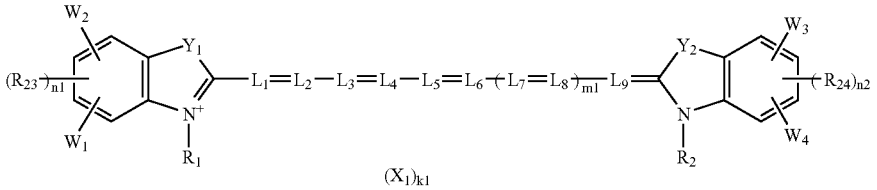

wherein $Y_1$ and $Y_2$ are each an oxygen atom, a sulfur atom, a selenium atom or —CH═CH—; $L_1$ to $L_9$ are each a methine group; $R_1$ and $R_2$ are an aliphatic group; $R_3$, $R_4$, $R_{23}$ and $R_{24}$ are each a lower alkyl group, a cycloalkyl group, an alkenyl group, an aralkyl group, an aryl group or a heterocyclic group; $W_1$, $W_2$, $W_3$ and $W_4$ are each a hydrogen atom, a substituent or an atom group necessary to form a ring by $W_1$ and $W_2$ or $W_3$ and $W_4$, or an atom group necessary to form a 5- or 6-membered ring by $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$; $X_1$ is an ion necessary to compensating for a charge within the molecule; k1 is the number of ions necessary to compensate for a charge within the molecule; m1 is 0 or 1; n1 and n2 are each 0, 1 or 2, provided that n1 and n2 are not 0 at the same time.

The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization, expansion or adjustment of the light-sensitive wavelength region. A super-sensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula is preferred as a supersensitizer:

Ar—SM wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole; naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferablyl 1 to 4 carbon atoms) or an alkoxy group (having one or more carbon atoms, and preferablyl 1 to 4 carbon atoms). In addition to the foregoing supersensitizers, there are usable heteroatom-containing macrocyclic compounds described in JP-A No. 2001-330918, as a supersensitizer. The supersensitizer is incorporated into a light-sensitive layer containing organic silver salt and silver halide grains, preferably in an amount of 0.001 to 1.0 mol, and more preferably 0.01 to 0.5 mol per mol of silver.

It is preferred that-a sensitizing dye is allowed to adsorb onto the surface of light-sensitive silver halide grains to achieve spectral sensitization and the spectral sensitization effect substantially disappears after being subjected to thermal development. The effect of spectral sensitization substantially disappearing means that the sensitivity of the photothermographic material, obtained by a sensitizing dye or a supersensitizer is reduced, after thermal development, to not more than 1.1 times that of the case not having been subjected to spectral sensitization. To allow the effect of spectral sensitization to disappear, it is preferred to use a spectral sensitizing dye easily releasable from silver halide grains and/or to allow an oxidizing agent such as a halogen radical-releasing compound which is capable of decomposing a spectral sensitizing dye through an oxidation reaction to be contained in an optimum amount in the light-sensitive layer and/or the light-insensitive layer. The content of an oxidizing agent is adjusted in light of oxidizing strength of the oxidizing agent and its spectral sensitization effects.

The light-sensitive layer or light-insensitive layer may contain a silver saving agent.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. The silver-saving agent may be contained in either the light-sensitive layer or light-insensitive layer, or in both of them. Examples of the preferred silver-saving agent include hydrazine derivative compounds represented by the following formula [H], vinyl compounds represented by formula (G) and quaternary onium compounds represented by formula (P):

formula [H]

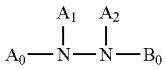

formula (G)

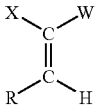

formula (P)

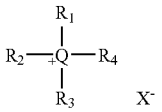

In formula [H], $A_0$ is an aliphatic group, aromatic group, heterocyclic group, each of which may be substituted, or $-G_0-D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, $—C(=NG_1D_1)-$, —SO—, $—SO_2—$ or $—P(O)(G_1D_1)-$ group, in which $G_1$ is a bond, or a —O—, —S— or $—N(D_1)-$ group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or $-G_0-D_0$ group represented by $A_0$ each may be substituted. Specifically preferred $A_0$ is an aryl group or $-G_0-D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably $-G_0-D_0$, wherein $G_0$ is a —CO—, —COCO—, —CS—, $—C(=NG_1D_1)-$, —SO—, $—SO_2—$ or $—P(O)(G_1D_1)-$ group, and preferred $G_0$ is a —CO—, —COCOA-, in which $G_1$ is a linkage, or a —O—, —S— or $—N(D_1)-$ group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

The compounds of formulas (H) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In formula (G), X and R may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio gpoup, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by X refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium grou, and further including a group of a heterocyclic ring formed by an ammonium group, sulfonium group, phosphonium group or immonium group. Of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$,combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

The quaternary onium salt compounds described above can be readily synthesized according to the methods commonly known in the art. For example, the tetrazolium compounds described above may be referred to Chemical Review 55, page 335–483.

In the present invention, it is preferable that at least one of silver saving agents is a silane compound.

The silane compounds employed as a silver saving agent in present invention are preferably alkoxysilane compounds having at least two primary or secondary amino groups or salts thereof, as described in Japanese Patent Application No. 2003-5324.

When alkoxysilane compounds or salts thereof or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

Image Tone Adjustment

The image tone (or image color) obtained by thermal development of the imaging material is described. It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In this invention, $h_{ab}$ is preferably in the range of 1.80 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Extensive investigation was performed for the silver salt photothermographic material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also from 0.998 to 1.000.

The value v* of the intersection point of the aforesaid linear regression line with the ordinate is −5–+5; and gradient (v*/u*) is 0.7 to 2.5.

(2) The coefficient of determination value $R^2$ of the linear regression line is 0.998 to 1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is from −5 to +5, while gradient (b*/a*) is from 0.7 to 2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below. In this invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, image toning agents such as phthalazinones or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

Other than such image toning agents, it is preferable to control color tone employing couplers disclosed in JP-A No. 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to the present invention.

Leuco dyes are employed in the silver salt photothermographic materials relating to this invention. There may be employed, as leuco dyes, any of the colorless or slightly tinted compounds which are oxidized to form a colored state when heated at temperatures of about 80 to about 200° C. for about 0.5 to about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include bisphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes and other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01 to 0.30, is preferably 0.02 to 0.20, and is most preferably 0.02 to 0.10. Further, it is preferable that images be controlled within the preferred color tone range described below.

In this invention, particularly preferably employed as yellow forming leuco dyes are color image forming agents represented by the following formula (YL) which increase absorbance between 360 and 450 nm via oxidation:

formula (YL)

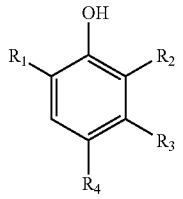

The compounds represented by Formula (YL) will now be detailed. In the foregoing formula (YL), the alkyl groups represented by $R_1$ are preferably those having 1–30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Examples of substituents which R, may have include a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_2$ represents a hydrogen atom, a substituted or unsubstituted alkyl group, or an acylamino group. The alkyl group represented by $R_2$ is preferably one having 1 to 30 carbon atoms, while the acylamino group is preferably one having 1 to 30 carbon atoms. Of these, description for the alkyl group is the same as for aforesaid $R_1$.

The acylamino group represented by $R_2$ may be unsubstituted or have a substituent. Specific examples thereof include an acetylamino group, an alkoxyacetylamino group, and an aryloxyacetylamino group. $R_2$ is preferably a hydrogen atom or an unsubstituted group having 1 to 24 carbon atoms, and specifically listed are methyl, i-propyl, and t-butyl. Further, neither $R_1$ nor $R_2$ is a 2-hydroxyphenylmethyl group.

$R_3$ represents a hydrogen atom, and a substituted or unsubstituted alkyl group. Preferred as alkyl groups are those having 1 to 30 carbon atoms. Description for the above alkyl groups is the same as for $R_1$. Preferred as $R_3$ are a hydrogen atom and an unsubstituted alkyl group having 1 to 24 carbon atoms, and specifically listed are methyl, i-propyl and t-butyl. It is preferable that either $R_{12}$ or $R_{13}$ represents a hydrogen atom.

$R_4$ represents a group capable of being substituted to a benzene ring, and represents the same group which is described for substituent $R_4$, for example, in aforesaid Formula (RED). $R_4$ is preferably a substituted or unsubstituted alkyl group having 1 to 30 carbon atoms, as well as an oxycarbonyl group having 2 to 30 carbon atoms. The alkyl group having 1 to 24 carbon atoms is more preferred. Listed as substituents of the alkyl group are an aryl group, an amino group, an alkoxy group, an oxycarbonyl group, an acylamino group, an acyloxy group, an imido group, and a ureido group. Of these, more preferred are an aryl group, an amino group, an oxycarbonyl group, and an alkoxy group. The substituent of the alkyl group may be substituted with any of the above alkyl groups.

Among the compounds represented by the foregoing formula (YL), preferred compounds are bis-phenol compounds represented by the following formula:

formula (YL')

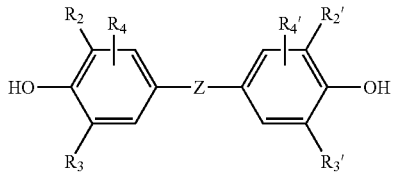

wherein, Z represents a —S— or —C($R_1$)($R_{1'}$)- group. $R_1$ and $R_{1'}$ each represent a hydrogen atom or a substituent. The substituents represented by $R_1$ and $R_{1'}$ are the same substituents listed for $R_1$ in the aforementioned Formula (RED). $R_1$ and $R_{1'}$ are preferably a hydrogen atom or an alkyl group.

$R_2$, $R_3$, $R_2'$ and $R_3'$ each represent a substituent. The substituents represented by $R_2$, $R_3$, $R_2'$ and $R_3'$ are the same substituents listed for $R_2$ and $R_3$ in the aforementioned Formula (RED). $R_2$, $R_3$, $R_2'$ and $R_3'$ are preferably, an alkyl group, an alkenyl group, an alkynyl group, an aryl group, a heterocyclic group, and more preferably, an alkyl group. Substituents on the alkyl group are the same substituents listed for the substituents in the aforementioned Formula (RED). $R_2$, $R_3$, $R_2'$ and $R_3'$ are more preferably tertiary alkyl groups such as t-butyl, t-amino, t-octyl and 1-methyl-cyclohexyl.

$R_4$ and $R_{4'}$ each represent a hydrogen atom or a substituent, and the substituents are the same substituents listed for $R_4$ in the aforementioned formula (RED).

Examples of the bis-phenol compounds represented by the formula (YL) are, the compounds disclosed in JP-A No. 2002-169249, Compounds (II-1) to (II-40), paragraph Nos. [0032]–[0038]; and EP 1211093, Compounds (ITS-1) to (ITS-12), paragraph No. [0026].

Specific examples of bisphenol compounds represented by Formula (YL) are shown below.
(YL-1)
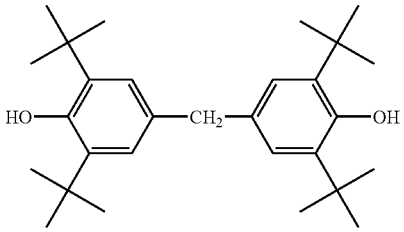
(YL-2)
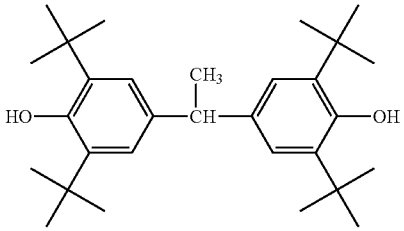
(YL-3)
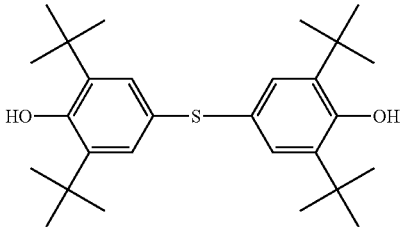
(YL-4)
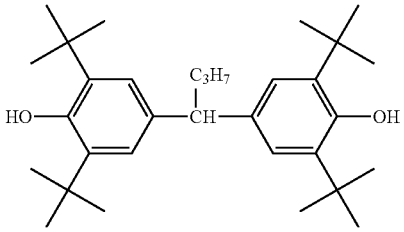
(YL-5)
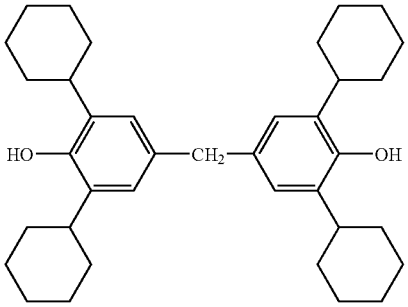
(YL-6)
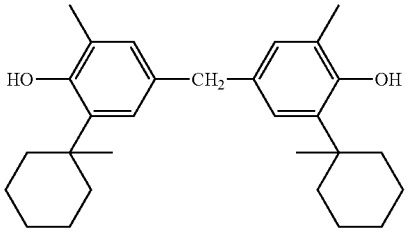
-continued
(YL-7)
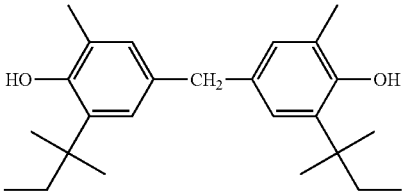
(YL-8)
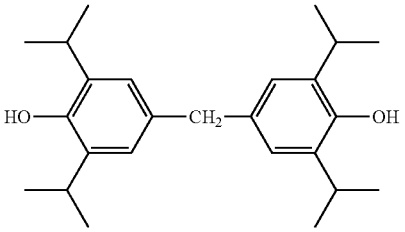
(YL-9)
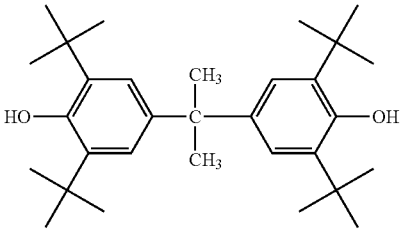
(YL-10)
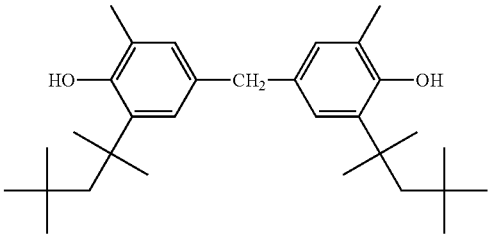
(YL-11)
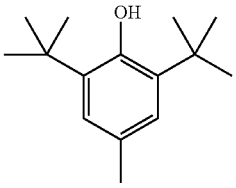
(YL-12)
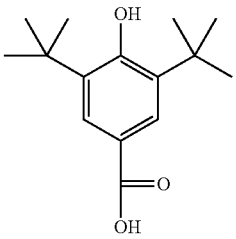

-continued (YL-13)

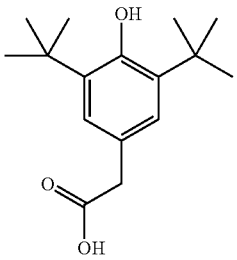

(YL-14)

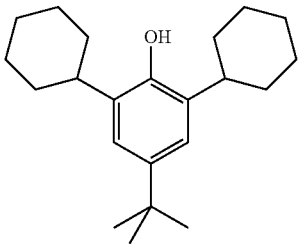

(YL-15)

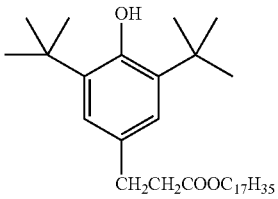

An amount of an incorporated compound represented by formula (YL) is; usually, 0.00001 to 0.01 mol, and preferably, 0.0005 to 0.01 mol, and more preferably, 0.001 to 0.008 mol per mol of Ag.

Cyan forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600–700 nm), compounds represented by formulas (I) through (IV) of JP-A No. 5-204087 (specifically, compounds (1) through (18) described in paragraphs [0032] through [0037]), and compounds represented by formulas 4–7 (specifically, compound Nos. 1 through 79 described in-paragraph [0105]) of JP-A No. 11-231460.

Cyan forming leuco dyes which are particularly preferably employed in the present invention are represented by the following formula (CL):

formula (CL)

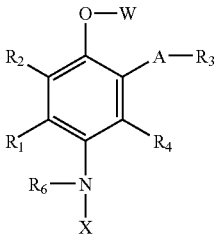

wherein $R_1$ and $R_2$ each represent a hydrogen atom, a substituted or unsubstituted alkyl group, an NHCO—$R_{10}$ group wherein $R_{10}$ is an alkyl group, an aryl group, or a heterocyclic group, while $R_1$ and $R_2$ may bond to each other to form an aliphatic hydrocarbon ring, an aromatic hydrocarbon ring, or a heterocyclic ring; A represents —NHCO—, —CONH—, or —NHCONH—; $R_3$ represents a substituted or unsubstituted alkyl group, an aryl group, or a heterocyclic group, or -A-$R_3$ is a hydrogen atom; W represents a hydrogen atom or a —CONH$R_5$- group, —CO$R_5$ or a —CO—O—$R_5$ group wherein $R_5$ represents a substituted or unsubstituted alkyl group, an aryl group, or a heterocyclic group; $R_4$ represents a hydrogen atom, a halogen atom, a substituted or unsubstituted alkyl group, an alkoxy group, a carbamoyl group, or a nitrile group; $R_6$ represents a —CONH—$R_7$ group, a —CO—$R_7$ group, or a —CO—O—$R_7$ group wherein $R_7$ is a substituted or unsubstituted alkyl group, an aryl group, or a heterocyclic group; and X represents a substituted or unsubstituted aryl group or a heterocyclic group.

In the foregoing formula (CL), halogen atoms include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6–20 carbon atoms such as a phenyl group, a naphthyl group, or a thienyl group; heterocyclic groups include each of thiophene, furan, imidazole, pyrazole, and pyrrole groups. A represents —NHCO—, —CONH—, or —NHCONH—; $R_3$ represents a substituted or unsubstituted alkyl group (preferably having at most 20 carbon atoms such as methyl, ethyl, butyl, or dodecyl), an aryl group (preferably having 6–20 carbon atoms, such as phenyl, naphthyl, or thienyl), or a heterocyclic group (thiophene, furan, imidazole, pyrazole, or pyrrole); -A-$R_3$ is a hydrogen atom; W represents a hydrogen atom or a —CONH$R_5$ group, a —CO—$R_5$ group or a —CO—O$R_5$ group wherein $R_5$ represents a substituted or unsubstituted alkyl group (preferably having at most 20 carbon atoms, such as methyl, ethyl, butyl, or dodecyl), an aryl group (preferably having 6–20 carbon atoms, such as phenyl, naphthyl, or thienyl), or a heterocyclic group (such as thiophene, furan, imidazole, pyrazole, or pyrrole); $R_4$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Aforesaid $R_1$ and $R_2$, and $R_3$ and $R_4$ bond to each other to form a ring structure. The aforesaid groups may have a single substituent or a plurality of substituents. For example, typical substituents which may be introduced into aryl groups include a halogen atom (e.g., fluorine, chlorine, or bromine), an alkyl group (e.g., methyl, ethyl, propyl, butyl, or dodecyl), a hydroxyl group, a cyan group, a nitro group, an alkoxy group (methoxy or ethoxy), an alkylsulfonamide group (e.g., methylsulfonamido or octylsulfonamido), an arylsulfonamide group (e.g., phenylsulfonamido or naphthylsulfonamido), an alkylsulfamoyl group (e.g., butylsulfamoyl), an arylsulfamoyl group (e.g., phenylsulfamoyl), an alkyloxycarbonyl group (e.g., methoxycarbonyl), an aryloxycarbonyl group (e.g., phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group. It is possible to introduce two different groups of these groups into an aryl group. Either $R_{10}$ or $R_{85}$ is preferably a phenyl group, and is more preferably a phenyl group having a plurality of substituents containing a halogen atom or a cyano group.

$R_6$ is a —CONH—$R_7$ group, a —CO—$R_7$ group, or —CO—O—$R_7$ group, wherein $R_7$ is a substituted or unsubstituted alkyl group (preferably having at most 20 carbon atoms, such as methyl, ethyl, butyl, or dodecyl), an aryl group (preferably having 6 to 20 carbon atoms, such as phenyl, naphthol, or thienyl), or a heterocyclic group (thiophene, furan, imidazole, pyrazole, or pyrrole). The substituents of the alkyl group represented by $R_7$ are the same ones as substituents in $R_1$ to $R_4$. $X_8$ represents a substituted or unsubstituted aryl group or a heterocyclic group. These aryl groups include groups having 6 to 20 carbon atoms such as phenyl, naphthyl, or thienyl, while the heterocyclic groups include any of the groups such as thiophene, furan, imidazole, pyrazole, or pyrrole. The substituents which may be substituted to the group represented by X are the same ones as the substituents in $R_1$ to $R_4$. The groups represented by X preferably is an aryl group, which is substituted with an alkylamino group (a diethylamino group) at the para-position, or a heterocyclic group. These may contain other photographically useful groups.

Specific examples of cyan forming leuco dyes (CL) are listed below, however are not limited thereto.

(CL-1)

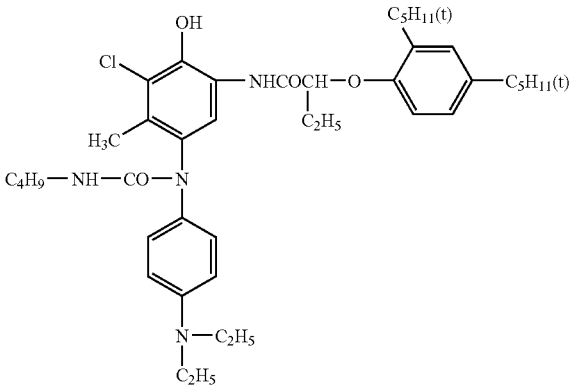

(CL-2)

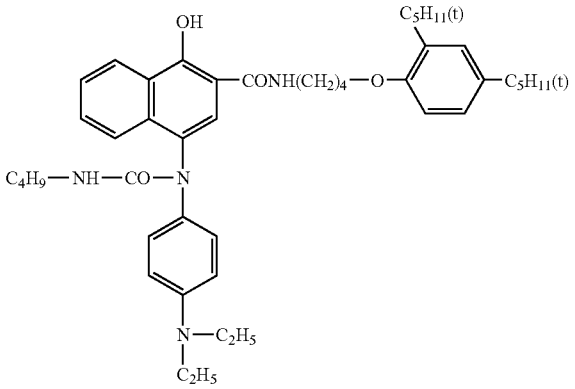

-continued (CL-3)

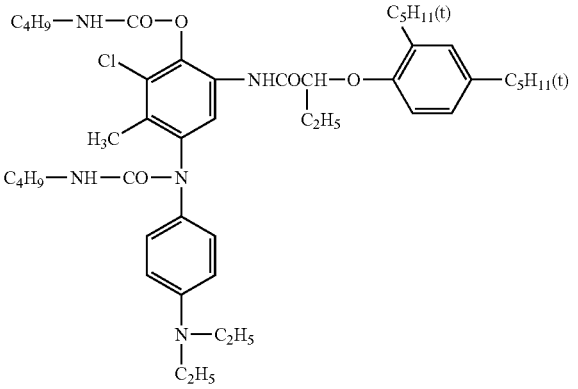

(CL-4)

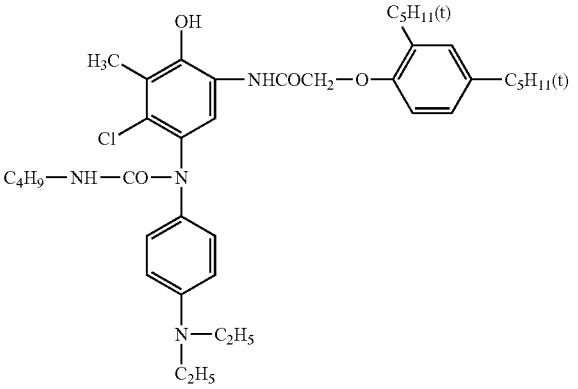

(CL-5)

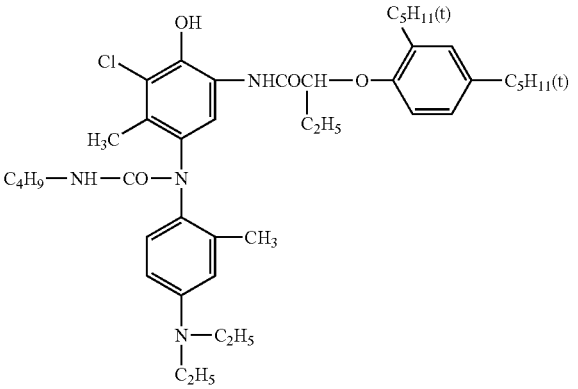

(CL-6)

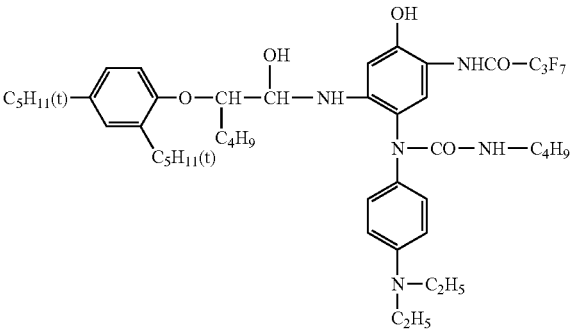

-continued (CL-7)

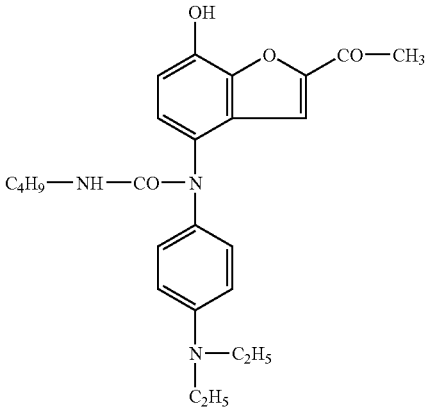

(CL-8)

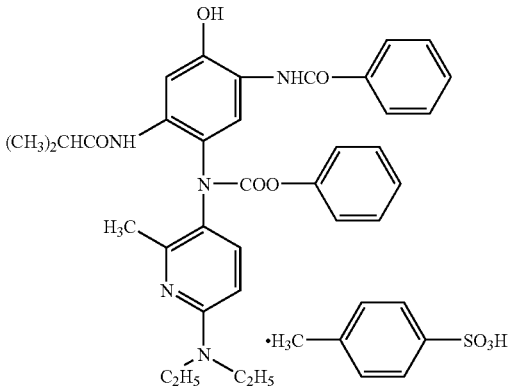

(CL-9)

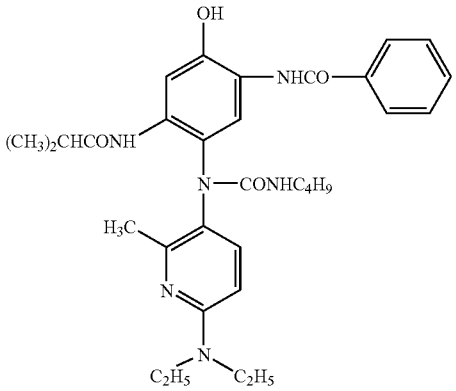

(CL-10)

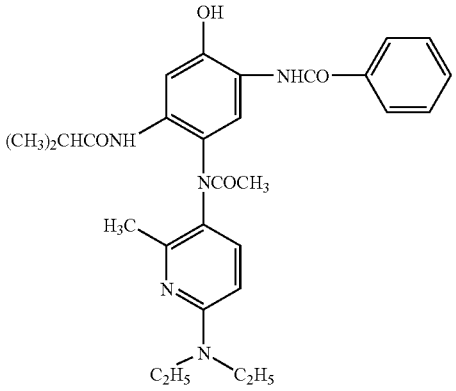

-continued (CL-11)

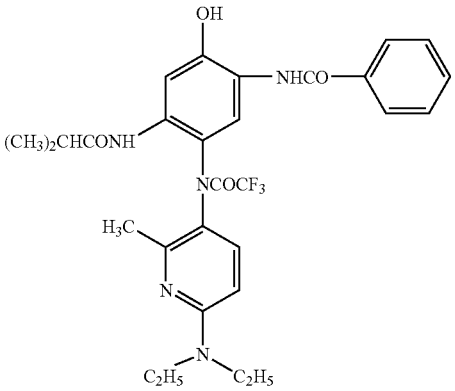

(CL-12)

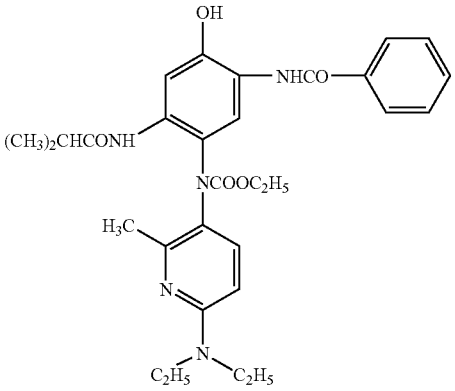

The addition amount of cyan forming leuco dyes is usually 0.00001 to 0.05 mol/mol of Ag, preferably 0.0005 to 0.02 mol/mol, and more preferably 0.001 to 0.01 mol.

The compounds represented by the foregoing formula (YL) and cyan forming leuco dyes may be added employing the same method as for the reducing agents represented by the foregoing formula (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by Formula, (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

To minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably less than or equal to 50 percent, is more preferably less than or equal to 40 percent, and is most preferably from less than or equal to 30 percent. Herein, the variation coefficient of the particle size distribution refers to the value expressed by the formula described below:

[(Standard deviation of particle diameter)/(particle diameter average)]×100

Methods of adding the matting agent may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

It is preferable to employ the fluorinated surfactants represented by the following formulas (SA-1) to (SA-3) in the photothermographic materials:

$$(Rf\text{-}L)_p\text{-}Y\text{-}(A)_q \qquad \text{formula (SA-1)}$$

$$LiO_3S\text{—}(CF_2)_n\text{—}SO_3Li \qquad \text{formula (SA-2)}$$

$$MO_3S\text{—}(CF_2)_n\text{—}SO_3M \qquad \text{formula (SA-3)}$$

wherein M represents a hydrogen atom, a sodium atom, a potassium atom, and an ammonium group; n represents a positive integer, while in the case in which M represents H, n represents an integer of 1 to 6 and 8, and in the case in which M represents an ammonium group, n represents an integers of 1 to 8.

In the foregoing formula (SA-1), Rf represents a substituent containing a fluorine atom. Fluorine atom-containing substituents include, for example, an alkyl group having 1 to 25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

L represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

Y represents a trivalent or tetravalent linking group having no fluorine atom. Examples include trivalent or tetravalent linking groups having no fluorine atom, which are groups of atoms comprised of a nitrogen atom as the center. P represents an integer from 1 to 3, while q represents an integer of 2 or 3.

The fluorinated surfactants represented by the foregoing formula (SA-1) are prepared as follows. Alkyl compounds having 1 to 25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the tri- to hexa-valent alkanol compounds into which fluorine atom(s) are not introduced, aromatic compounds having 3 or 4 hydroxyl groups or hetero compounds. Anion group (A) is further introduced into the resulting compounds (including alkanol compounds which have been partially subjected to introduction of Rf) employing, for example, sulfuric acid esterification.

Examples of the aforesaid tri- to hexa-valent alkanol compounds include glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl)propane, 2,2-bis(butanol), aliphatic triol, tetramethylolmethane, D-sorbitol, xylitol, and D-mannitol. The aforesaid aromatic compounds, having 3–4 hydroxyl groups and hetero compounds, include, for example, 1,3,5-trihydroxybenzene and 2,4,6-trihydroxypyridine.

In formula (SA-2), "n" is an integer of 1 to 4.

In the foregoing formula (SA-3), M represents a hydrogen atom, a potassium atom, or an ammonium group and n represents a positive integer. In the case in which M represents H, n represents an integer from 1 to 6 or 8; in the case in which M represents Na, n represents 4; in the case in which M represents K, n represents an integer from 1 to 6; and in the case in which M represents an ammonium group, n represents an integer from 1 to 8.

It is possible to add the fluorinated surfactants represented by the formulas (SA-1) to (SA-3) to liquid coating compositions, employing any conventional addition methods known in the art. Thus, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorinated surfactants are added to the protective layer which is the outermost layer.

The added amount of the aforesaid fluorinated surfactants is preferably $1\times10^{-8}$ to $1\times10^{-1}$ mol per $m^2$. When the added amount is less than the lower limit, it is not possible to achieve desired charging characteristics, while it exceeds the upper limit, storage stability degrades due to an increase in humidity dependence.

Surfactants represented by the foregoing formulas (SA-1), (SA-2), and (SA-3) are disclosed in JP-A No. 2003-57786, and Japanese Patent Application Nos. 2002-178386 and 2003-237982.

Materials for the support employed in the silver salt photothermographic material are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic material of the present invention are plastic films (for example, cellulose acetate film, polyester film, polyethylene terephthalate film, polyethylene naphthalate film, polyamide film, polyimide film, cellulose-triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

To minimize static charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic material relating to this invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

For example, when the silver salt photothermographic material of the present invention is used as an image recording material utilizing infrared radiation, it is preferable to employ squalilium dyes having a thiopyrylium nucleus (hereinafter referred to as thiopyriliumsqualilium dyes) and squalilium dyes having a pyrylium nucleus (hereinafter referred to as pyryliumsqualilium dyes), as described in Japanese Patent Application No. 11-255557, and thiopyryliumcroconium dyes or pyryliumcroconium dyes which are analogous to the squalilium dyes.

Incidentally, the compounds having a squalilium nucleus, as described herein, refers to ones having 1-cyclobutene-2-hydroxy-4-one in their molecular structure. Herein, the hydroxyl group may be dissociated. Hereinafter, all of these dyes are referred to as squalilium dyes. There are also preferably employed as a dye compounds described in JP-A No. 8-201959.

It is preferable to prepare the silver salt photothermographic material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system-called an extrusion coating method. The extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.1 to 2.5 g/m$^2$, and is more preferably from 0.5 to 1.5 g/m$^2$. Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$. The ratio of the silver coverage which is resulted from silver halide is preferably from 2 to 18 percent with respect to the total silver, and is more preferably from 3 to 15 percent. Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$. Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{--16}$ to $10^{--14}$ g. When coating is carried out under conditions within the aforesaid range, from the viewpoint of maximum optical silver image density per definite silver coverage, namely covering power as well as silver image tone, desired results are obtained.

Exposure

When the silver salt photothermographic material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. There are employed various ones as the exposure methods. Examples of a preferable method include the method utilizing a laser scanning exposure apparatus in which the angle between the scanning surface of a photosensitive material and the scanning laser beam does not substantially become vertical. "Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode. The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

In the recording methods of the aforesaid first and second embodiments, it is possible to suitably select any of the following lasers employed for scanning exposure, which are generally well known, while matching the use. The foregoing lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm. The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic material at laser transmitting wavelength and the laser power.

Processing

In the present invention, development conditions vary depending on employed devices and apparatuses, or means. Typically, an imagewise exposed silver salt photothermographic material is heated at optimal high temperature. It is possible to develop a latent image formed by exposure by heating the material at relatively high temperature (for example, from about 100 to about 200° C.) for a sufficient period (commonly from about 1 second to about 2 minutes). When the heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will be further described based on examples but is by no means limited to these.

Example 1

Preparation of Photothermographic Material

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as subbing lower layer B-1), which exhibited an antistatic function, was applied onto the backing layer side. The surface of subbing Lower Layer A-1 and subbing lower layer B-1 was subjected to corona discharge treatment of 8 W·minute/$m^2$. Subsequently, subbing liquid coating composition a-2 was applied onto subbing lower layer A-1 was applied at 33° C. and 100 m/minute to result in a dried layer thickness of 0.03 μm and dried at 140° C. The resulting layer was designated as subbing upper layer A-2. Subbing liquid coating composition b-2 described below was applied onto subbing lower Layer B-1 at 33° C. and 100 m/minute to results in a dried layer thickness of 0.2 μm and dried at 140° C. The resulting layer was designated as subbing upper layer B-2. Thereafter, the resulting support was subjected to heat treatment at 123° C. for two minutes and wound up under the conditions of 25° C. and 50 percent relative humidity, whereby a subbed sample was prepared.

Preparation of Water-based Polyester A-1

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170 to 220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220 to 235° C. while a nearly theoretical amount of water being distilled away.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle size was 40 nm, and Mw was 80,000 to 100,000.

Subsequently, 850 ml of pure water was placed in a 2-liter three-necked flask fitted with stirring blades, a refluxing cooling pipe, and a thermometer, and while rotating the stirring blades, 150 g of water-soluble polyester A-1 was gradually added. The resulting mixture was stirred at room temperature for 30 minutes without any modification. Thereafter; the interior temperature was raised to 98° C. over a period of 1.5 hours and at that resulting temperature, dissolution was performed. Thereafter, the temperature was lowered to room-temperature over a period of one hour and the resulting product was allowed to stand overnight, whereby water-based polyester A-1 solution was prepared.

Preparation of Modified Water-based Polyester Solution B-1 and B-2

Into a 3-liter four-necked flask fitted with stirring blades, a reflux cooling pipe, a thermometer, and a dripping funnel was put 1,900 ml of the aforesaid 15 percent by weight water-based polyester A-1 solution, and the interior temperature was raised to 80° C., while rotating the stirring blades. Into this was added 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby modified water-based polyesters solution B-1 (vinyl based component modification ratio of 20 percent by weight) of 18 wt % solid was obtained.

Subsequently, modified water-based polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate:acetacetoxyethyl methacrylate:n-butyl acrylate=39.5:40:20:0.5.

Preparation of Acryl-based Polymer Latexes C-1 to C-3

Acryl based polymer latexes C-1 to C-3 having the monomer compositions shown in Table 1 were synthesized employing emulsion polymerization. All the solid concentrations were adjusted to 30 percent by weight.

TABLE 2

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetacetoxyethyl methacrylate = 40:40:20 | 50 |

Aqueous Polymer Containing Polyvinyl Alcohol Unit

D-1: PVA-617 [aqueous dispersion (5% solid), available from KURARAY CO., LTD., a saponification degree of 95]

| | |
|---|---|
| Coating Composition a-1: Subbing Lower Layer A-1 on Image Forming Layer Side | |
| Acryl Based Polymer Latex C-3 (30% solids) | 70.0 g |
| Aqueous dispersion of ethoxylated alcohol and ethylene homopolymer (10% solids) | 5.0 g |
| Surfactant (A) | 0.1 g |
| Distilled water to make | 1000 ml |
| Coating Composition a-2: Image Forming Layer Side Subbing Upper Layer A-2 | |
| Modified Water-based Polyester B-2 (18 wt %) | 30.0 g |
| Surfactant (A) | 0.1 g |
| Spherical silica matting agent (Sea Hoster KE-P50, manufactured by Nippon Shokubai Co., Ltd.) | 0.04 g |
| Distilled water to make | 1000 ml |
| Coating Composition b-1: Backing Layer Side Subbing Lower Layer B-1 | |
| Acryl Based Polymer Latex C-1 (30% solids) | 30.0 g |
| Acryl Based Polymer Latex C-2 (30% solids) | 7.6 g |
| $SnO_2$ sol*[1] | 180 g |
| Surfactant (A) | 0.5 g |
| Aqueous 5 wt % PVA-613 (PVA, manufactured by Kuraray Co., Ltd.) | 0.4 g |
| Distilled water to make | 1000 ml |
| Coatings Composition b-2: Backing Layer Side Subbing Upper Layer B-2 | |
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |
| Distilled water to make | 1000 ml |
| An antihalation layer having the composition described below was applied onto subbing layer A-2 on the subbed support. Antihalation Layer Coating Composition | |
| Binder: PVB-1*[2] | 0.8 g/m$^2$ |
| Dye: C1 | $1.2 \times 10^{-5}$ mol/m$^2$ |

*[1]The solid concentration of $SnO_2$ sol synthesized employing the method described in Example 1 of Japanese Patent Publication JP-B No. 35-6616 (the term, JP-B refers to Japanese Patent Publication) was heated and concentrated to reach a solid concentration of 10 percent by weight, and subsequently, the pH was adjusted to 10 by the addition of ammonia water.

Backing Layer and Protective Layer

Coating compositions of a backing layer and its protective layer which were prepared to achieve a coated amount (per $m^2$) described below was successively applied onto the subbing upper layer B-2 and subsequently dried, whereby a a backing layer and a protective layer were formed.

| Backing Layer Coating Composition | |
|---|---|
| PVB-1 (binding agent) | 1.8 g |
| C1 (dye) | $1.2 \times 10^{-5}$ mol |
| Protective Layer Coating Composition) | |
| Cellulose acetate butyrate | 1.1 g |
| Matting agent (polymethyl methacrylate of an average particle size of 5 μm) | 0.12 g |
| Antistatic agent F-EO | 250 mg |
| Antistatic agent F-DS1 | 30 mg |

Surfactant (A)

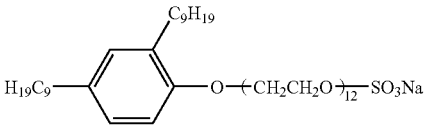

C1 (Dye)

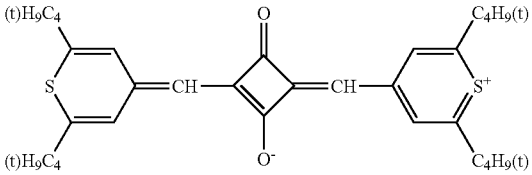

F-EO

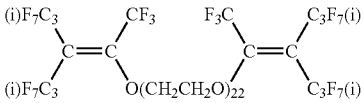

F-DS1

$LiO_3S—(CF_2)_3—SO_3Li$

| Preparation of Silver Halide Emulsion 1 | |
|---|---|
| Solution A1 | |
| Phenylcarbamoyl-modified gelatin | 88.3 g |
| Compound*3 (10% aqueous methanol solution) | 10 ml |
| Potassium bromide | 0.32 g |
| Water to make | 5429 ml |
| Solution B1 | |
| 0.67 mol/L aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| Solution E1 | |
| 0.4 mol/L aqueous potassium bromide solution in an amount to control silver potential | |

-continued

| Preparation of Silver Halide Emulsion 1 | |
|---|---|
| Solution F1 | |
| Potassium hydroxide | 0.71 g |
| Water to make | 20 ml |
| Solution G1 | |
| 56% aqueous acetic acid solution | 18.0 ml |
| Solution H1 | |
| Sodium carbonate anhydride | 1.72 g |
| Water to make | 151 ml |

*3Compound A: $HO(CH_2CH_2O)_n(CH(CH_3)CH_2O)_{17}(CH_2CH_2O)_mH$ (m + N = 5 through 7)

Using a mixing stirrer shown in JP-B Nos. 58-58288 and 58-58289, ¼ portion of solution B1 and whole solution C1 were added to solution A1 over 4 minutes 45 seconds, employing a double-jet precipitation method while adjusting the temperature to 30° C. and the pAg to 8.09, whereby nuclei were formed. After one minute, whole solution F1 was added. During the addition, the pAg was appropriately adjusted employing Solution E1. After 6 minutes, ¾ portions of solution B1 and whole solution D1 were added over 14 minutes 15 seconds, employing a double-jet precipitation method while adjusting the temperature to 30° C. and the pAg to 8.09. After stirring for 5 minutes, the mixture was cooled to 40° C., and whole solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, solution H1 was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodisperse cubic silver iodobromide grains having an average grain size of 0.040 μm, a grain size variation coefficient of 12 percent and a (100) crystal face ratio of 92 percent.

Preparation of Aliphatic Carboxylic Acid Silver Salt A

In 4,720 ml of pure water were dissolved 117.7 g of behenic acid, 60.9 g of arachidic acid, 39.2 g of stearic acid, and 2.1 g of palmitic acid at 80° C. Subsequently, 486.2 ml of a 1.5 M aqueous sodium hydroxide solution was added, and further, 6.2 ml of concentrated nitric acid was added. Thereafter, the resultant mixture was cooled to 55° C., whereby an aliphatic acid sodium salt solution was prepared. After 347 ml of t-butyl alcohol was added and stirred for 20 min, the above-described photosensitive silver halide emulsion 1 as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kigyo Co., Ltd.), while setting the drying conditions such as nitrogen gas as well as heating flow temperature at the inlet of the dryer, until its water content ratio reached 0.1 percent, whereby powdery aliphatic carboxylic acid silver salt A was prepared. The water content ratio of aliphatic carboxylic acid silver salt compositions was determined employing an infrared moisture meter.

A silver salt conversion ratio of the aliphatic carboxylic acid was confirmed to be about 95%, measured by the above-described method.

Preparation of Preliminary Dispersion A

In 1457 g of methyl ethyl ketone (hereinafter referred to as MEK) was dissolved 14.57 g of poly(vinyl butyral) resin P-9. While stirring, employing dissolver DISPERMAT Type CA-40M, manufactured by VMA-Getzmann Co., 500 g of aforesaid Powder Aliphatic Carboxylic Acid Silver Salt A was gradually added and sufficiently mixed, and Preliminary Dispersion A was thus prepared.

Preparation of Photosensitive Emulsion A

Preliminary dispersion A, prepared as above, was charged into a media type homogenizer DISPERMAT Type SL-C12EX (manufactured by VMA-Getzmann Co.), filled with 0.5 mm diameter zirconia beads (Toreselam, produced by Toray Co.) so as to occupy 80 percent of the interior volume so that the retention time in the mill reached 1.5 minutes and was dispersed at a peripheral rate of the mill of 8 m/second, whereby photosensitive emulsion A was prepared.

Preparation of Stabilizer Solution

Stabilizer solution was prepared by dissolving 1.0 g of stabilizer 1 and 0.31 g of potassium acetate in 4.97 g of methanol.

Preparation of Infrared Sensitizing Dye A Solution

Infrared sensitizing dye A solution was prepared by dissolving 19.2 mg of infrared sensitizing dye 1, 10 mg of infrared sensitizing dye 2, 1.48 g of 2-chloro-benzoic acid, 2.78 g of stabilizer 2, and 365 mg of 5-methyl-2-mercapto-benzimidazole in 31.3 ml of MEK in a dark room.

Preparation of Additive Solution "a"

Additive solution "a" was prepared by dissolving 27.98 g of 1,1-bis(2-hydroxy-3,5-dimethylphenyl)-3,5,5-trimethylhexane (developer A) and 1.54 g of 4-methylphthalic acid, and 0.20 g of aforesaid infrared dye 1 in 110 g of MEK.

Further, in addition to the foregoing developer A, a compound (at an equimolar amount to developer A) selected from the group of exemplified compounds of formula (RED) or a development accelerator (at 10 mol % of the whole developer) was used, as shown in Table 1.

Preparation of Additive Solution "b"

Additive Solution "b" was prepared by dissolving 3.56 g of Antifoggant 2 and 3.43 g of phthalazine in 40.9 g of MEK.

Preparation of Light-sensitive Layer Coating Composition A

While stirring, 50 g of aforesaid light-sensitive emulsion A and 15.11 g of MEK were mixed and the resultant mixture was maintained at 21° C. Subsequently, 390 μl of antifoggant 1 (being a 10 percent methanol solution) was added and stirred for one hour. Further, 494 μl of calcium bromide (being a 10 percent methanol solution) was added and stirred for 20 minutes. Subsequently, 167 ml of aforesaid stabilizer solution was added and stirred for 10 minutes. Thereafter, 1.32 g of the foregoing infrared sensitizing dye A was added and the resulting mixture was stirred for one hour. Subsequently, the resulting mixture was cooled to 13° C. and stirred for an additional 30 minutes. While maintaining at 13° C., 13.31 g of poly(vinyl acetal) resin P-1 as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of additive solution "a", 1.6 ml of Desmodur N300/aliphatic isocyanate, manufactured by Mobay Chemical Co. (being a 10 percent MEK solution), and 4.27 g of additive Solution "b" were successively added, whereby light-sensitive layer coating composition A was prepared.

Preparation of Surface Protective Layer Coating Composition

The coating composition having the formulation described below was prepared in the same manner as the foregoing light-sensitive layer coating composition and was subsequently applied onto a photosensitive layer to result in the coated amount (per $m^2$) below, and subsequently dried, whereby a photosensitive layer protective layer was formed.

| | |
|---|---|
| Cellulose acetate propionate | 2.0 g |
| 4-Methyl phthalate | 0.7 g |
| Tetrachlorophthalic acid | 0.2 g |
| Tetrachlorophthalic anhydride | 0.5 g |
| Silica matting agent (at an average diameter of 5 μm) | 0.5 g |
| 1,3-bis(vinylsulfonyl)-2-propanol | 50 mg |
| Benzotriazole | 30 mg |
| Antistatic Agent: F-EO | 20 mg |
| Antistatic Agent: F-DS1 | 3 mg |

There were used polyacetal as a binder and methyl ethyl ketone (MEK) as an organic solvent. Polyacetal was obtained by 98% saponification a poly(vinyl acetate) having a degree of polymerization of 500, followed by acetal formation of 86% of the whole hydroxy group.

Preparation of Photothermographic Material

Light-sensitive layer coating composition A and surface protective layer coating composition, prepared as above, were simultaneously coated onto the subbing layer on the support prepared as above, employing a prior art extrusion type coater, and sample 101 was prepared. Coating was performed so that the thickness of the light-insensitive layer was 3.7 μm, the coated silver amount of the photosensitive layer was 1.5 g/$m^2$ and the thickness of the surface-protective layer reached 2.5 μm after drying. Thereafter, drying was performed employing a drying air flow at a drying temperature of 75° C. and a dew point of 10° C. for 10 minutes, and photothermographic material sample 101 was thus obtained.

Samples 102 to 126 were prepared similarly to sample 101, except that the kind of a slight-sensitive silver halide emulsion contained in the light-sensitive layer coating composition A, a developer (comparative developer of the additive solution a), the proportion of silver behenate of aliphatic acid silver salts, drying conditions, a compound of formula (ST), a compound of formula (CV) and a polymer containing a halogen radical releasing group were varied and at least a part of P-1 was replaced by the dispersion particles o f the invention as shown in Table 3. When the proportion of silver behenate was varied, the relative ratio of contents of silver arachidate, silver stearate and silver palmitate was kept constant.

The contents of a compound of formula (ST), a compound of formula (CV) and a polymer containing a halogen radical releasing group and their addition are as follows. The compound of formula (ST) was added to the light-sensitive layer coating composition at a coating weight of 0.015 g/m$^2$ immediately before coating. The compound of formula (CV) was added to the protective layer coating composition at a coating weight of 0.135 g/m$^2$ immediately before coating. The polymer containing a halogen radical releasing group was added to the light-sensitive layer coating composition at a coating weight of 0.45 g/m$^2$ immediately before coating.

Stabilizer 1

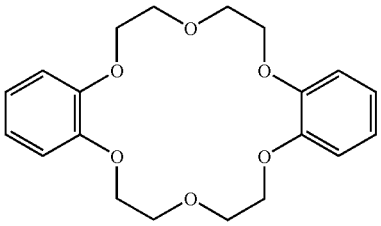

Sulfur sensitizer S-5

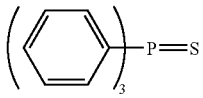

Antifoggant 1

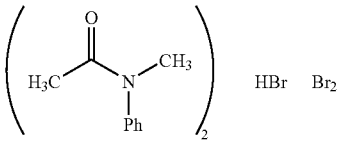

ETTU

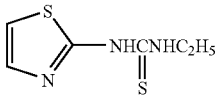

Stabilizer 2

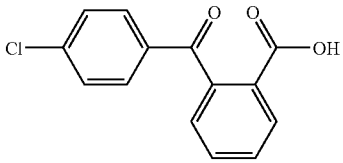

Antifoggant 2

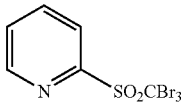

Infrared sensitizing dye 1

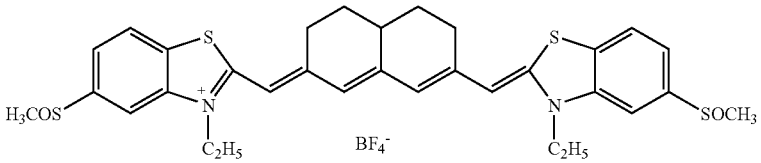

Infrared sensitizing dye 2

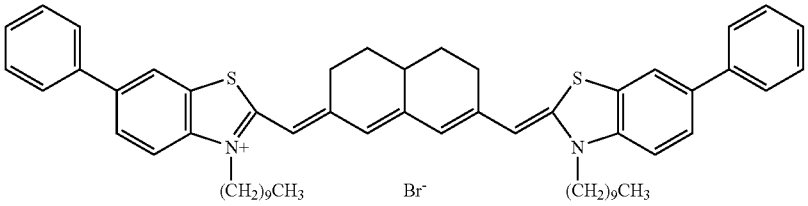

Sensitizing dye A

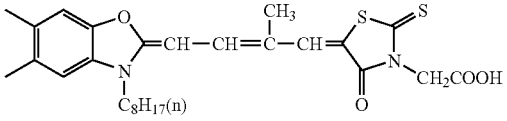

Sensitizing dye B

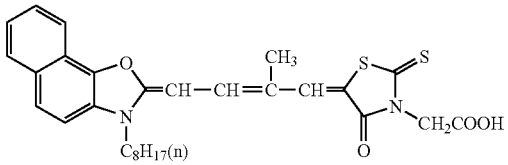

Tellurium sensitizing C

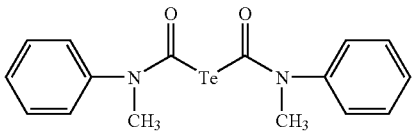

-continued

Base precursor compound-1

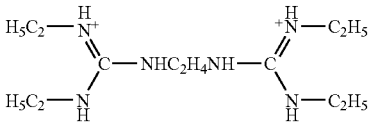

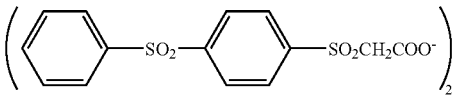

Phthalazine compound-1

Development accelerator-1

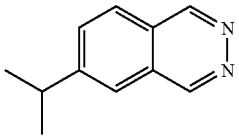

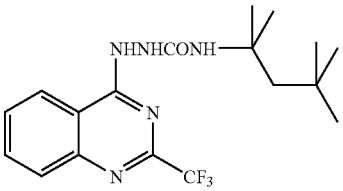

Development accelerator-2

Development accelerator-3

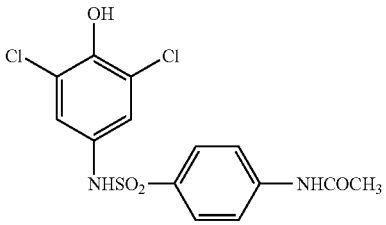

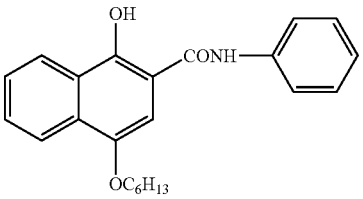

Image toning agent-1

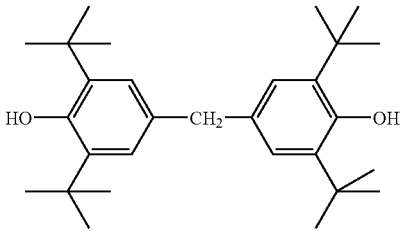

Evaluation of Photothermographic Material

Exposure and Processing

Scanning exposure was applied onto the emulsion side surface of each sample prepared as above, employing an exposure apparatus in which a semiconductor laser, which was subjected to a longitudinal multi-mode at a wavelength of 800 to 820 nm, employing high frequency superposition, was employed as a laser beam source. In such a case, images were formed while adjusting the angle between the exposed surface of the sample and the exposure laser beam to 75 degrees. By employing such a method, compared to the case in which the angle was adjusted to 90 degrees, images were obtained with minimized unevenness and which exhibited surprisingly excellent sharpness.

Thereafter, while employing an automatic processor having a heating drum, the protective layer of each sample was brought into contact with the surface of the drum and thermal development was carried out at 110° C. for 15 sec. In such a case, exposure as well as development was carried out in an atmosphere which was maintained at 23° C. and 50% relative humidity.

Sensitivity, Fog and Maximum Density

The visual transmission density of the resulting silver images formed as above was measured employing a densitometer and characteristic curves were prepared in which the abscise shows the exposure amount and the ordinate shows the density. Utilizing the resulting characteristic curve, sensitivity (also denoted simply as "S") was defined as the reciprocal of an exposure amount to give a density higher 1.0 than the unexposed area, and fog density (also denoted simply as Dmin) as well as maximum density (also denoted simply as "Dmax) was determined. The sensitivity and the maximum density were represented by a relative value, based on each of the sensitivity and the maximum density of Sample 101 being 100.

Image Lasting Quality

Each of thermally developed samples, which had been prepared in the same manner as for the foregoing sensitivity determination, was allowed to stand for three days at 45° C. and 55% RH while a commercially available fluorescent lamp was arranged so as to give an illuminance of 500 lux on the surface of each sample. The minimum density (D2) of each of the fluorescent light-exposed samples and the minimum density (D1) of each of the fluorescent light-unexposed samples were determined, and the variation rate (in percent) of minimum density was calculated based on the formula described below.

$$\text{Variation rate of minimum density } (\Delta Dmin) = D2/D1 \times 100\ (\%)$$

Each of thermally developed samples, which had been prepared in the same manner as the determination of the variation ratio of minimum density, was allowed to stand for three days at 25° C. and 45° C. Thereafter, the variation of the maximum density was determined, and the variation rate of image density was determined based on the formula described below, which was utilized as the scale of the image lasting quality:

Variation rate of maximum density ($\Delta Dmax$) = maximum density of the sample aged at 45° C./maximum density of the sample aged at 25° C.×100 (%).

Raw Stock Stability

After aged for 10 days under two conditions A and B described below, samples were also exposed and processed similarly to the foregoing sensitometry and the sensitivity, minimum density and maximum density of each of the samples were measured to determine, as a measure of raw stock stability, the rate of change of minimum density (Dmin) and maximum density (Dmax) under the condition B based on those under the condition A, according to the equation as below. Samples were each cut to a size of 345 mm×430 mm, packed in a package material (PET 10 μm/PE 12 μm/aluminum foil 9 μm/Nyl 15 μm/3% carbon containing polyethylene (PE) 50 μm; oxygen permeability: 0 ml/$1\times10^5$ Pa·$m^2$·25° C.·day; moisture permeability: 0 g/$1\times10^5$ Pa·$m^2$·25° C.·day, and kept under the following conditions:

condition A: 25° C., 55% RH, condition B: 40° C., 80% RH, rate of change=(minimum density or sensitivity under condition $B$)/(minimum density or sensitivity under condition $A$)×100(%)

Evaluation of Odor

Samples were each converted to film and wound up under 23° C. and 50% RH, and the film was cut to a size of 18 cm×30 cm and sealed within 1 min in a ten-sheet moisture-proof barrier bag within 1 min.

Samples were also processed similarly to the above and immediately after processed, 18 cm×30 cm film was sealed in a ten-sheet moisture-proof barrier bag under 23° C. and 50% RH.

The samples thus obtained before and after processing were subjected to sensory test and evaluated with respect to odor of the film surface.

Further, samples were each placed on a hot plate of 120° C. under 23° C. and 50% RH, while being in contact with the backing layer, and order of the film surface was evaluated based on the sensory test.

Odor was evaluated and ranked based on the following criteria:

5: a level of no odor being perceived,

4: a level of extremely slight odor being perceived,

3: a level of slight odor being perceived

2: a level of odor being perceived,

1: a level of strong odor being perceived.

In the foregoing ranks, the intermediate rank was represented by a decimal.

Friction Factor

The friction factor was measured in an atmosphere of 23° C. and 50% RH with respect to the protective layer surface of each of the unprocessed samples.

Drying condition 1: 75° C., 10 hr.

Drying condition 2: 60° C., 10 hr.

TABLE 3

| Sample No. | *1 | *2 | Developer or Development Accelerator | Leuco Dye | *3 | *4 | *5 | Dispersing Particle (%)*6 | Drying Condition *7 |
|---|---|---|---|---|---|---|---|---|---|
| 101 | 1 | 54 (K100) | A (RED-12) | — | — | — | — | — | 1 |
| 102 | 1 | 54 (K100) | A (RED-12) | — | — | — | — | — | 2 |
| 103 | 1 | 54 (K100) | A (RED-12) | — | — | — | — | PB-1 (80) | 2 |
| 104 | 1 | 54 (K100) | A (RED-12) | — | — | — | — | PB-2 (80) | 2 |
| 105 | 1 | 54 (K100) | A (RED-12) | — | — | — | — | PB-3 (5) | 2 |
| 106 | 1 | 54 (K100) | A (RED-12) | — | — | — | — | PB-3 (10) | 2 |
| 107 | 1 | 54 (K100) | A (RED-12) | — | — | — | — | PB-3 (40) | 2 |
| 108 | 1 | 54 (K100) | A (RED-12) | — | — | — | — | PB-3 )60) | 2 |
| 109 | 1 | 54 (K100) | A (RED-12) | — | — | — | — | PB-3 (80) | 1 |
| 110 | 1 | 54 (K100) | A (RED-12) | — | — | — | — | PB-3 (80) | 2 |
| 111 | 1 | 54 (K100) | A (RED-12) | — | — | — | — | PB-3 (90) | 2 |
| 112 | 1 | 54 (K100) | A (RED-12) | — | — | — | — | PB-3 (98) | 2 |
| 113 | 1 | 54 (K100) | A (RED-12) | — | — | — | — | PB-4 (80) | 2 |
| 114 | 1 | 54 (K100) | A (RED-12) | — | — | — | — | PB-5 (80) | 2 |
| 115 | 1 | 54 (K100) | A (RED-12) | — | — | — | — | PB-6 (80) | 2 |
| 116 | 1 | 54 (K100) | A (RED-12) | — | — | — | — | PB-7 (80) | 2 |
| 117 | 1 | 54 (K100) | A (RED-12) | — | — | — | — | PB-8 (80) | 2 |
| 118 | 1 | 54 (K100) | A (RED-12) | — | — | — | — | PB-9 (80) | 2 |
| 119 | 1 | 54 (K100) | A (RED-12) | — | — | — | — | PB-10 (80) | 2 |
| 120 | 1 | 54 (K100) | A (RED-12) | — | — | — | — | PB-11 (80) | 2 |
| 121 | 2 | 54 (K100) | A (RED-12) | — | — | — | — | — | 2 |
| 122 | 2 | 54 (K100) | A (RED-12) | — | — | — | — | PB-3 (80) | 2 |
| 123 | 2 | 54 (K100) | A (RED-12) | — | — | — | — | PB-7 (80) | 2 |
| 124 | 2 | 98 (K100) | RED-17/−10 | YL-3/CL-8 | ST-21 | CV-133 | XP5 | — | 2 |
| 125 | 2 | 98 (K100) | RED-17/−10 | YL-3/CL-8 | ST-21 | CV-133 | XP5 | PB-3 (80) | 2 |
| 126 | 2 | 98 (K100) | RED-17/−10 | YL-3/CL-8 | ST-21 | CV-133 | XP5 | PB-7 (80) | 2 |

*1silver halide emulsion
*2content of behenic acid
*3compound of formula (ST)
*4compound of formula (CV)
*5polymer having a halogen radical releasing group
*6volume fraction of dispersing particles replacing P-1
*7drying condition 1 at 75° C., 10 hr.
drying condition 2 at 60° C., 10 hr.

TABLE 4

| Sample No. | Fog | S | Dmax | Raw Stock Stability ΔDmin (%) | Raw Stock Stability ΔDmax (%) | Image Lasting Quality ΔDmin (%) | Image Lasting Quality ΔDmax (%) | Friction factor | Odor (Sensory Test) 23° C. before processing | Odor (Sensory Test) 23° C. after processing | Odor (Sensory Test) 120° C. during processing | Remark |
|---|---|---|---|---|---|---|---|---|---|---|---|---|
| 101 | 0.240 | 100(28) | 100 | 125 | 75 | 145 | 85 | 0.42 | 2 | 2.5 | 1 | Comp. |
| 102 | 0.240 | 102(29) | 98 | 127 | 70 | 148 | 85 | 0.45 | 1 | 1.5 | 1 | Comp. |
| 103 | 0.190 | 130(30) | 135 | 103 | 98 | 105 | 96 | 0.32 | 4 | 4 | 4 | Inv. |
| 104 | 0.192 | 133(29) | 134 | 102 | 97 | 106 | 95 | 0.3 | 4 | 4 | 4 | Inv. |
| 105 | 0.240 | 101(30) | 105 | 120 | 76 | 141 | 86 | 0.47 | 1 | 1.5 | 1 | Comp. |
| 106 | 0.198 | 125(28) | 132 | 103 | 98 | 105 | 96 | 0.34 | 4 | 4 | 4 | Inv. |
| 107 | 0.195 | 130(30) | 132 | 100 | 100 | 104 | 97 | 0.32 | 4 | 4 | 4 | Inv. |
| 108 | 0.190 | 132(28) | 130 | 99 | 100 | 103 | 97 | 0.3 | 4 | 4 | 4 | Inv. |
| 109 | 0.195 | 135(28) | 128 | 101 | 99 | 106 | 99 | 0.3 | 4 | 4 | 4 | Inv. |
| 110 | 0.187 | 130(29) | 130 | 99 | 100 | 105 | 100 | 0.3 | 4 | 4 | 4 | Inv. |
| 111 | 0.185 | 132(29) | 131 | 98 | 100 | 104 | 97 | 0.31 | 4 | 4 | 4 | Inv. |
| 112 | 0.220 | 108(31) | 104 | 122 | 78 | 140 | 87 | 0.45 | 2 | 2.5 | 2 | Comp. |
| 113 | 0.188 | 131(28) | 130 | 100 | 99 | 105 | 97 | 0.3 | 4 | 4 | 4 | Inv. |
| 114 | 0.185 | 133(27) | 132 | 99 | 100 | 104 | 98 | 0.28 | 4 | 4 | 4 | Inv. |
| 115 | 0.182 | 130(27) | 133 | 101 | 100 | 104 | 98 | 0.28 | 4 | 4 | 4 | Inv. |
| 116 | 0.195 | 125(26) | 126 | 102 | 98 | 108 | 99 | 0.32 | 4 | 4 | 4 | Inv. |
| 117 | 0.194 | 122(28) | 124 | 101 | 98 | 107 | 97 | 0.35 | 4 | 4 | 4 | Inv. |
| 118 | 0.190 | 120(27) | 125 | 100 | 98 | 110 | 98 | 0.34 | 4 | 4 | 4 | Inv. |
| 119 | 0.192 | 121(28) | 127 | 102 | 97 | 109 | 97 | 0.33 | 4 | 4 | 4 | Inv. |
| 120 | 0.193 | 121(29) | 129 | 102 | 98 | 107 | 98 | 0.35 | 4 | 4 | 4 | Inv. |
| 121 | 0.215 | 125(5) | 130 | 109 | 90 | 118 | 90 | 0.45 | 2 | 2.5 | 1 | Comp. |
| 122 | 0.170 | 148(4) | 141 | 100 | 100 | 102 | 99 | 0.3 | 5 | 5 | 5 | Inv. |
| 123 | 0.172 | 145(3) | 140 | 101 | 101 | 104 | 98 | 0.28 | 5 | 5 | 5 | Inv. |
| 124 | 0.152 | 138(3) | 139 | 107 | 88 | 110 | 92 | 0.43 | 2 | 2.5 | 1 | Comp. |
| 125 | 0.145 | 155(3) | 152 | 100 | 99 | 101 | 100 | 0.28 | 5 | 5 | 5 | Inv. |
| 126 | 0.142 | 152(2) | 150 | 99 | 100 | 100 | 99 | 0.27 | 5 | 5 | 5 | Inv. |

In the sensitivity column of Table 4, values in parentheses represent a relative value of the sensitivity obtained when prior to exposure to white light (4874K, 30 sec.), pre-heated at a thermal development temperature and then exposed and thermally developed, based on the sensitivity obtained when exposed and thermally developed being 100. As shown therein, it was proved from observation/measurement of spectral sensitivity and the like that a decrease in sensitivity obtained when preheated prior to white light exposure and thermal development, then exposed and thermally developed, was mainly caused by disappearance or decrease of spectral and chemical sensitization effects, whereby the relative relationship between surface and internal sensitivities of silver halide grains changed.

As can be seen from the Tables, it was shown that photothermographic material samples of this invention exhibited enhanced sensitivity and maximum density as well as reduced fogging (minimum density) and resulting in superior storage stability and reduced odor even when being thermally developed.

What is claimed is:

1. A photothermographic material comprising on a support a light-sensitive layer comprising a light-insensitive silver salt of an aliphatic carboxylic acid, light-sensitive silver halide grains, a reducing agent for silver ions and a binder, wherein the light-sensitive layer further comprises nonaqueous dispersion particles, insoluble in an organic solvent.

2. The photothermographic material of claim 1, wherein the nonaqueous dispersion particles are polymeric particles having an average primary particle size of from 0.05 to 0.5 μm.

3. The photothermographic material of claim 2, wherein a difference in solubility parameter between the polymeric particle and methyl ethyl ketone is from 0.0 to 3.5.

4. The photothermographic material of claim 2, wherein the polymeric particles are comprised of at least one acrylic resin exhibiting a glass transition point of 60° C. or more.

5. The photothermographic material of claim 4, wherein the polymeric particles are each comprised of a core and a shell and the shell exhibiting a glass transition point of 60° C. or more.

6. The photothermographic material of claim 2, wherein the polymeric particles are comprised of crosslinked resin.

7. The photothermographic material of claim 6, wherein the crosslinked resin is one obtained by copolymerization of a crosslinkable monomer with other monomers.

8. The photothermographic material of claim 6, wherein the crosslinked resin is one obtained by copolymerization of a conjugated diene monomer with a vinyl aromatic hydrocarbon.

9. The photothermographic material of claim 1, wherein the photothermographic material meets the following $$S_2/S_1 \leqq 0.2$$

wherein $S_1$ represents a sensitivity obtained when exposed and thermally developed, and $S_2$ represents a sensitivity obtained when subjected to a heat treatment at 123° C. for 15 sec., then, exposed and thermally developed.

10. The photothermographic material of claim 1, wherein the silver halide grains each internally contain a dopant capable of functioning as an electron trap after being thermally developed.

11. The photothermographic material of claim 10, wherein the dopant is occluded in an amount of from $1\times10^{-8}$ to $1\times10^{-1}$ mol per mol of silver halide.

12. The photothermographic material of claim 10, wherein the dopant is selected from the group consisting of metal ions except for silver ion and their salts or complexes, chalcogens, chalcogen- or nitrogen-containing compounds, and rare earth ions and their complexes.

13. The photothermographic material of claim 12, wherein the dopant is selected from the group consisting of lead ion, bismuth ion, gold-ion, and their salts.

14. The photothermographic material of claim 12, wherein the dopant is a complex of a transition metal ion selected from the group consisting of W, Fe, Co, Ni, Cu, Ru, Rh, Pd, Os, Ir and Pt.

15. The photothermographic material of claim 10, wherein the dopant is selected from the group consisting of chalcogens and chalcogen- or nitrogen-containing compounds.

16. The photothermographic material of claim 1, wherein the silver halide grains are silver bromide or silver iodobromide.

* * * * *